US009661418B2

(12) United States Patent
Butler et al.

(10) Patent No.: US 9,661,418 B2
(45) **Date of Patent: *May 23, 2017**

(54) METHOD AND SYSTEM FOR LARGE SCALE AUDIO SYSTEM

(71) Applicants: Nathan Butler, Sterling, MA (US); Steven Desrosiers, Woonsocket, RI (US); Matthew Joseph Dube, Westborough, MA (US); Geoffrey Peter McKinnon, Woonsocket, RI (US); Jeffrey A. Rocha, Paxton, MA (US); John Francis Dugan, Millville, MA (US)

(72) Inventors: Nathan Butler, Sterling, MA (US); Steven Desrosiers, Woonsocket, RI (US); Matthew Joseph Dube, Westborough, MA (US); Geoffrey Peter McKinnon, Woonsocket, RI (US); Jeffrey A. Rocha, Paxton, MA (US); John Francis Dugan, Millville, MA (US)

(73) Assignee: LOUD TECHNOLOGIES INC, Woodinville, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/727,780

(22) Filed: Jun. 1, 2015

(65) Prior Publication Data

US 2015/0358734 A1 Dec. 10, 2015

Related U.S. Application Data

(63) Continuation-in-part of application No. 14/683,009, filed on Apr. 9, 2015, which is a continuation-in-part (Continued)

(51) Int. Cl.
*H04R 29/00* (2006.01)
*H04R 3/12* (2006.01)

(Continued)

(52) U.S. Cl.
CPC ..... *H04R 3/12* (2013.01); *G10K 11/22* (2013.01); *G10K 11/26* (2013.01); *H04R 1/02* (2013.01);

(Continued)

(58) Field of Classification Search
CPC ..... G10K 11/178; G10K 11/1788; G10K 2210/1291; G10K 2210/3028;

(Continued)

(56) References Cited

U.S. PATENT DOCUMENTS 1,752,526 A 4/1930 Hinckley
2,058,132 A 10/1936 Cirelli (Continued)

FOREIGN PATENT DOCUMENTS

GB 2 230 682 A 10/1990
JP 63-236498 A 10/1988
JP 2009-65609 A 3/2009

OTHER PUBLICATIONS

"Airline LA12: 3-Way Symmetrical High Output Line Array System," Product Data, Apr. 2012, Coda Audio GmbH, Hannover, Germany, <http://www.codaaudio.com/products/line-arrays/airline-la-series/airline-la12/airline-la12 -overview/>, p. 5.

(Continued)

*Primary Examiner* — Akelaw Teshale
(74) *Attorney, Agent, or Firm* — Christensen O'Connor Johnson Kindness PLLC

(57) ABSTRACT

Audio loudspeaker 300 can be arranged in various vertical arrays, such as 302. Each loudspeaker 300 is identical in construction and includes a housing 310 generally in the (Continued)

shape of a rectangular cuboid. A pair of ultra low-frequency transducers 300 are positioned in the housing 310. Each of the ultra low-frequency transducers is individually powered and controlled by a separate DSP channel, thereby to directionally steer the transducer output.

25 Claims, 45 Drawing Sheets

Related U.S. Application Data of application No. 14/489,340, filed on Sep. 17, 2014, now Pat. No. 9,215,524, which is a continuation-in-part of application No. 13/832,817, filed on Mar. 15, 2013, now Pat. No. 9,219,954, application No. 14/727,780, filed on Jun. 1, 2015, which is a continuation-in-part of application No. 29/512,448, filed on Dec. 18, 2014, now Pat. No. Des. 746,264.

(51) Int. Cl.

| | |
|---|---|
| ***H04R 1/02*** | (2006.01) |
| ***G10K 11/22*** | (2006.01) |
| ***G10K 11/26*** | (2006.01) |
| ***H04R 1/30*** | (2006.01) |
| ***H04R 1/40*** | (2006.01) |
| ***H04R 27/00*** | (2006.01) |
| *H04R 1/34* | (2006.01) |

(52) U.S. Cl.

CPC ..... *H04R 1/30* (2013.01); *H04R 1/403* (2013.01); *H04R 27/00* (2013.01); *H04R 1/345* (2013.01); *H04R 29/001* (2013.01); *H04R 2201/34* (2013.01); *H04R 2400/13* (2013.01)

(58) Field of Classification Search

CPC ... G10K 2210/121; G10K 2210/30391; G10K 2210/503

USPC ..... 381/71.4, 58, 71.1, 71.11, 71.8, 59, 103, 381/17, 303, 307, 56, 63, 64, 66, 92, 100, 381/101, 111, 122, 300, 313, 315, 317, 381/320, 321, 387, 57, 61, 79, 84, 86, 89, 381/91, 95, 98, 99

See application file for complete search history.

(56) References Cited

U.S. PATENT DOCUMENTS

| | | | | |
|---|---|---|---|---|
| 4,344,504 | A | 8/1982 | Howze | |
| 4,629,029 | A | 12/1986 | Gunness | |
| 4,923,031 | A | 5/1990 | Carlson | |
| 5,070,530 | A | 12/1991 | Grodinsky | |
| 5,519,572 | A | 5/1996 | Luo | |
| 5,715,322 | A | 2/1998 | Yoshioka | |
| 5,996,728 | A * | 12/1999 | Stark | H04R 1/028 181/144 |
| 6,035,051 | A | 3/2000 | Sato | |
| 6,112,847 | A | 9/2000 | Lehman | |
| 6,118,883 | A | 9/2000 | Rocha | |
| 6,393,131 | B1 | 5/2002 | Rexroat | |
| 6,394,223 | B1 | 5/2002 | Lehman | |
| 6,668,969 | B2 | 12/2003 | Meyer | |
| 6,712,177 | B2 | 3/2004 | Ureda | |
| D500,025 | S | 12/2004 | Vincenot | |
| D500,306 | S | 12/2004 | Noselli | |
| 7,392,880 | B2 | 7/2008 | Buck | |
| 7,454,029 | B2 | 11/2008 | Andrews | |
| 7,590,257 | B1 | 9/2009 | Blanchard | |
| D637,580 | S | 5/2011 | Aranda, Jr. | |
| D654,473 | S | 2/2012 | Paddock | |
| 8,199,953 | B2 | 6/2012 | Buccafusca | |
| 8,224,001 | B1 | 7/2012 | Waller | |
| 8,275,160 | B2 * | 9/2012 | Kushida | H04R 3/12 381/17 |
| D676,827 | S | 2/2013 | Desrosiers | |
| D690,280 | S | 9/2013 | Schul | |
| D714,253 | S | 9/2014 | Aglassinger | |
| 2002/0038740 | A1 | 4/2002 | Ureda | |
| 2003/0132056 | A1 | 7/2003 | Meyer | |
| 2004/0218773 | A1 | 11/2004 | Andrews | |
| 2006/0169530 | A1 | 8/2006 | Noselli | |
| 2011/0205347 | A1 * | 8/2011 | MacNaughton | H04N 13/0438 348/56 |
| 2011/0222698 | A1 * | 9/2011 | Asao | G10K 11/1784 381/71.1 |
| 2011/0305347 | A1 * | 12/2011 | Wurm | G10K 11/178 381/71.1 |
| 2012/0213387 | A1 | 8/2012 | Blore | |

OTHER PUBLICATIONS

"Cohedra™ CDR 208 S/T" (Product Information), HK Audio, Germany, <www.hkaudio.com/products.php?id=205>, 2011, 5 pages.

"DSA250i: 2-Way Full-Range Digitally Steerable Array," Part No. RD0383 (A) DSA250i SPEC (Specifications), Eastern Acoustic Works, Whitinsville, Mass., <www.eaw.com/docs/2_legacy.../DSA250i/DSA250i_SPECS_revA.pdf>, Feb. 2007, 5 pages.

"Flashline : TFS-900H: Four-Way Line Array Module" (Product Information), Oct. 2011, Turbosound, Partridge Green, UK, <http://www.turbosound.com/docs/products/TFS-900H.shtml>, 2 pages.

"GTO Tech Specs" (Product Information), Outline s.r.l., Flero, Italy, <http://89.96.202.198/GTO/index_eng_3.htm>, 12 pages.

International Search Report and Written Opinion mailed Jun. 6, 2014, issued in corresponding International Application No. PCT/US2014/021959, filed Mar. 7, 2014, 9 pages.

"KF740: 3-Way Full Range Loudspeaker," Part No. RD0510 (A) KF740 SPEC (Specifications), Eastern Acoustic Works, Whitinsville, Mass., <http://www.eaw.com/KF740>, Nov. 2009, 7 pages.

"KF760," Part No. KF760/0002962/2 (Specifications), Eastern Acoustic Works, Whitinsville, Mass., <http://www.eaw.com/KF760>, Apr. 2002, 3 pages.

"KF910," Part No. KF910/888056(A)12 (Specifications), Eastern Acoustic Works, Whitinsville, Mass., <http://www.manualslib.com/download/41874/Eaw-Kf910.html>, Jan. 29, 1999, 3 pages.

"KIVA Modular WST® Line Source," Product Spec Sheet KIVA_SP_EN_04-1/06-10, L-Acoustics, Marcoussis, France, <http://www.l-acoustics.com/products-kiva-31.html>, Jun. 2010, 1 page.

"LS432," Publication No. LS432-888138(A)/2 (Technical Specifications ), Eastern Acoustic Works, Whitinsville, Mass., <eshop.prodance.cz/Files/LS432_POLAR.pdf>, Feb. 1, 1999, 21 pages.

"LS832," Publication No. LS832-888139 (A)/2 (Technical Specifications), Eastern Acoustic Works, Whitinsville, Mass., <eshop.prodance.cz/Files/LS832_POLAR.pdf>, 21 pages.

"MILO™: High-Power Curvilinear Array Loudspeaker," Product No. 04.132.096.01 C, Datasheet, Meyer Sound Laboratories Inc., Berkeley, Calif., <http://www.meyersound.com/products/mseries/milo/>, 2003, 4 pages.

"MLA Compact™: Multi-Cellular Loudspeaker Array" (Product Information), Martin Audio, London, <http://www.martinaudio-mla.com/downloads/brochuredownloads>, 10 pages.

"MLA™ Multi-Cellular Loudspeaker Array: MLA System Dual Hybrid® Bass Section" (Product Information), Martin Audio, London, <http://www.martinaudio-mla.com/downloads/brochuredownloads>, 2010, p. 15.

"NTL720: 3-Way Self-Powered, 110° × 12°," Part No. NTL720 SPEC (Specifications), Eastern Acoustic Works, Whitinsville, Mass., <http://www.eaw.com/NTL720>, Nov. 2007, 3 pages.

"PACRIM Line Array PA Speaker System From Turnaround360" (Product Information), PacRim, UK, <http://pacrim.co.uk/L5-longthrow.html>, 6 pages.

(56) References Cited

OTHER PUBLICATIONS

"VerTec© Series, Subcompact Models," Publication No. CAT VTSUB-25 (Product Information), JBL by Harman, Northridge, Calif., <http://www.jblpro.com/catalog/support/getfile.aspx?doctype=3&docid=1453>, Mar. 2011, 6 pages.
"VTX V25: RBI Radiation Boundary Integrator® and VTX Waveguide," Publication No. CAT VTX-25 (Product Information), JBL by Harman, Northridge, Calif., <http://www.jblpro.com/products/tour/vtx/specs.html>, Sep. 2012, 12 pages.

* cited by examiner (FRONT VIEW)

(SIDE VIEW)

Horizontal Polar Data
Unadapted

Maximum SPL

Maximum Rejection

Vertical Polar Data

Unadapted

Maximum SPL

Maximum Rejection

METHOD AND SYSTEM FOR LARGE SCALE AUDIO SYSTEM

CROSS-REFERENCES TO RELATED APPLICATIONS

This application is a continuation-in-part of U.S. application Ser. No. 14/683,009, filed Apr. 9, 2015, which is a continuation-in-part of U.S. application Ser. No. 14/489,340, filed Sep. 17, 2014, which is a continuation-in-part of U.S. application Ser. No. 13/832,817, filed Mar. 15, 2013, and this application also is a continuation-in-part of U.S. Design application No. 29/512,448, filed Dec. 18, 2014, all of the disclosures of which are hereby incorporated by reference herein in their entirety.

BACKGROUND

Typically, sound systems for live concert touring are owned by a professional sound provider and travel in one of many tractor/trailer trucks with all the band's production equipment. This can include lighting, video, staging and the band's instruments. A variety of speaker types is typically carried on the tour to accommodate the variety of seating arrangements various venues may provide.

Typically, a large line array is used to cover the main audience area and the farthest areas of an arena or stadium. Smaller line arrays are used to cover the outer sides and center of the audience area. Additional speakers are then also used on stage to cover the closest audience members. There are typically 2 to 7 or more separate loudspeaker arrays brought in and flown (installed) on the day of the show. As most systems are symmetric on the left and right, 1 to 4 or more arrays must be designed to fit their respective coverage areas. The arrays may comprise high, mid and low frequency speakers, as well as subwoofer (ultra low frequency) speakers.

With existing line array loudspeakers each box in the array can be set to a number of different angles relative to the adjacent box; smaller angles increase sound pressure level (SPL), larger angles increase vertical coverage. To get a general idea of the number of speakers required and location for array, acoustic modeling software is used to roughly "draw" the venue prior to the show. This initial look provides a starting point for future modeling, but not the actual angles or orientations of the speakers that need to be implemented on show day.

To fine-tune the speaker angles for the actual performance, a system engineer will arrive early in the morning at the venue to measure the dimensions of the room (typically with a laser range finder), and verify the actual suspension locations and trim height limitations. The venue configuration will then be modified in the modeling software and appropriate array angles and trim heights are chosen. This work must be completed before the loudspeakers can be flown (installed) in the venue.

The loudspeakers are then flown in the venue. Flying each array is a labor-intensive process. Large format loudspeakers typically weigh in excess of 200 lbs. Inter-cabinet angles must be set between each cabinet, typically at more than one point per cabinet. If angles are set incorrectly or the trim height is incorrect, the system could have non-ideal coverage, or worse, not cover the entire audience. Once all the arrays are flown, connected and powered, the system technician will take acoustical measurements of the system to see how the performance matches their acoustic model. If performance is very poor and time permits, an array might be brought down and reconfigured. However, if time does not permit, typically only system equalization and array alignment delay can be adjusted to improve performance. In extreme cases at least some loudspeakers are unplugged to modify coverage.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

The loudspeaker system of the present disclosure includes adaptive loudspeakers, each having a housing generally in the shape of a rectangular cuboid. A pair of ultra low frequency (also "ULF") transducers are mounted back-to-back within the housing, with each of the transducers being individually powered and controlled. In addition, a digital signal processor (also "DSP") channel is provided for each transducer to control the output, including the vertical and/or horizontal directionality of each transducer. An electronic network interconnects the digital signal processing channels with each other. A control system is provided to monitor and control the operation and performance of the transducers individually. The control system includes a computer processor connected to the networked digital signal processing channels and is capable of calculating the loudspeaker output acoustic lobe formation parameters. The control system controls the operation of the transducers based on the calculated loudspeaker output lobe formation parameters.

The control system controls the digital signal processor channels to direct the acoustic output from the loudspeaker components in desired vertical and/or horizontal directions. In this regard, the control system controls at least one of the gain, delay, and response of each transducer in the loudspeaker, thereby to selectively direct the acoustic output from the loudspeaker in a desired vertical direction to achieve a desired coverage of a venue in which the loudspeaker is located, as well as to selectively direct the acoustic output of the loudspeaker in a desired horizontal direction.

Each of the loudspeakers includes a self-testing program incorporated into the circuitry of the loudspeaker, whereby to operably verify that the components of the loudspeaker are operating properly. The loudspeaker system further includes in a single housing a pair of ultra low-frequency transducers in the range of about 20-200 Hz.

The individual loudspeaker cabinets may be arranged in a vertical array, with the vertical array in substantially a straight vertical line. Also, vertical arrays of loudspeakers may be positioned side-by-side to each other to achieve a desired horizontal coverage or scope. The loudspeakers are also substantially identical in construction, including the same transducer configuration and the same number and type of transducers.

Proximity sensors are disposed on the loudspeaker to enable the control system to determine the identity and position of each loudspeaker in an array. Such proximity sensors may transmit signals in the infrared frequency range, or alternatively ultrasonic or radar-type proximity sensors may be utilized.

A tilt sensor is positioned within each of the loudspeaker cabinets, thereby to determine the tilt of each loudspeaker cabinet. The output of the tilt sensors are actively directed to the control system.

As a further aspect of the present disclosure, the self-testing program is incorporated into loudspeakers of the above configuration or into loudspeakers of other configurations. The self-test program is operable to verify that the transducers and other components of each loudspeaker are operating properly.

In accordance with a further aspect of the present disclosure, the control system for the loudspeakers of the above configuration, or loudspeakers of other configurations, can function to verify the specific location of each loudspeaker with respect to the location in the venue in question. The control system generates acoustical impulses from transducers positioned at different locations to trilaterally locate the microphone and thereby determine the distance and direction of the microphone relative to the transducers which generated the acoustical impulses. This helps to verify the configuration of the venue in question.

As a further aspect of the present disclosure, proximity sensors may be utilized in conjunction with the loudspeakers described above, or with loudspeakers of other configurations. Such proximity sensors are capable of determining the position of each loudspeaker based on the output signals from the proximity sensors. Such proximity sensors may consist of infrared proximity sensors, ultrasonic proximity sensors, or radar proximity sensors.

The present disclosure also includes a method for providing sound to a venue, including creating a model of the configuration of the venue, and assembling a plurality of loudspeakers in stacked relationship, and positioning the stacked loudspeakers so that the loudspeakers are disposed in a substantially vertical array. Each of said loudspeakers includes transducers, wherein each transducer is operated by a digital signal processor channel. Based on the modeled venue configuration, the stacked loudspeaker arrays are positioned at one or more locations at the venue. Each of the transducers is operated individually by a control system that networks all the digital processor channels together and also networks the loudspeakers together. Each of the transducers is tested and the parameters for each loudspeaker is individually specified. In this regard, the gain, delay, and/or response of each transducer is individually specified, thereby to direct sound emanating from the loudspeaker in desired vertical and/or horizontal directions.

The method includes assembling two or more vertical arrays of loudspeakers in side-by-side configuration, thereby to achieve the desired horizontal coverage.

The method also includes utilizing a rigging system to suspend the loudspeakers in substantially a straight line vertical array. The method of the present disclosure also utilizes loudspeakers which are substantially identical to each other in construction.

In the method of the present disclosure, the control system recognizes if a particular transducer is not operational, and then adjusts the output of other operational transducers to compensate for the non-operational transducer(s).

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein:

FIG. 1 is a front perspective view of a loudspeaker of the present disclosure;

FIG. 2 illustrates the rigging for a loudspeaker array of the present disclosure;

FIG. 3 illustrates loudspeakers of the present disclosure arranged in a vertical array;

FIG. 4 illustrates loudspeakers of the present disclosure arranged in two side-by-side vertical arrays;

FIG. 5 illustrates a front elevational view of a loudspeaker of FIG. 1 shown with portions broken away to view the interior of the loudspeaker;

FIG. 6 is a rear isometric view of the loudspeaker of FIG. 1;

FIG. 7 is a top plan view of FIG. 1;

FIG. 8 is a bottom view of FIG. 1;

FIG. 9 is a front elevational view of FIG. 1;

FIG. 10 is a rear elevational view of FIG. 1;

FIG. 11 is a side elevational view of FIG. 1 taken from the left side thereof;

FIG. 12 is a side elevational view of FIG. 1 taken from the right side thereof;

FIG. 13 illustrates loudspeaker arrays of the present disclosure arranged for a large indoor arena;

FIG. 14 illustrates the use of loudspeaker arrays of the present disclosure configured for an outdoor amphitheater;

FIG. 15 illustrates loudspeaker arrays of the present disclosure configured for a large tent;

FIG. 16 is an isometric view of the high-frequency compression drivers and mid-range cone transducers configured for use in a speaker of the present disclosure, shown without a housing;

FIG. 17 is a front perspective view of FIG. 16;

FIG. 18 is a view similar to FIG. 17, but with the addition of a horn wall;

FIG. 19 is a view similar to FIG. 17, but from the opposite side from that shown in FIG. 17;

FIG. 20 shows the components of FIGS. 16-19 in partially disassembled condition;

FIG. 21 is a top view of FIG. 16;

FIG. 22 is a side perspective view of FIG. 16, but with the mid-range cone transducers removed;

FIG. 23 is a top view of FIG. 22;

FIG. 24 is a rear perspective view of FIG. 22, but with the horn drivers removed;

FIG. 25 is a rear elevational view of FIG. 22;

FIG. 26 is a front perspective view of FIG. 22;

FIG. 27 is a front elevational view of FIG. 22 showing the output openings of the high-frequency housing structure;

FIG. 28 is a side elevation view of FIG. 22;

FIG. 29 is a top view of FIG. 22;

FIG. 30 is a schematic of a control system of the present disclosure;

FIG. 31 is a flow diagram of the installation and operation of an audio system of the present disclosure;

FIGS. 32-44 illustrate a subwoofer loudspeaker of the present disclosure to generate sound in the ultra-low frequency (ULF) range, wherein FIG. 32 depicts a vertical array of ULF loudspeakers;

FIG. 33 is a front top perspective view of a ULF loudspeaker of the present disclosure;

FIG. 34 is a view similar to FIG. 33 but constituting a front lower perspective view of the ULF loudspeaker;

FIG. 35 is a top cross-sectional view of FIGS. 33 and 34;

FIG. 36 is a front top perspective view similar to FIG. 33, but with the front panel cover and corner structures shown detached from the housing;

FIG. 38 is a front elevational view of FIGS. 33 and 34;

FIG. 39 is a side elevational view of FIGS. 33 and 34;

FIG. 40 illustrates the rigging for the speaker array of the present disclosure;

FIG. 41 is a schematic of a control system of the present disclosure;

FIG. 42A depicts a horizontal omnidirectional output acoustical lobe formation for a speaker of the present disclosure at frequencies 25, 31.5, 40, and 50 Hz;

FIG. 42B depicts a horizontal hypercardioid output acoustical lobe formation for the speakers of the present disclosure at frequencies 25, 31.5, 40, and 50 Hz;

FIG. 42C depicts the horizontal cardioid output pattern in the rearward direction at frequencies 25, 31.5, 40, and 50 Hz;

FIG. 42D depicts the horizontal omnidirectional output acoustical lobe formation for the speakers of the present disclosure at frequencies 63, 80, 100, and 125 Hz;

FIG. 42E depicts the horizontal hypercardioid output acoustical lobe formation for the speakers of the present disclosure at frequencies 63, 80, 100, and 125 Hz;

FIG. 42F depicts the horizontal cardioid output acoustical lobe formation for the speakers of the present disclosure at frequencies 63, 80, 100, and 125 Hz;

FIG. 43A depicts the vertical omnidirectional output from the speakers of the present disclosure at frequencies 25, 31.5, 40, and 50 Hz;

FIG. 43B depicts the vertical hypercardioid output acoustical lobe formation for the speakers of the present disclosure at frequencies 25, 31.5, 40, and 50 Hz;

FIG. 43C depicts the vertical cardioid output acoustical lobe formation for the speakers of the present disclosure at frequencies 25, 31.5, 40, and 50 Hz;

FIG. 43D depicts the vertical omnidirectional output acoustical lobe formation for the speakers of the present disclosure at frequencies 63, 80, 100, and 125 Hz;

FIG. 43E depicts the vertical hypercardioid output acoustical lobe formation for the speakers of the present disclosure at frequencies 63, 80, 100, and 125 Hz;

FIG. 43F depicts the vertical cardioid output acoustical lobe formation in the rearward direction at frequencies 63, 80, 100, and 125 Hz;

FIG. 44 is a flow diagram of the installation and operation of the ULF speaker of FIGS. 33 and 34.

DETAILED DESCRIPTION

The attachments to this application, as well as the detailed description set forth below in connection with the appended drawings, where like numerals reference like elements, are intended as a description of various embodiments of the disclosed subject matter and are not intended to represent the only embodiments. Each embodiment described in this disclosure is provided merely as an example or illustration and should not be construed as preferred or advantageous over other embodiments. The illustrative examples provided herein are not intended to be exhaustive or to limit the disclosure to the precise forms disclosed. Similarly, any steps described herein may be interchangeable with other steps, or combinations of steps, in order to achieve the same or substantially similar result.

In the following description, numerous specific details are set forth in order to provide a thorough understanding of exemplary embodiments of the present disclosure. It will be apparent to one skilled in the art, however, that many embodiments of the present disclosure may be practiced without some or all of the specific details. In some instances, well-known process steps have not been described in detail in order not to unnecessarily obscure various aspects of the present disclosure. Further, it will be appreciated that embodiments of the present disclosure may employ any combination of features described herein.

The present application may include references to directions, such as "forward," "rearward," "front," "back," "upward," "downward," "vertical," "horizontal," "upright," "right-hand," "left-hand," "in," "out," "extended," "advanced," and "retracted." These references and other similar references in the present application are only to assist in helping describe and understand the present disclosure and invention and are not necessarily intended to limit the present disclosure or invention to these directions.

In the following description, various embodiments of the present disclosure are described. In the following description and in the accompanying drawings, the corresponding systems assemblies, apparatus and units may be identified by the same part number, but with an alpha or other suffix. The descriptions of the parts/components of such systems assemblies, apparatus and units are the same or similar, and therefore are not repeated so as to avoid redundancy in the present application.

Figure 1:
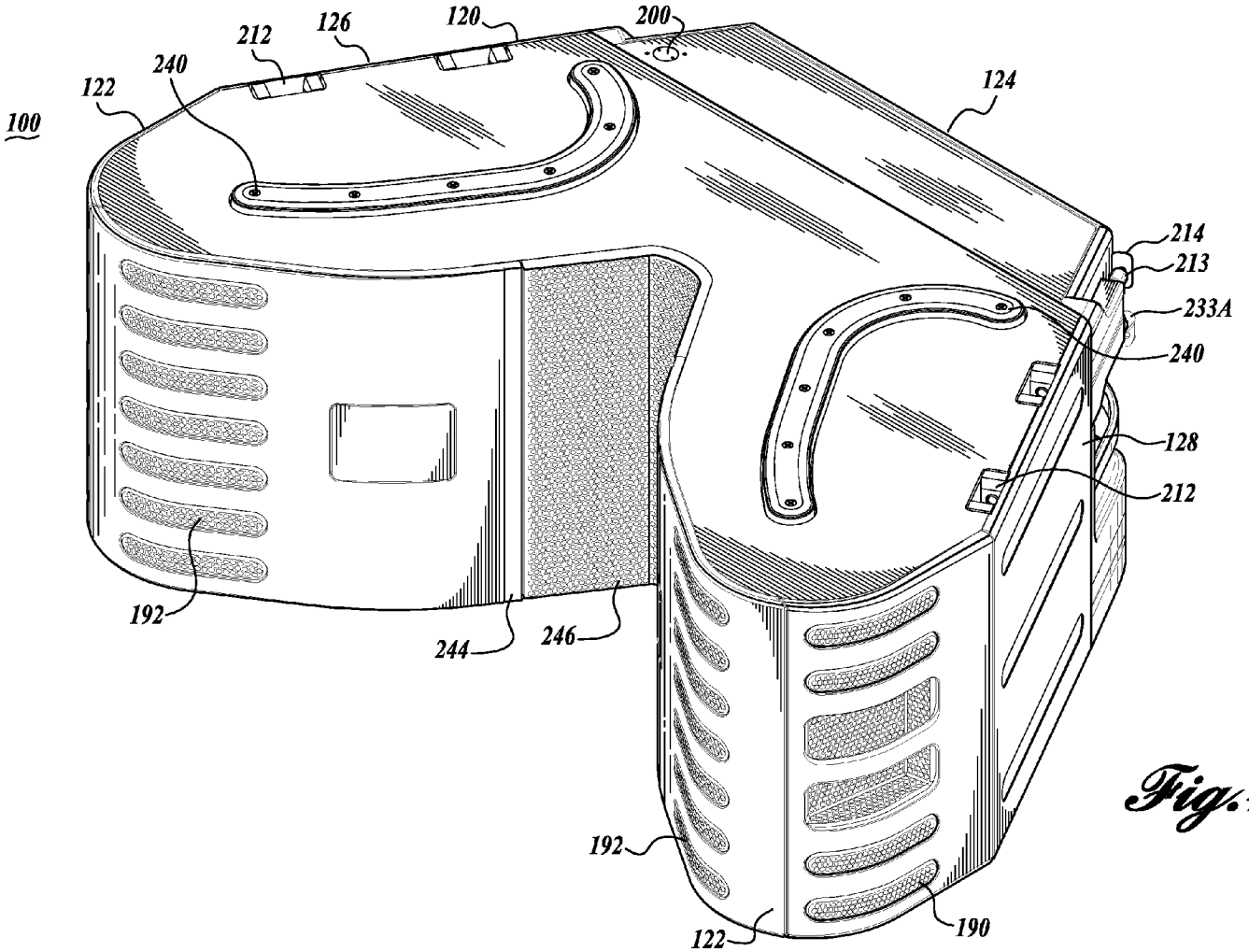
FIGS. 1-31 illustrate loudspeakers of the present disclosure to generate sound in the high, mid, and low frequency ranges. In this regard.
Figure 2:
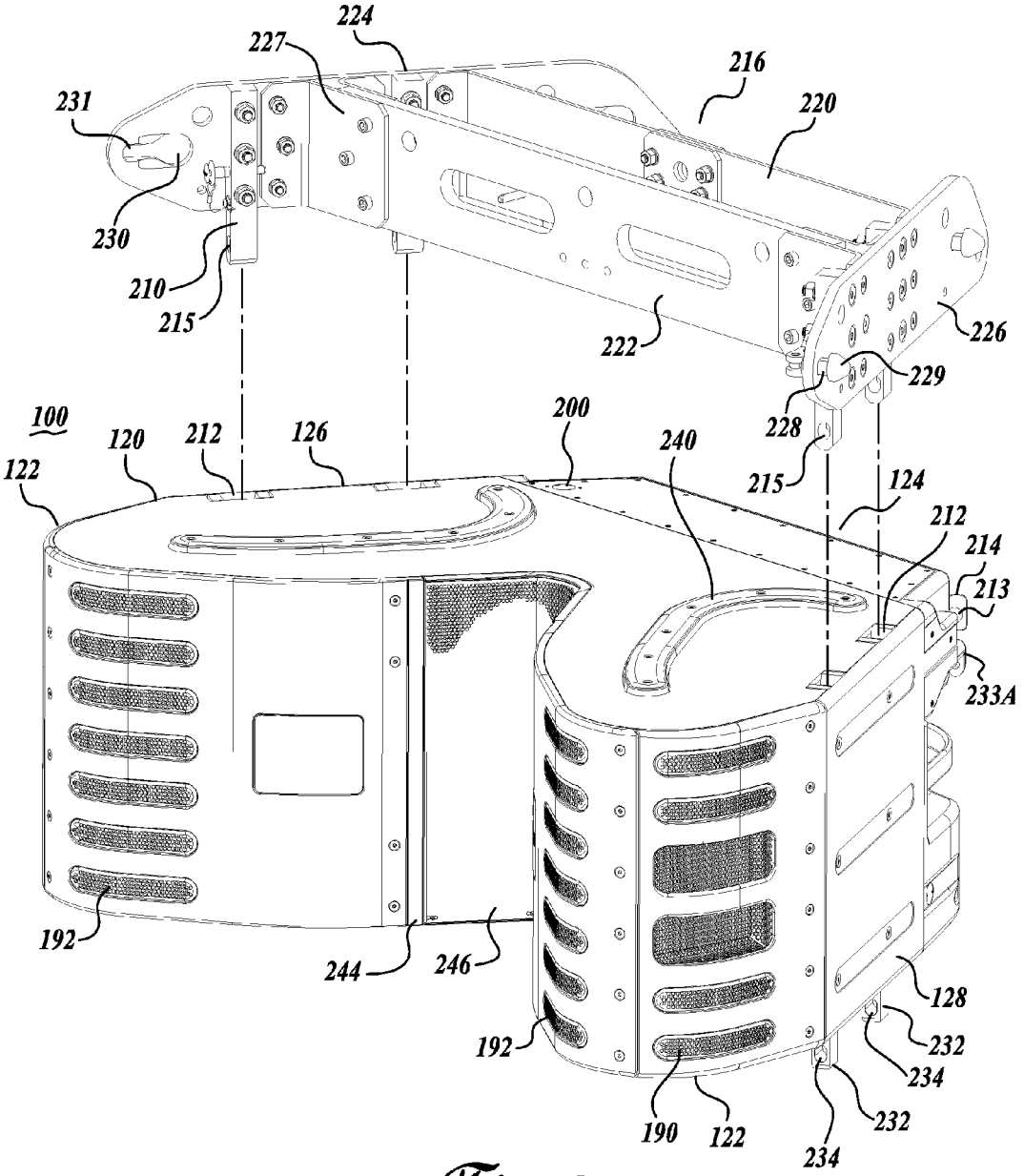
Figure 3:
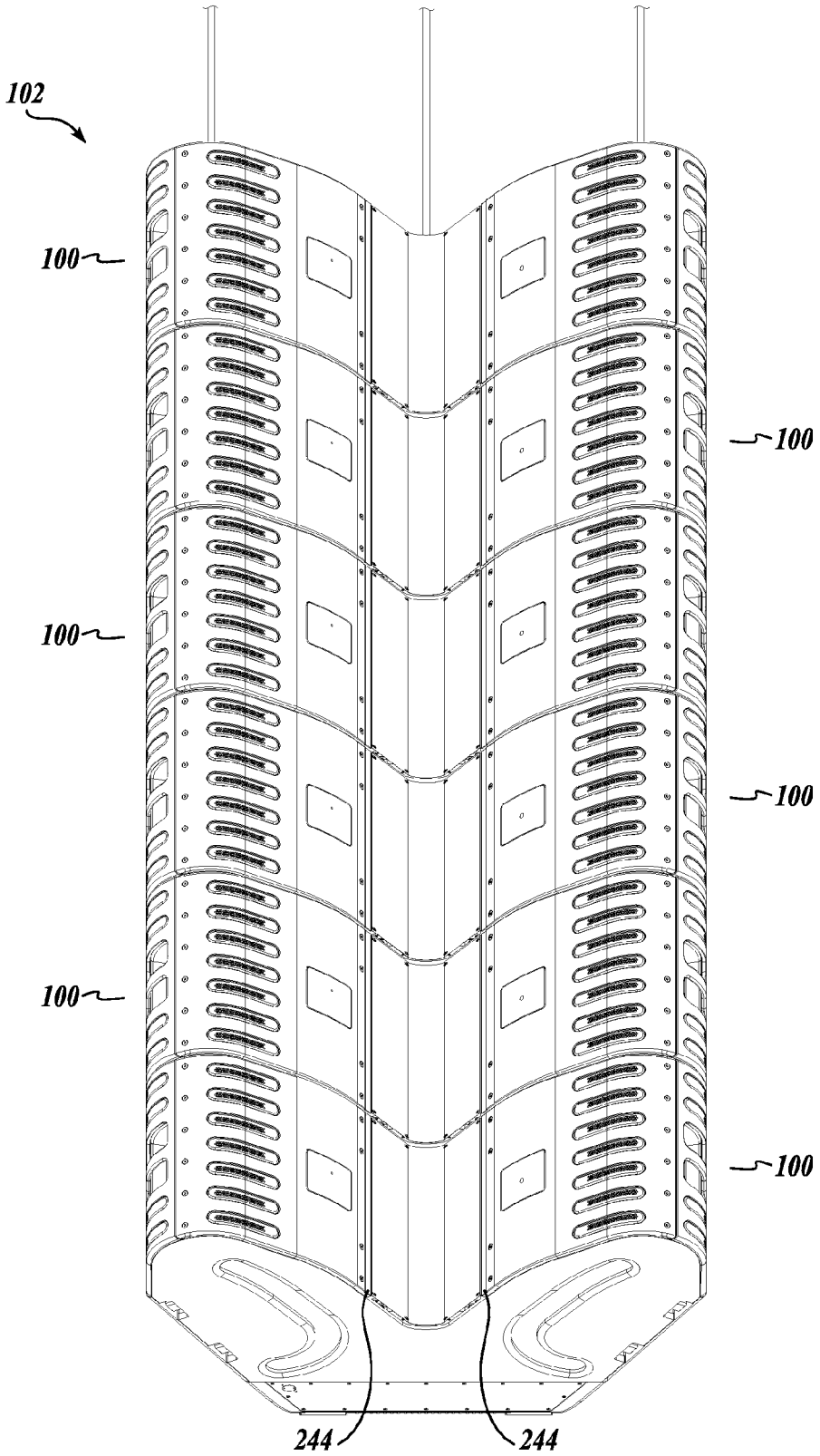
Figure 4:
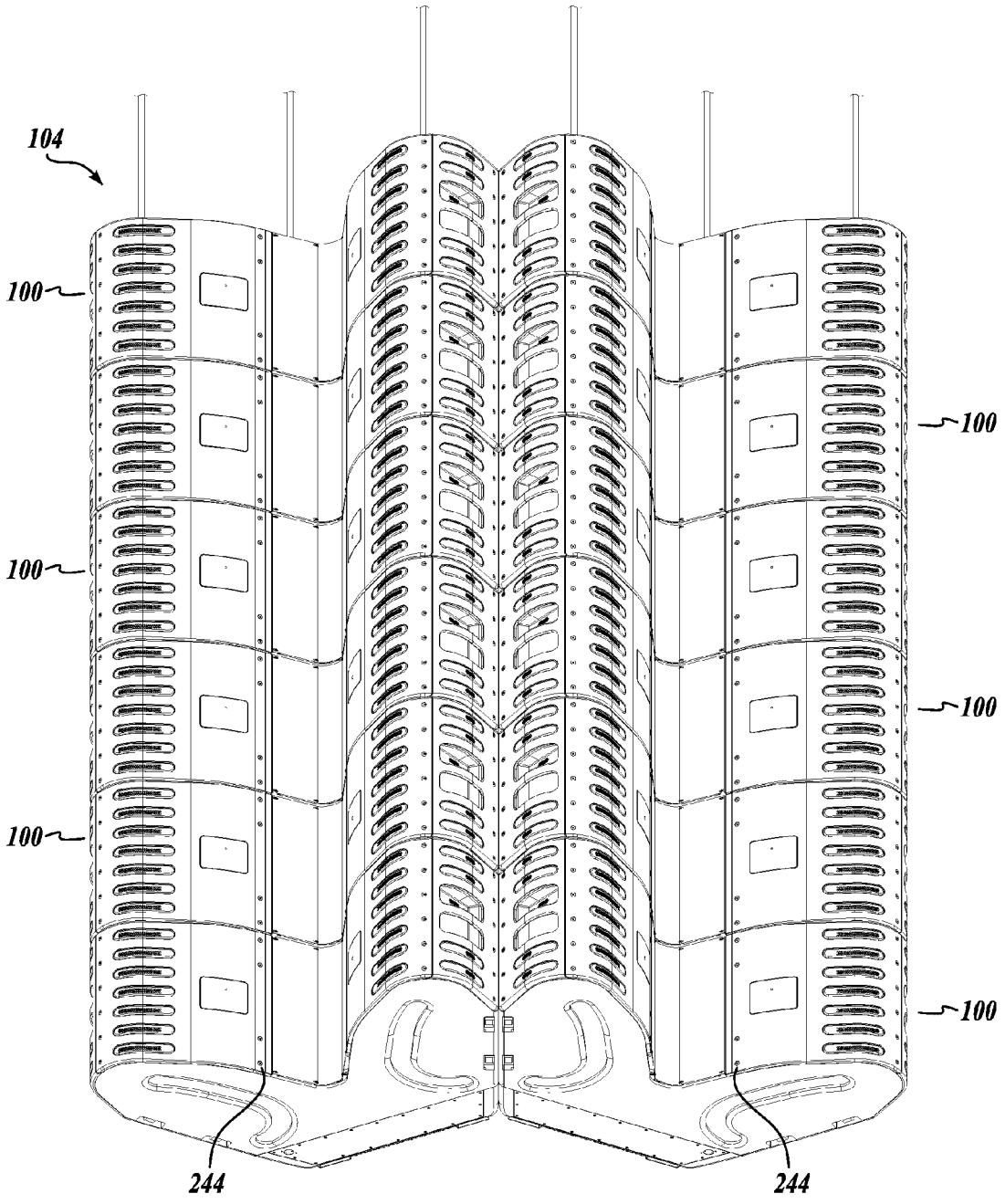
Figure 13:
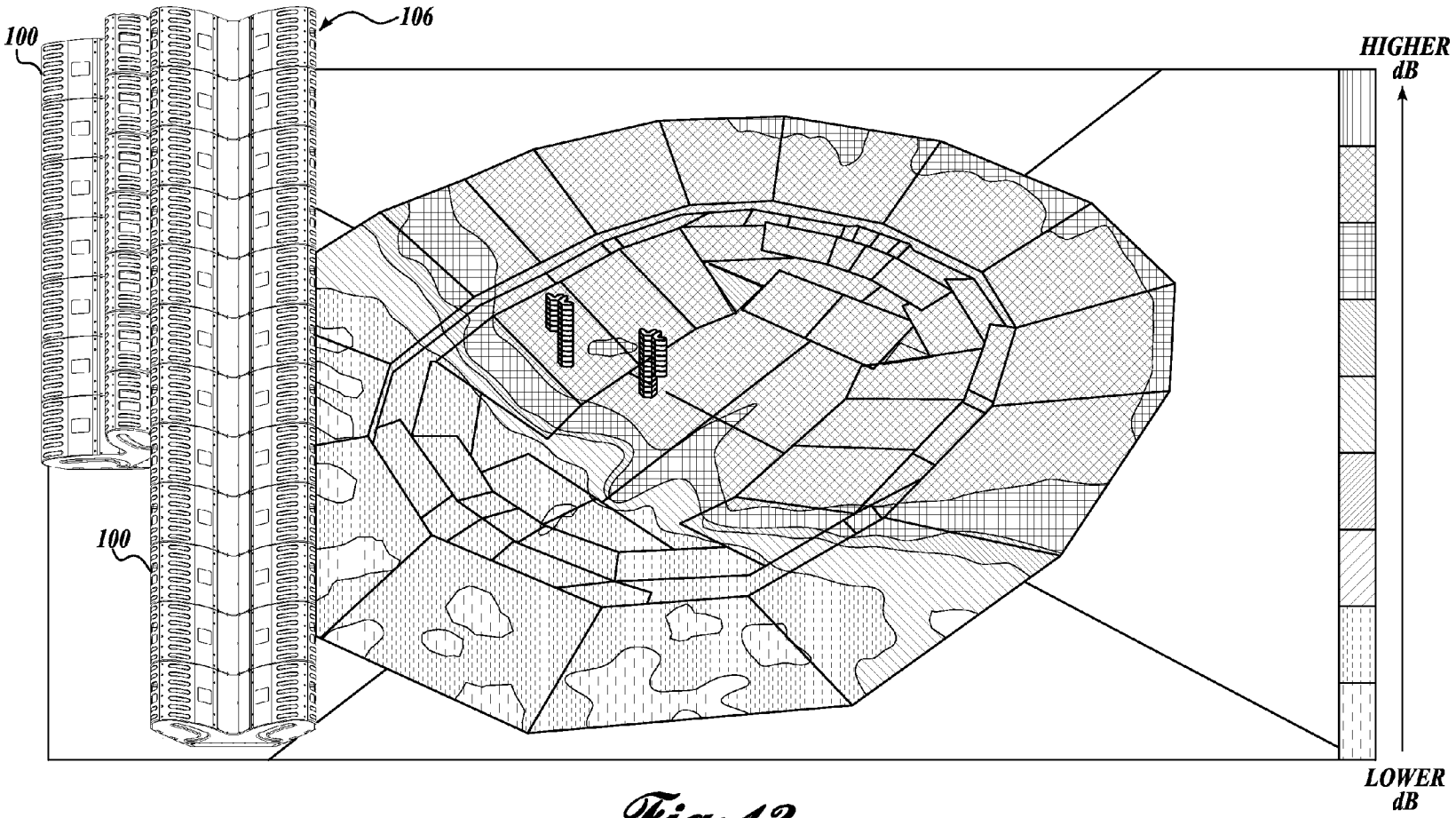
Figure 14:
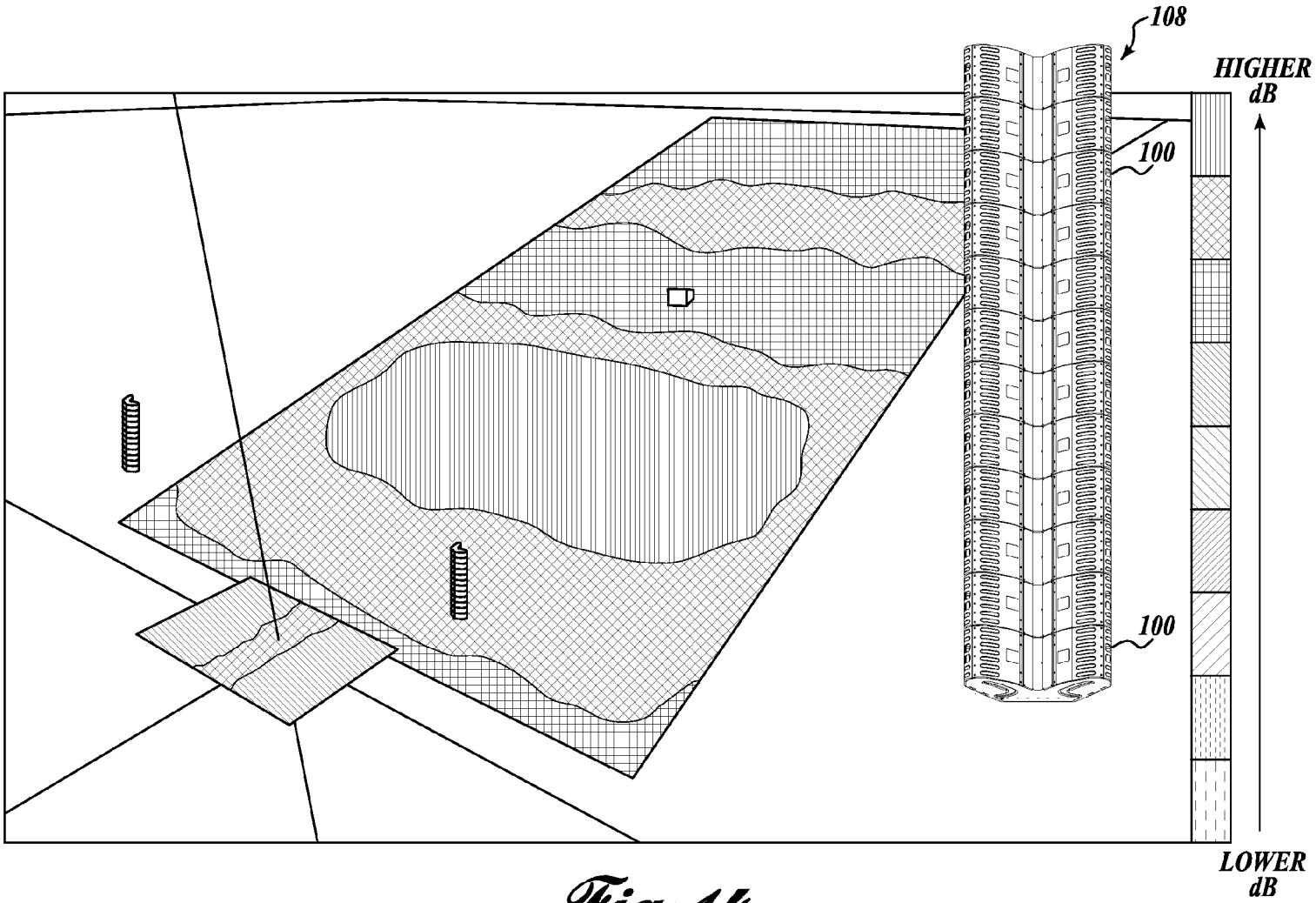
Figure 15:
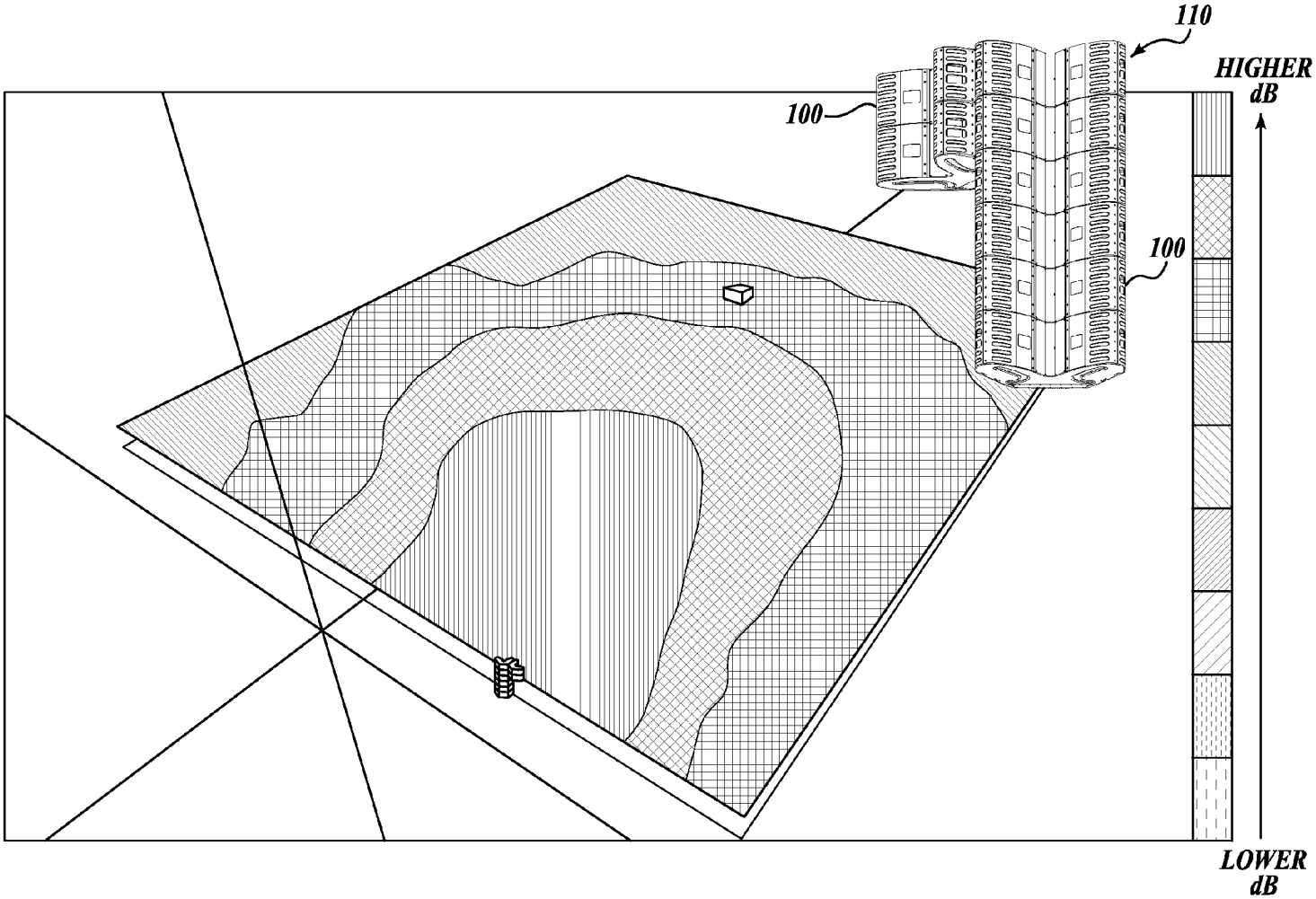
Figure 16:
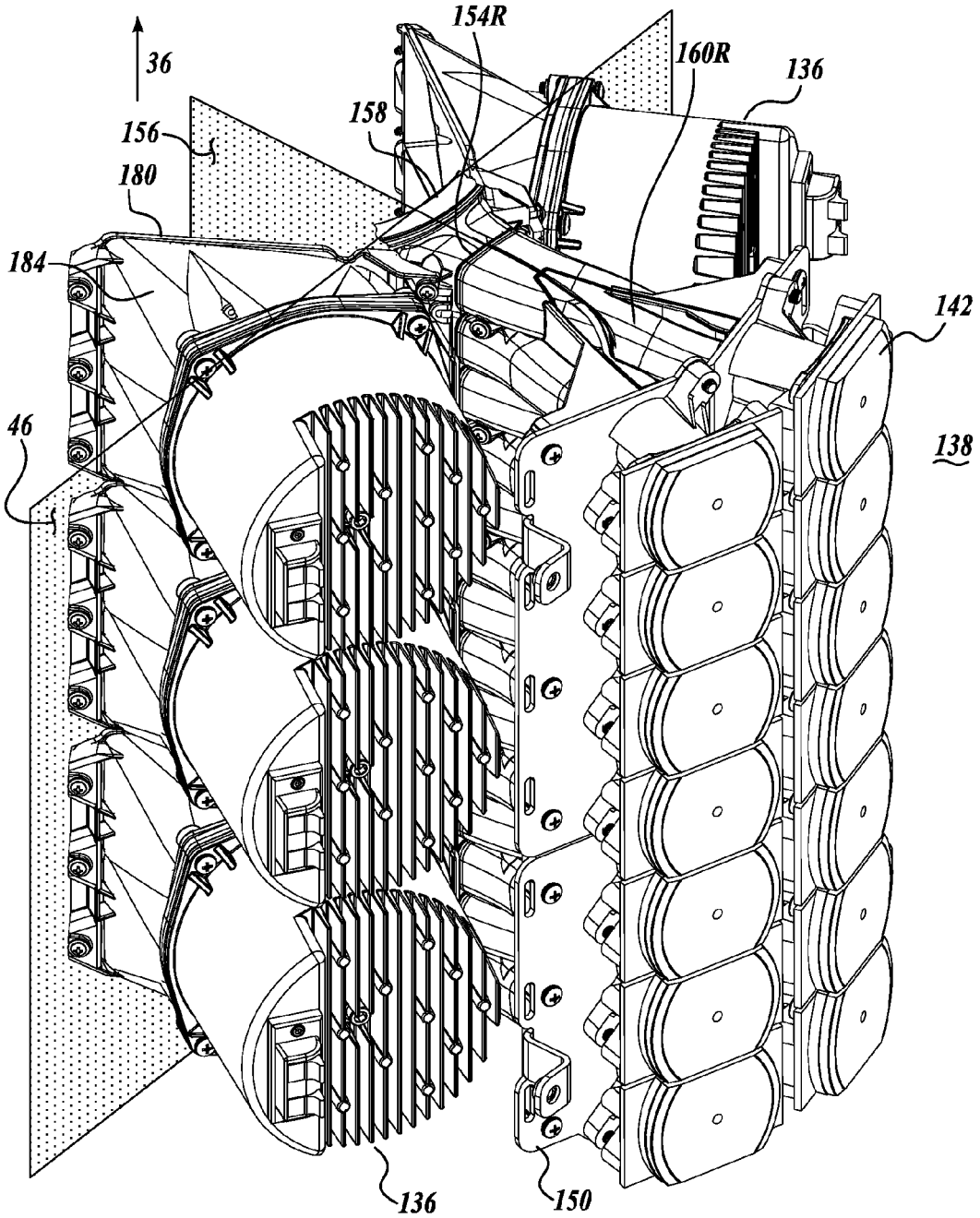
Figure 17:
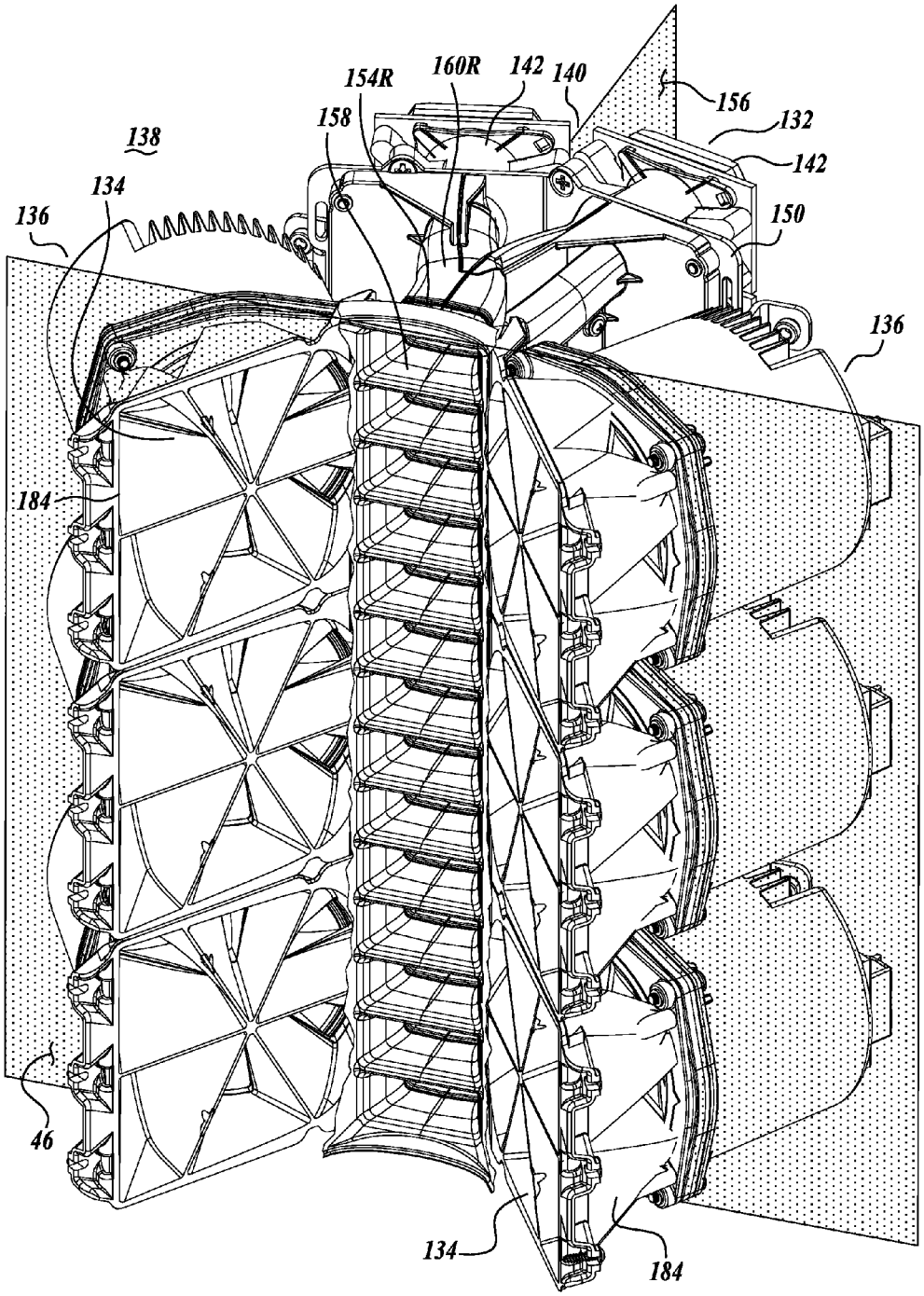
Figure 18:
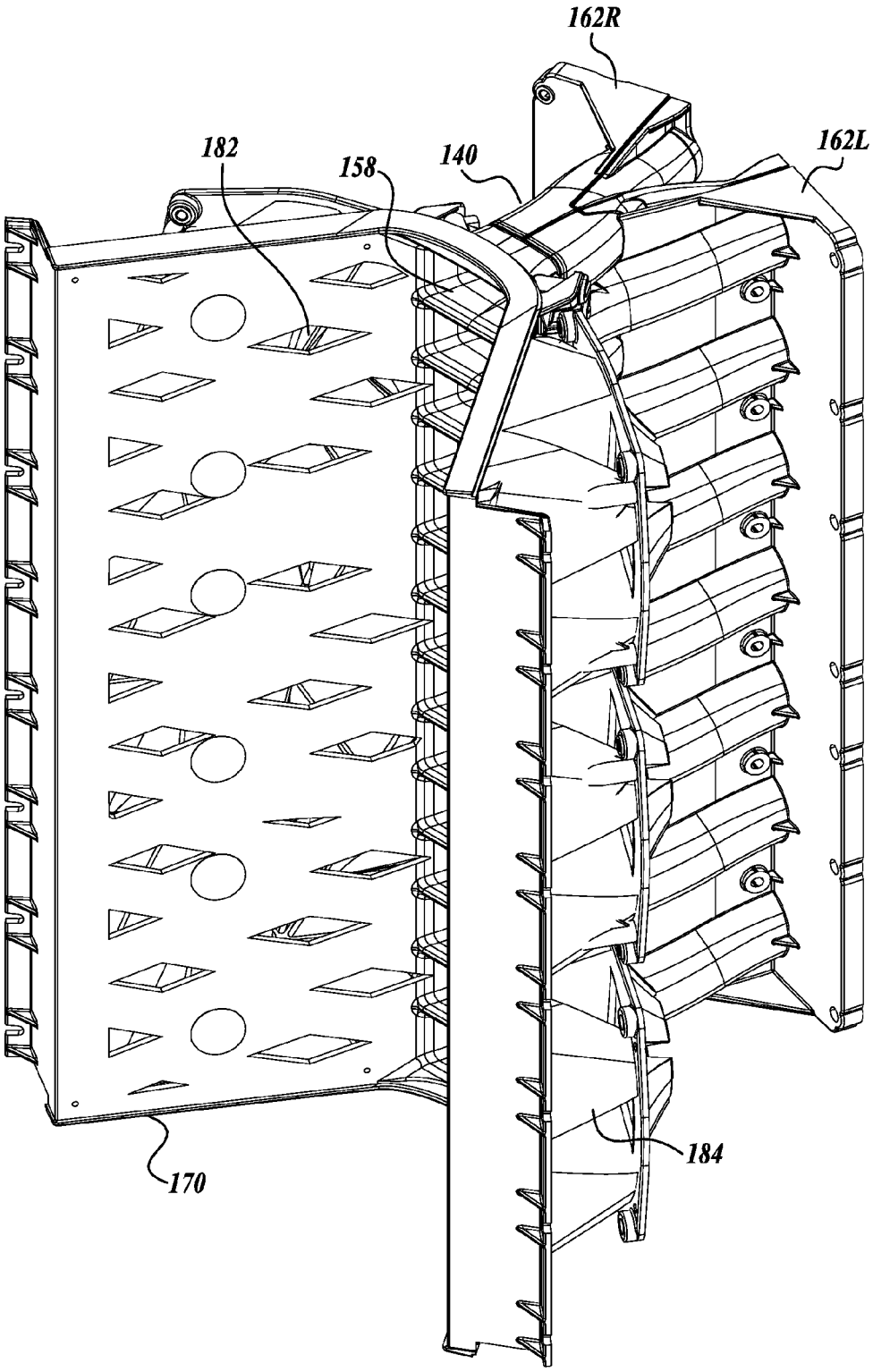
Figure 19:
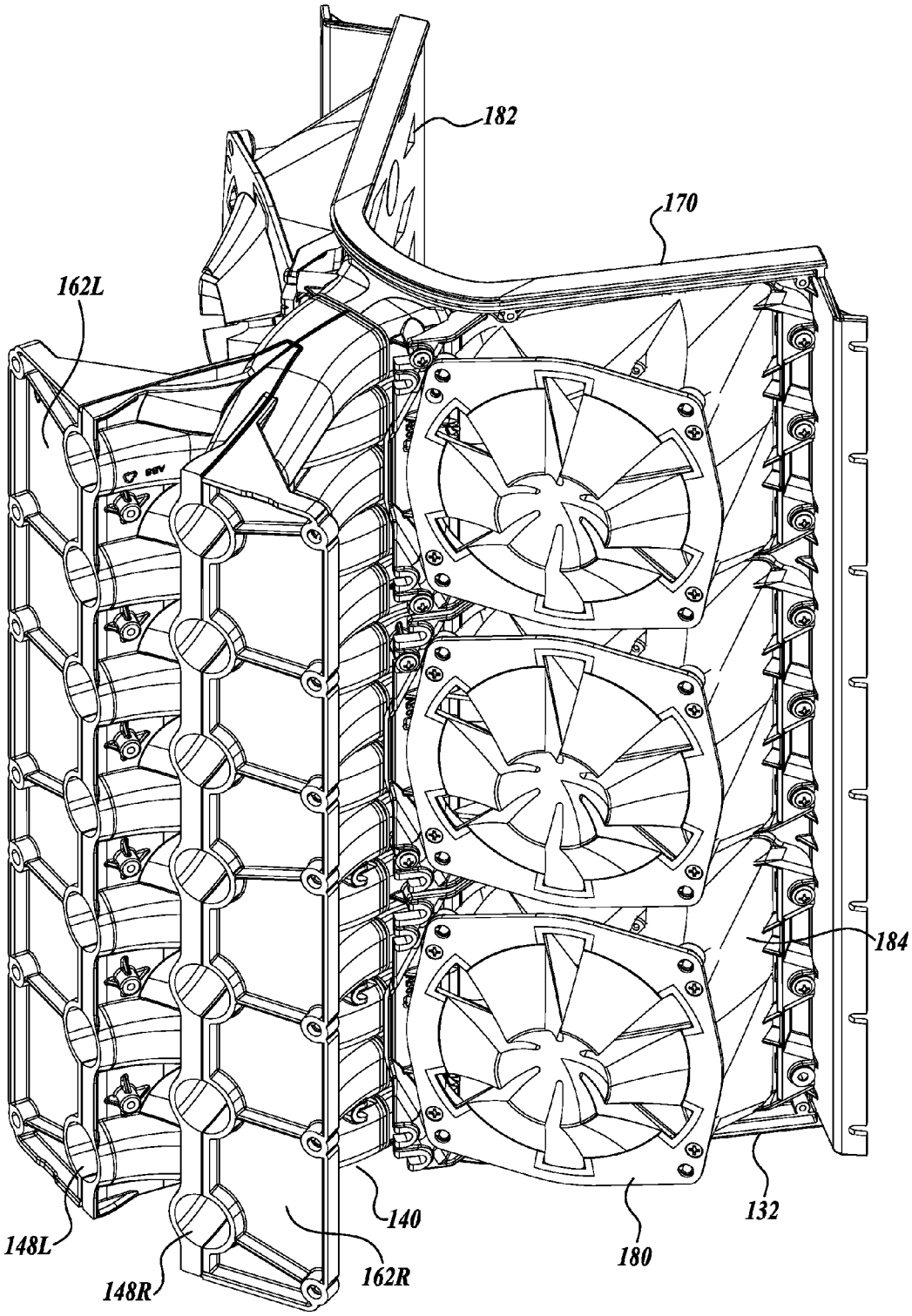
Figure 20:
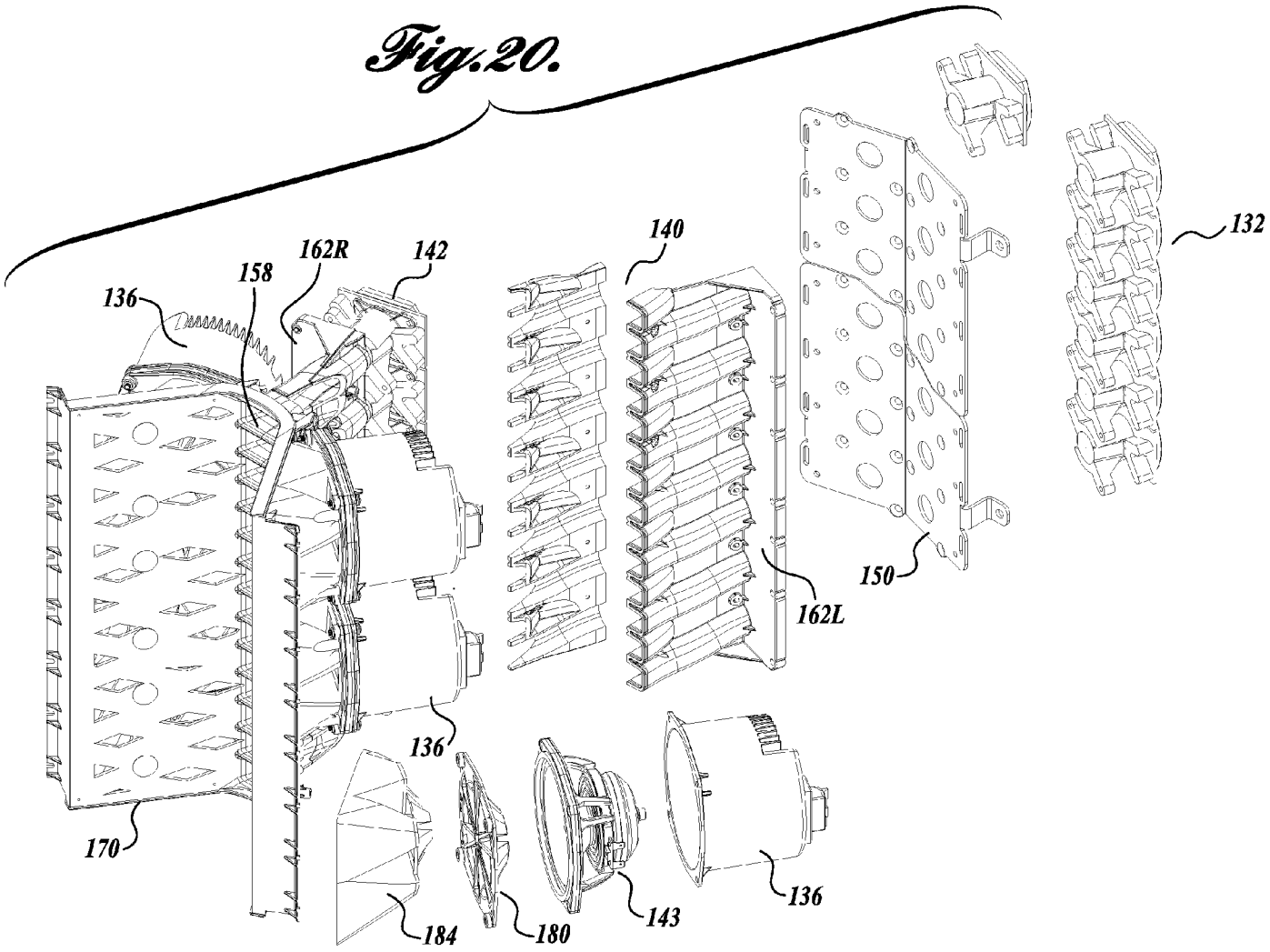
Figure 21:
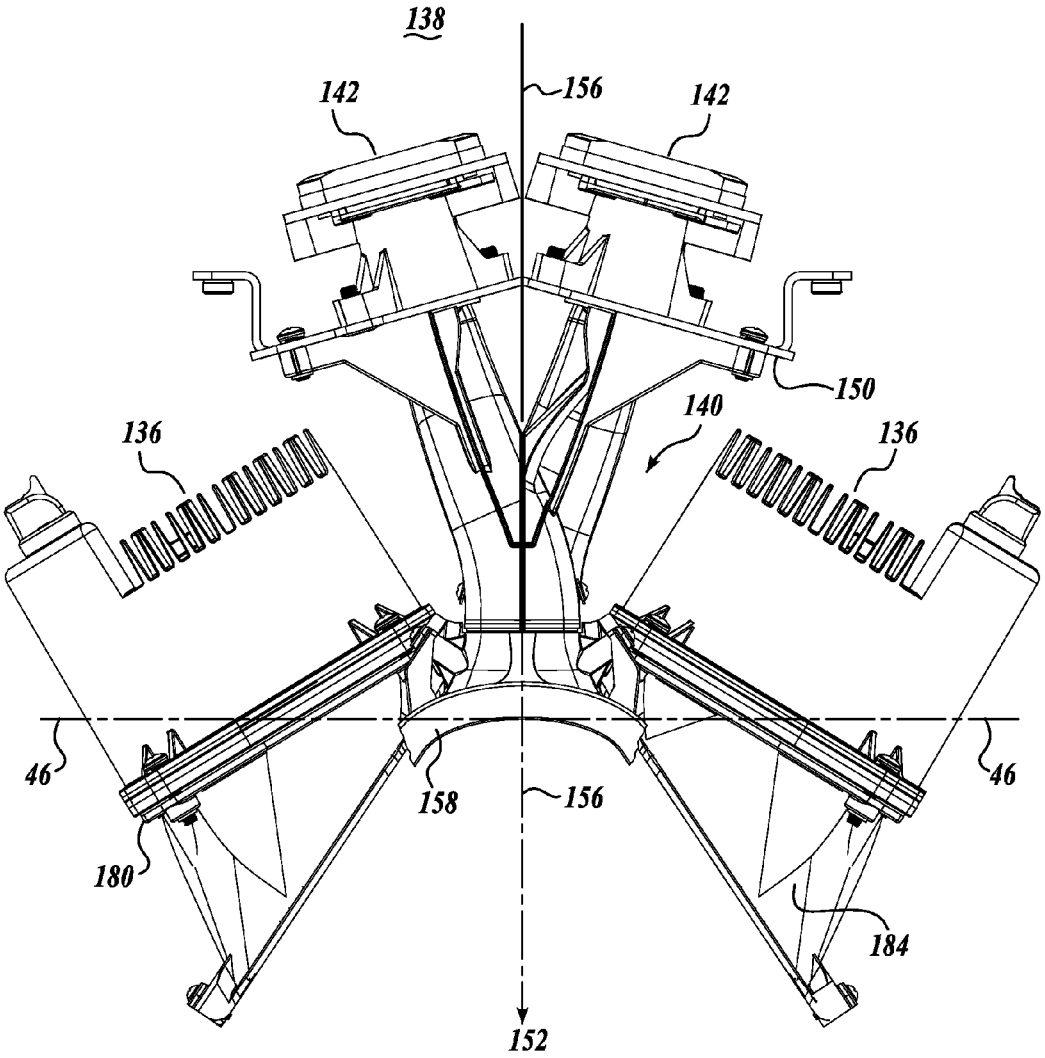
Figure 22:
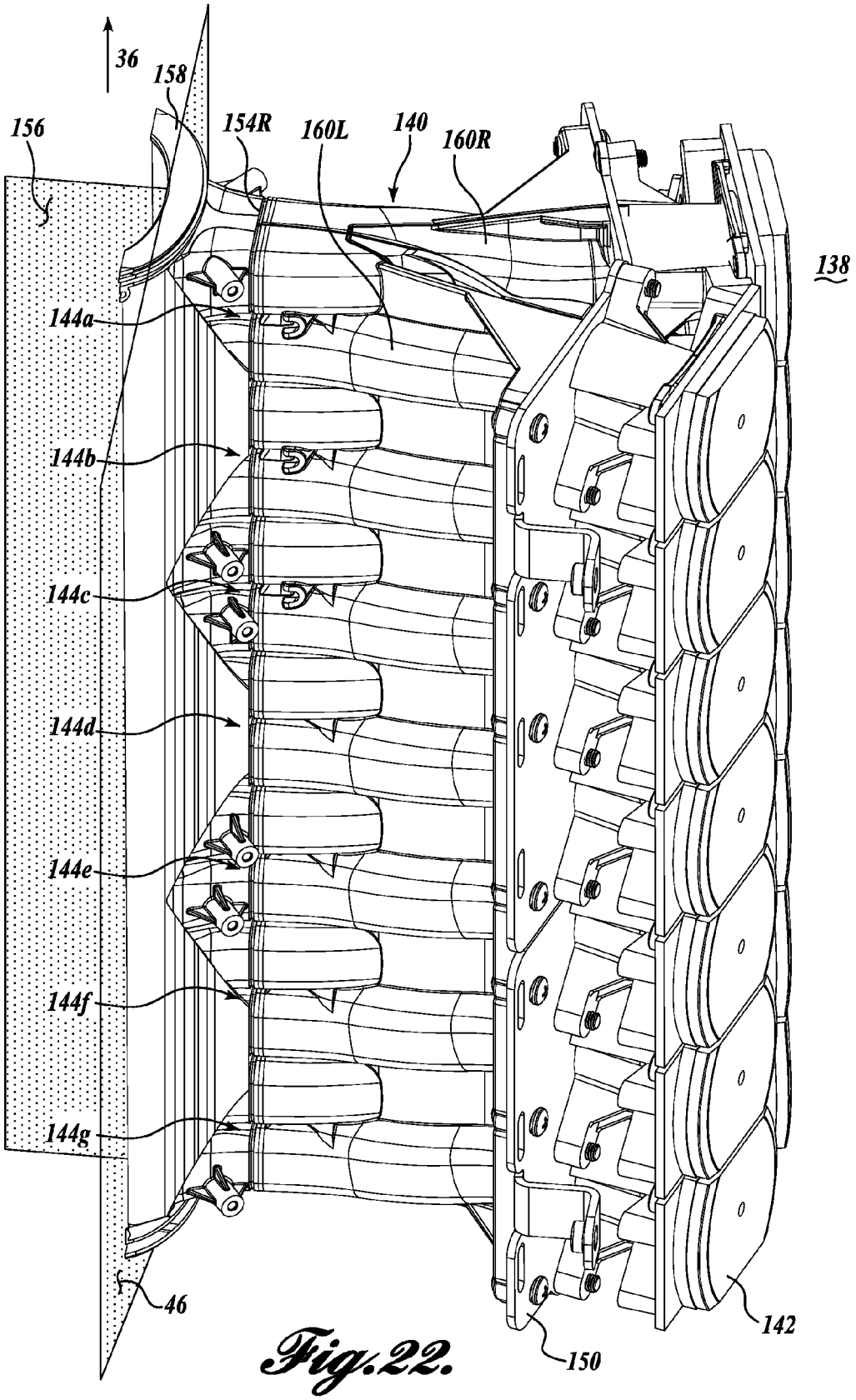
Figure 23:
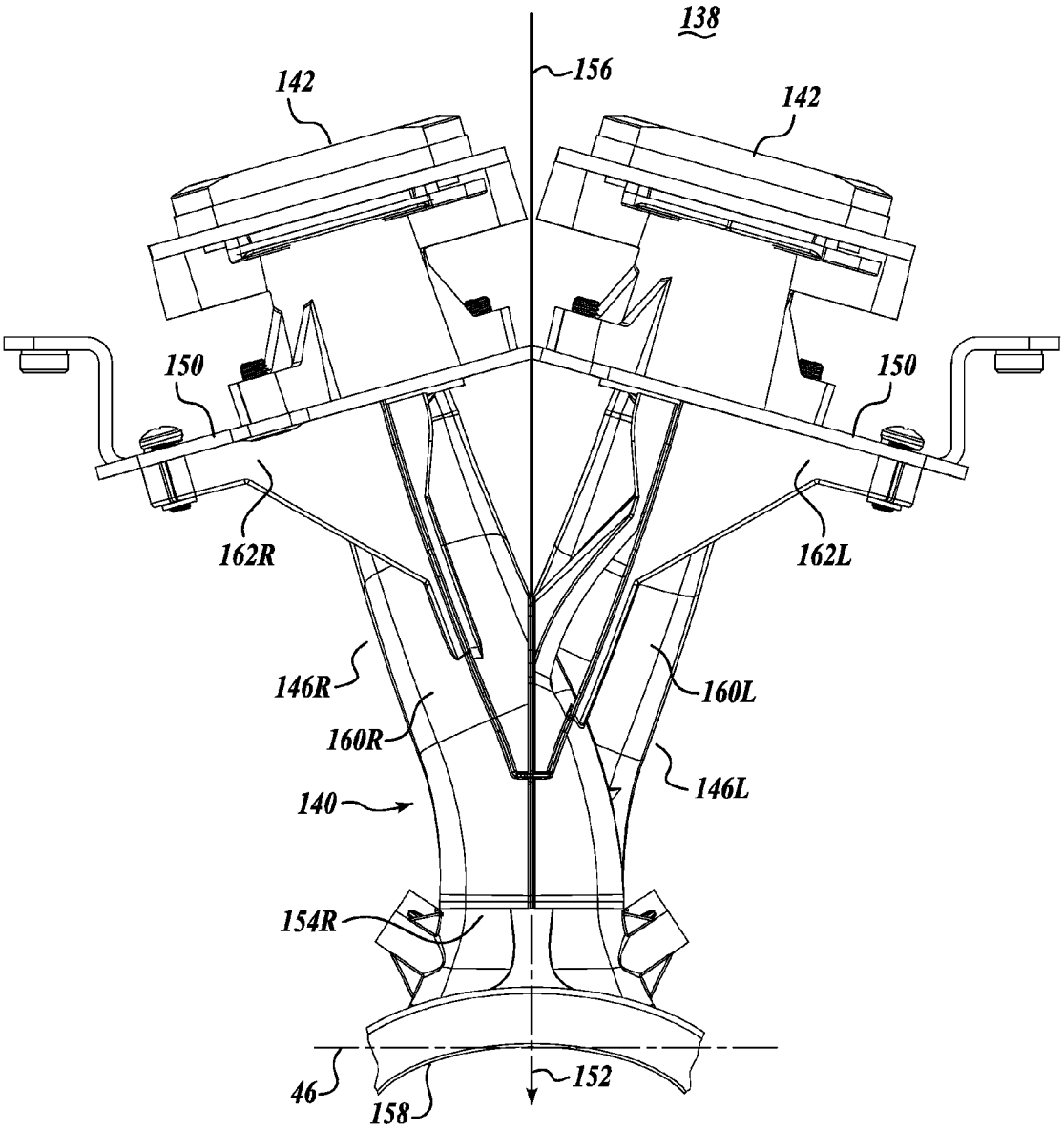

An audio loudspeaker 100 (also "speaker") of the present disclosure is shown in FIGS. 1 and 2 as a singular unit and is shown in FIG. 3 as arranged in a vertical array 102 composed of six speakers 100 stacked on top of each other in vertical fashion. Other speaker arrays can also be composed of speakers 100 including as shown in FIG. 4, a speaker array 104 having two speaker stacks each composed of six speakers, with the two stacks positioned side-by-side to each other. FIG. 13 illustrates a speaker array 106 composed of two side-by-side stacks configured for use in a large indoor arena having a stage. One stack consists of 12 speakers 100, and the second stack consists of six speakers 100, with the top of the stacks level with each other. The two stacks cover 120 degrees horizontally, but vary in their vertical directivity. FIG. 14 illustrates speaker arrays 108 utilized in a large outdoor amphitheater. The arrays 108 are located spaced apart from each other at one end of the amphitheater. Further, FIG. 15 illustrates a speaker array 110 configured for a concert within a very large tent. The arrays 110 are in two side-by-side stacks, a first stack consisting of six speakers 100 and the second side-by-side stack composed of two speakers 100. The six-module column covers most of the audience area, and a two-module outer column fills the intermediate near field as well as the side of the venue on which the short stack is positioned.

Figure 5:
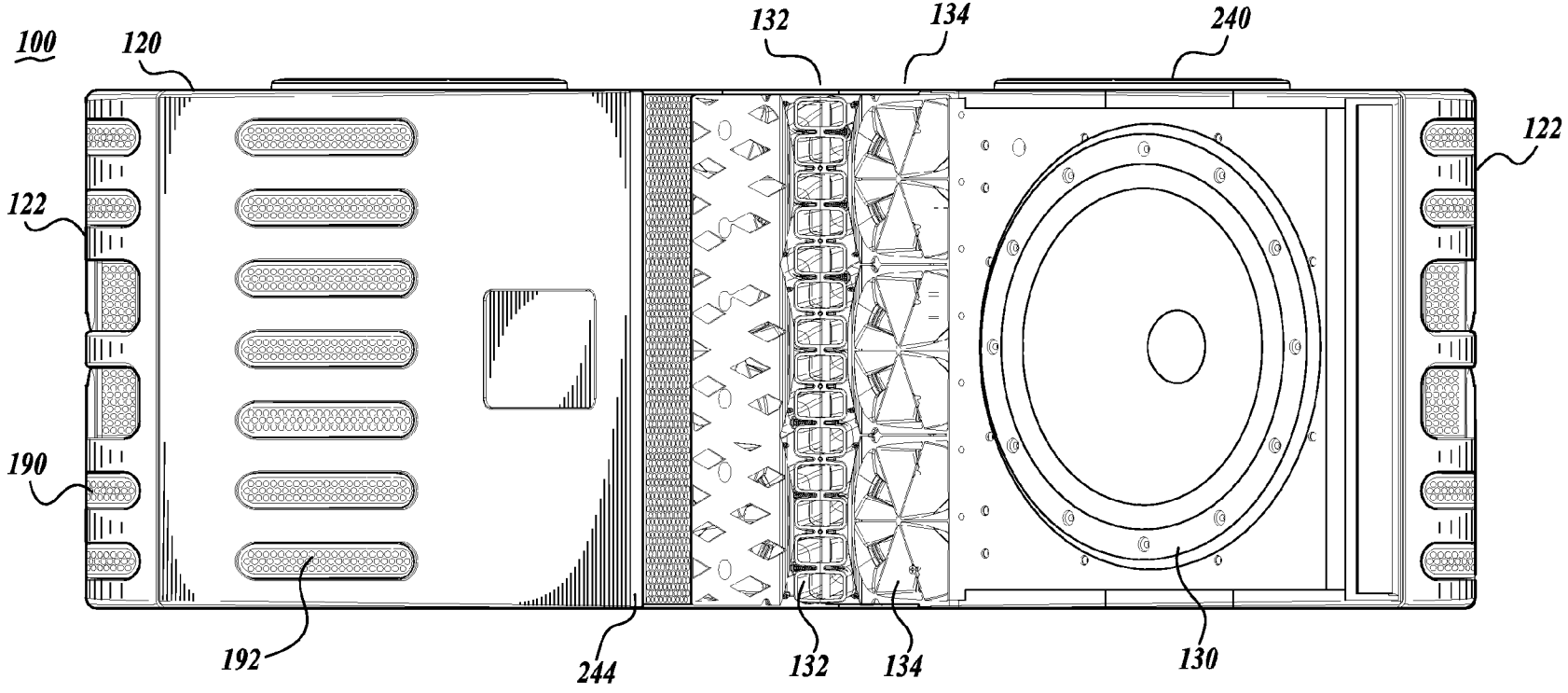
Figure 6:
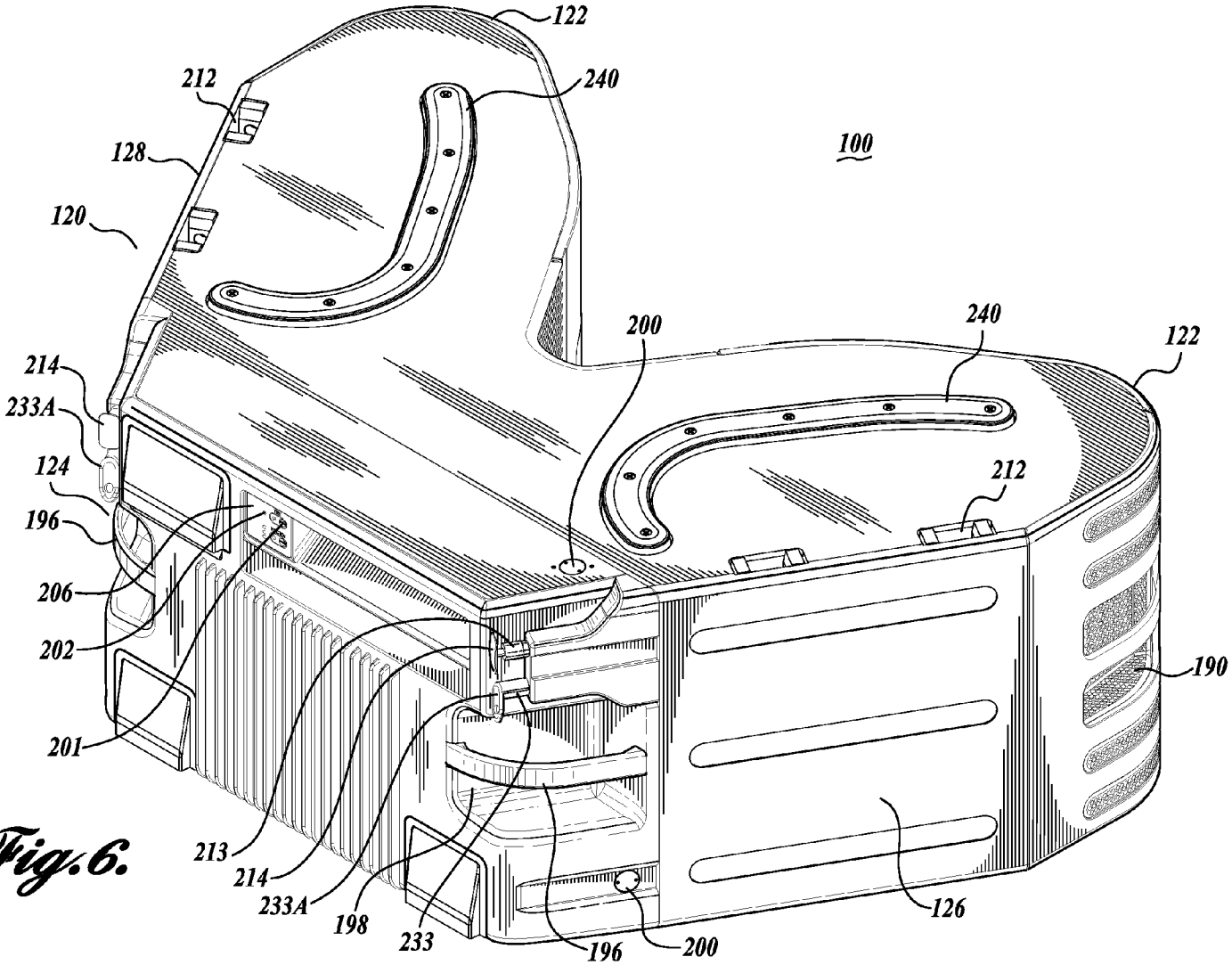
Figure 7:
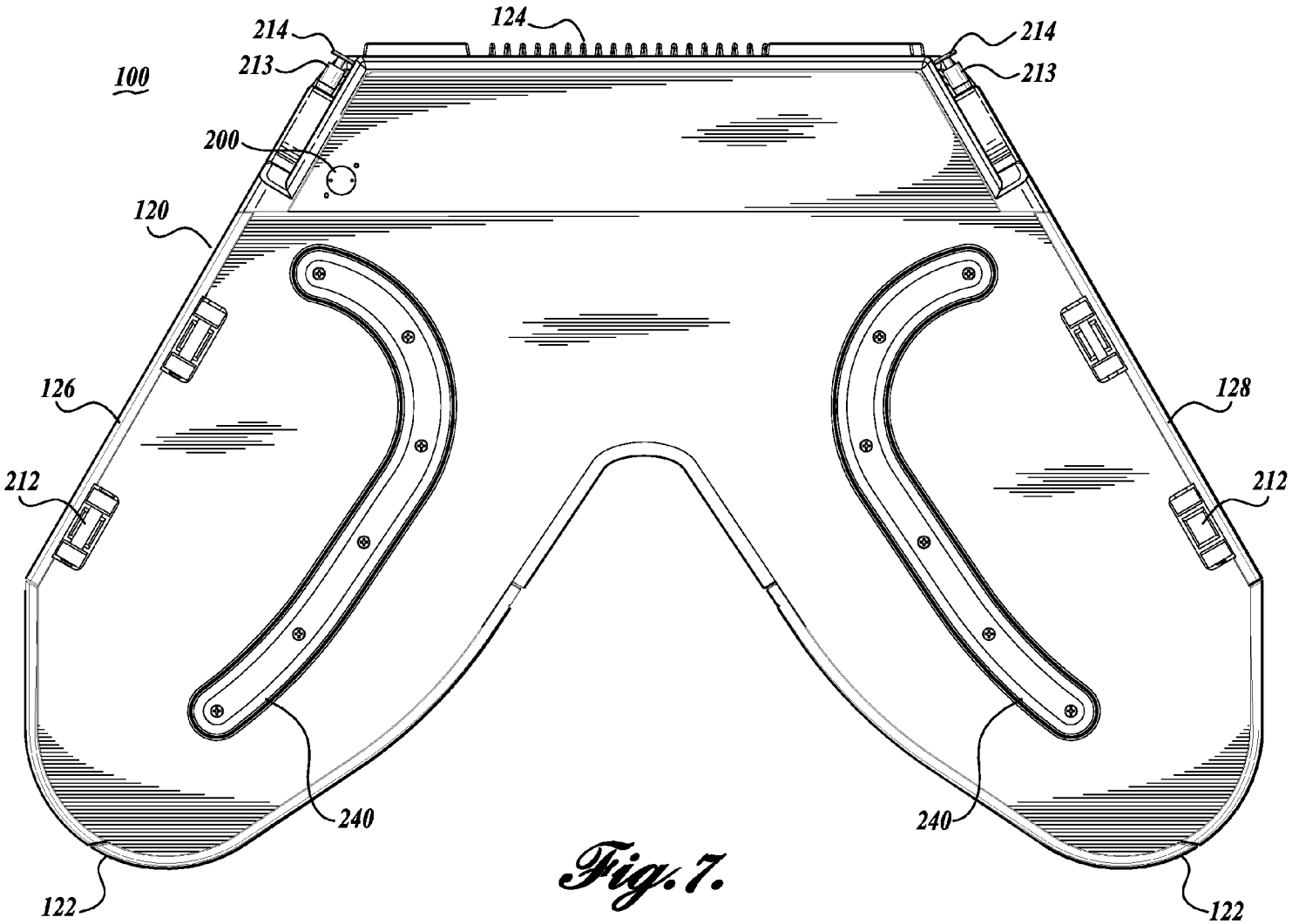
Figure 8:
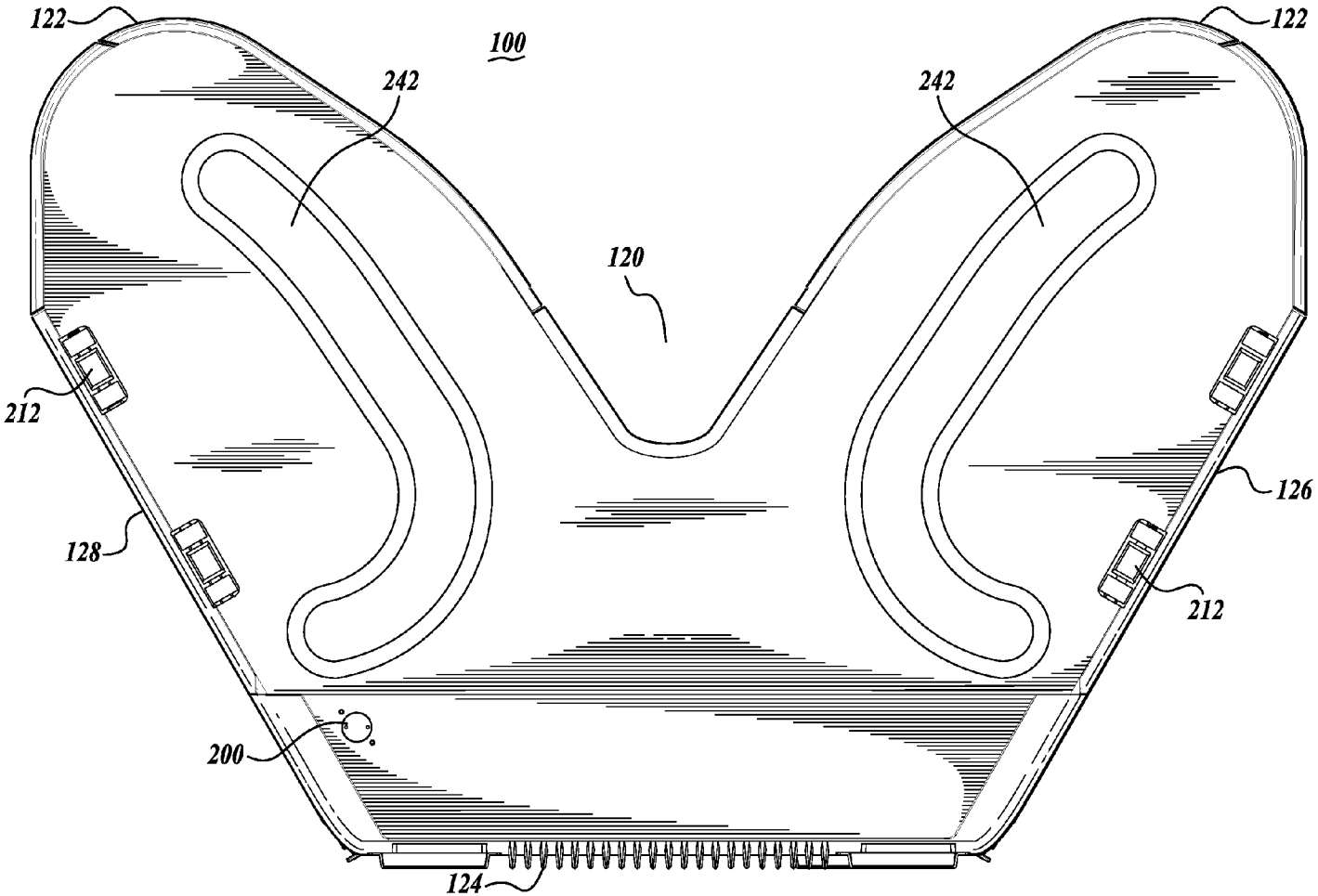

Next, describing the individual speakers 100, reference initially will be made primarily to FIGS. 1, 2, and 5-12. These speakers contain low, mid, and high frequency transducers covering the range of approximately 30 Hz to 20 kHz. As shown in these figures, the speaker 100 includes a generally trapezoidal-shaped housing 120 composed of two lobe sections 122 that project forwardly and outwardly from the transverse rear section 124. The housing 120 includes side portions 126 and 128 extending rearwardly and diagonally inwardly from the front lobe sections to intersect the transverse rear section 124. Referring specifically to FIG. 5, a pair of low-frequency cone transducers 130, operating in the range of about 30 Hz to 300 Hz, are housed in the lobe portions 122 of housing 120. The low-frequency transducers 130 occupy substantially the entire height and width of the lobe portions to face forwardly and inwardly toward each other. A vertically arranged set 138 of high-frequency compression drivers 142, operating in the range of about 1500 Hz to 20 kHz, are positioned centrally in the housing between the lobe sections to project in the forward direction, see FIG. 5 as well as FIGS. 16, 17, 20-23. The set 138 also includes three mid-frequency cone transducers 143, operating in the range of about 200 Hz to 2 kHz, that are vertically arranged along each side of the high-frequency drivers 132, see FIG. 5 as well as FIGS. 16, 17, 19, 20 and 21. Although three mid-frequency cone transducers 143 are shown on each side of the high-frequency horn, a greater or lesser number of mid-frequency cone transducers 143 may be utilized.

As described above, the forward portion of housing 120 is occupied by the high, mid-range, and low-frequency compression drivers/transducers 142, 143, and 130. The power components and control components of the speaker 100 are located in the transverse rear section 124 of the speaker.

Describing aspects of the speaker 100 in greater detail, FIGS. 16-29 focus on the high-frequency and mid-frequency drive assembly 138 composed of high-frequency compression drivers 142 and mid-frequency cone transducers 143. These aspects of the speaker 100 are illustrated and described in U.S. patent application Ser. No. 13/832,817, incorporated herein by reference. The high-frequency compression drivers 142 include a horn structure 140 powered by high-frequency drivers 142. The horn structure 140, which loads the compression drivers, includes an array of horn pairs 144*a*-144*g*, with the horn pairs stacked in vertical relationship to each other. Each horn pair is composed of a left- and right-hand horn designated as 146L and 146R as shown, for example, in FIG. 22. The high-frequency driver 142 is mounted to the inlets 148L and 148R of horns 146L and 146R, respectively. A formed mounting plate 150 is disposed between inlets 148L and 148R and corresponding drivers 142.

Figure 24:
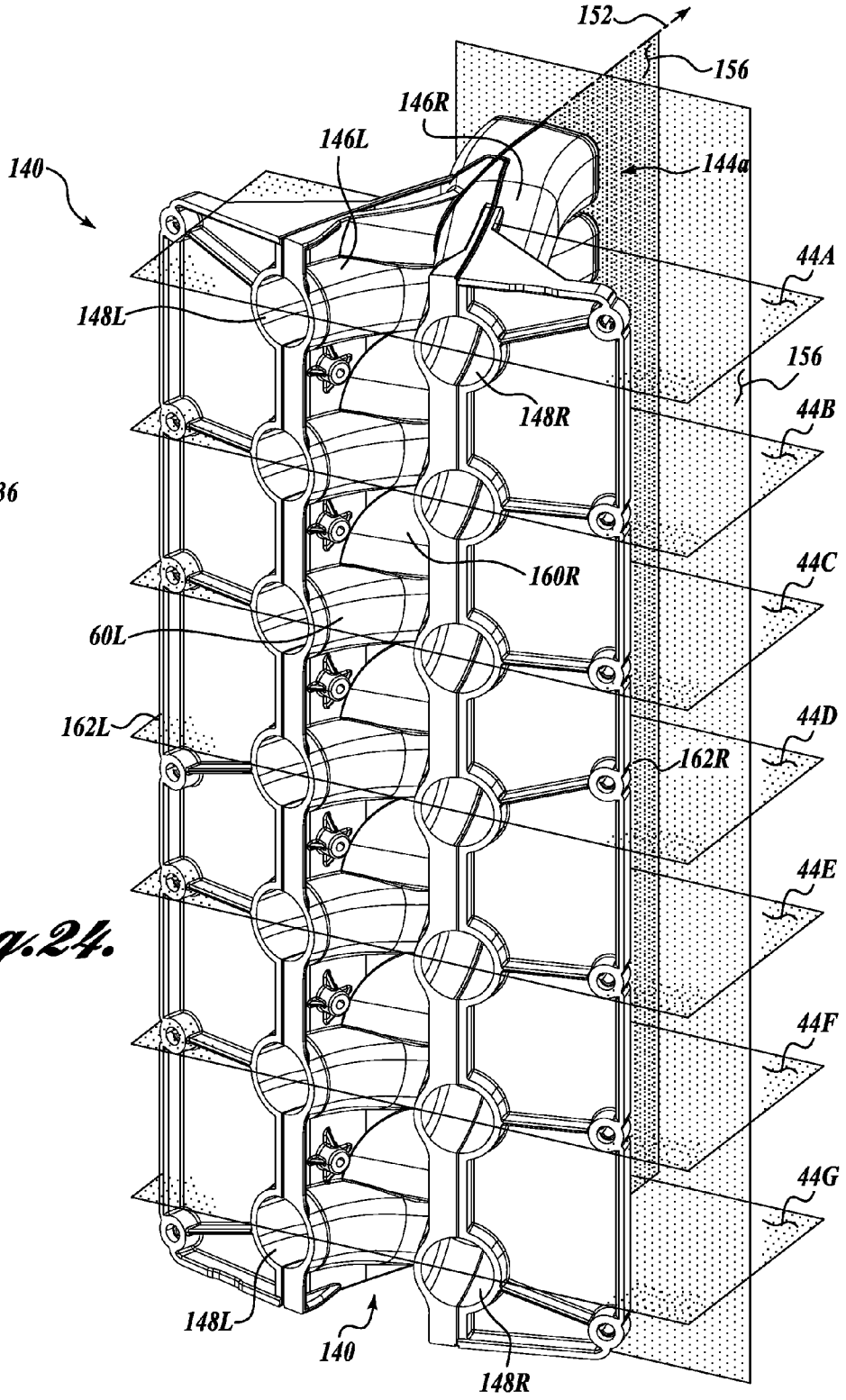
Figure 25:
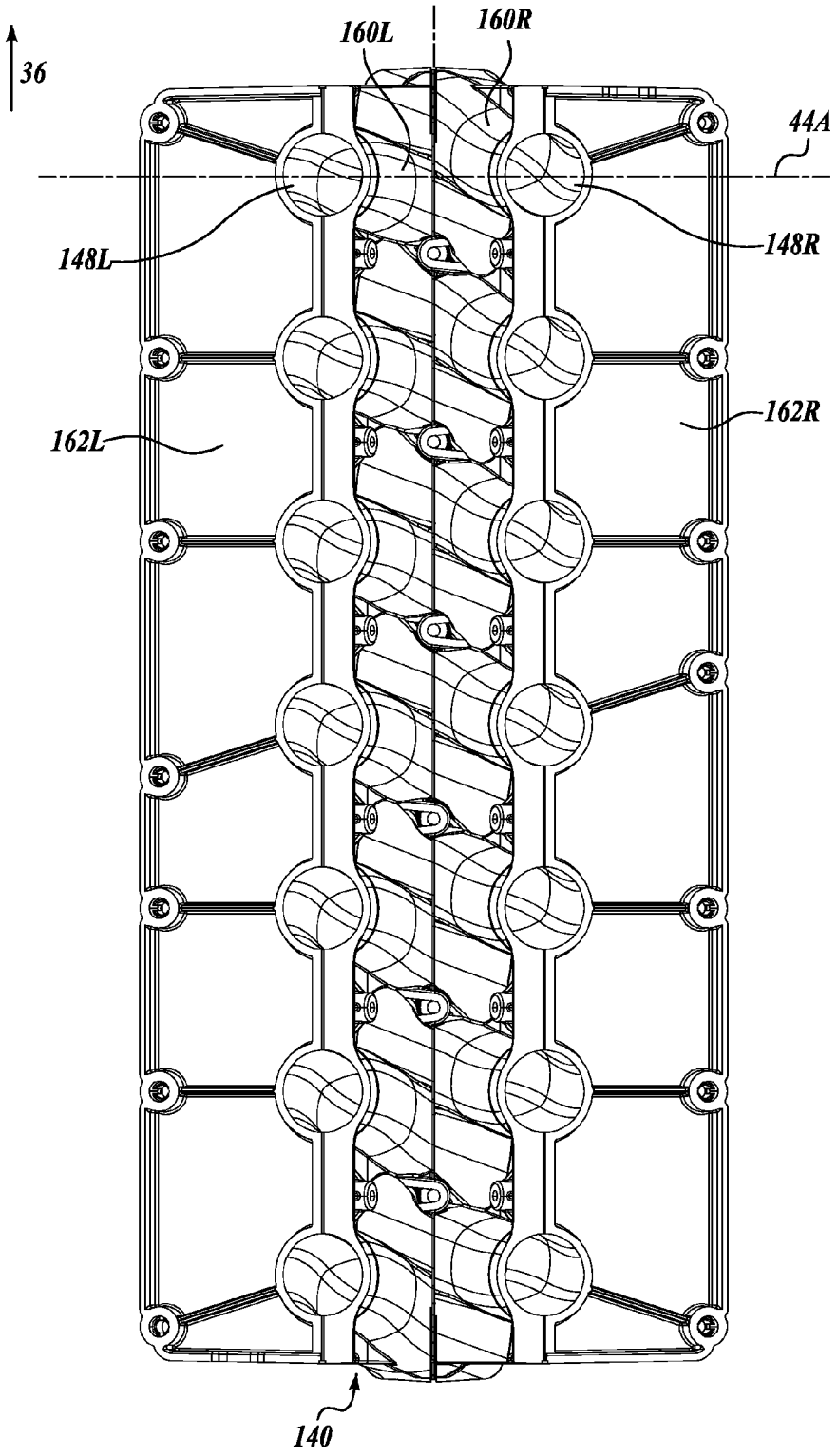
Figure 26:
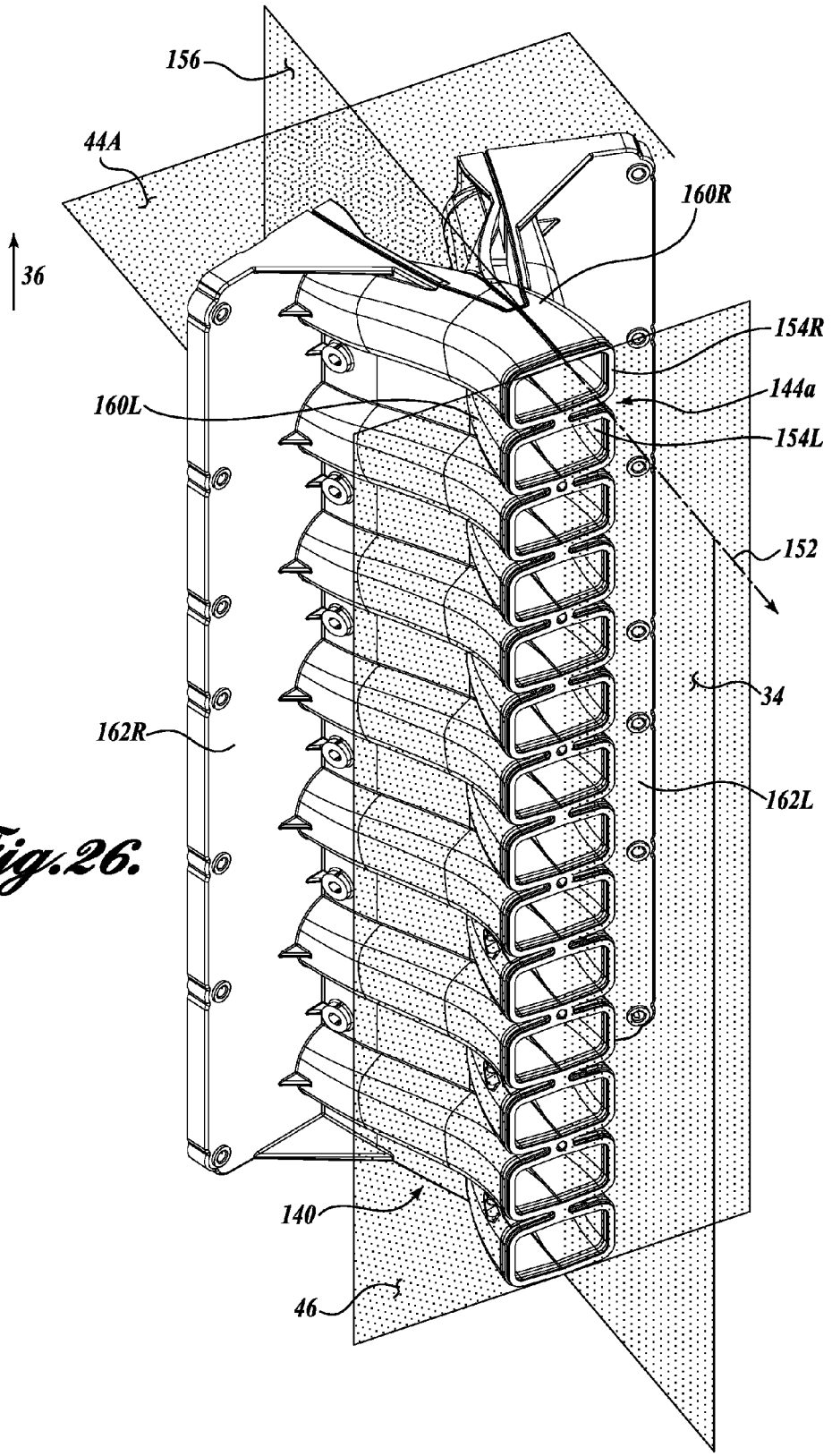
Figure 27:
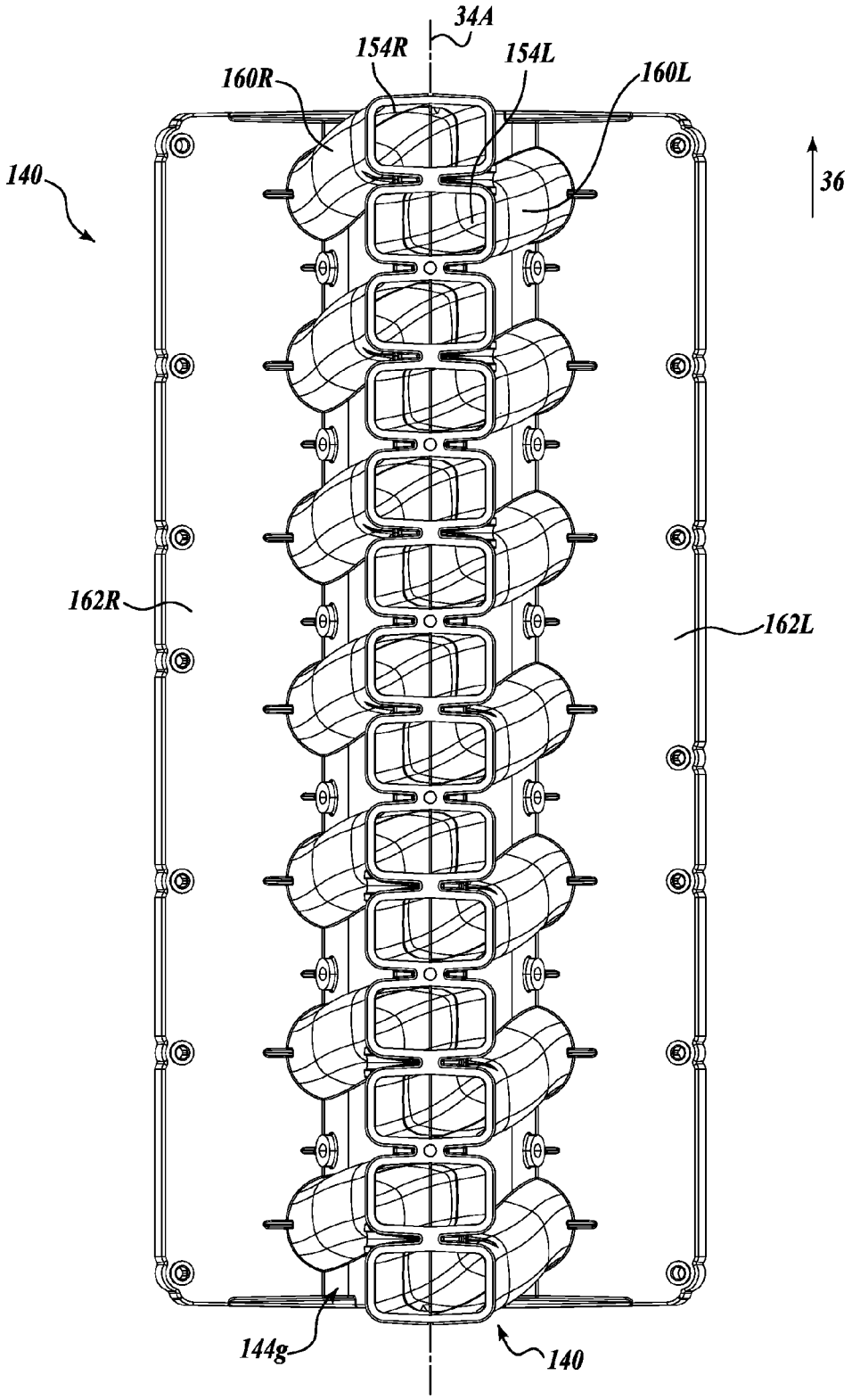
Figure 28:
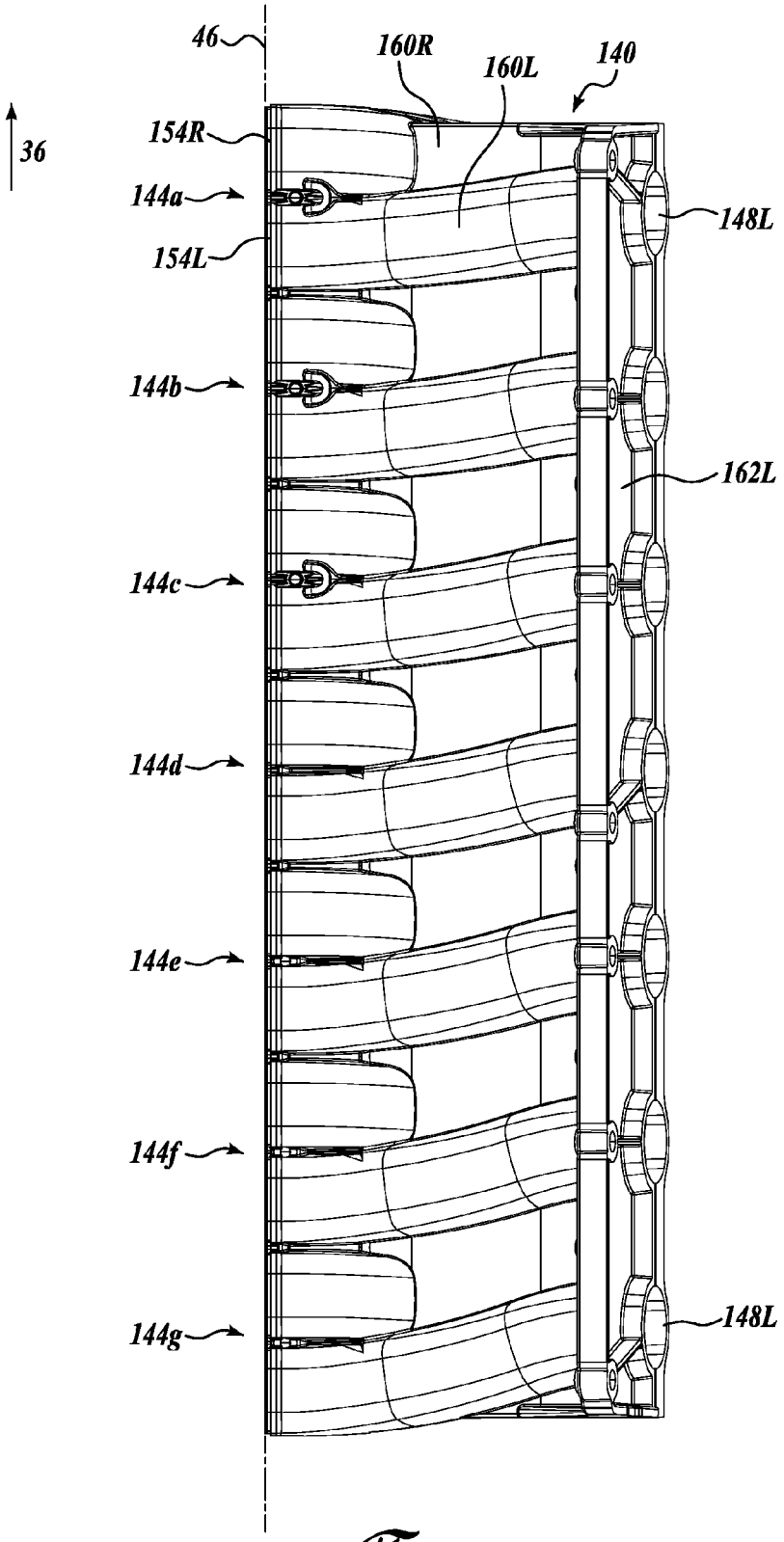
Figure 29:
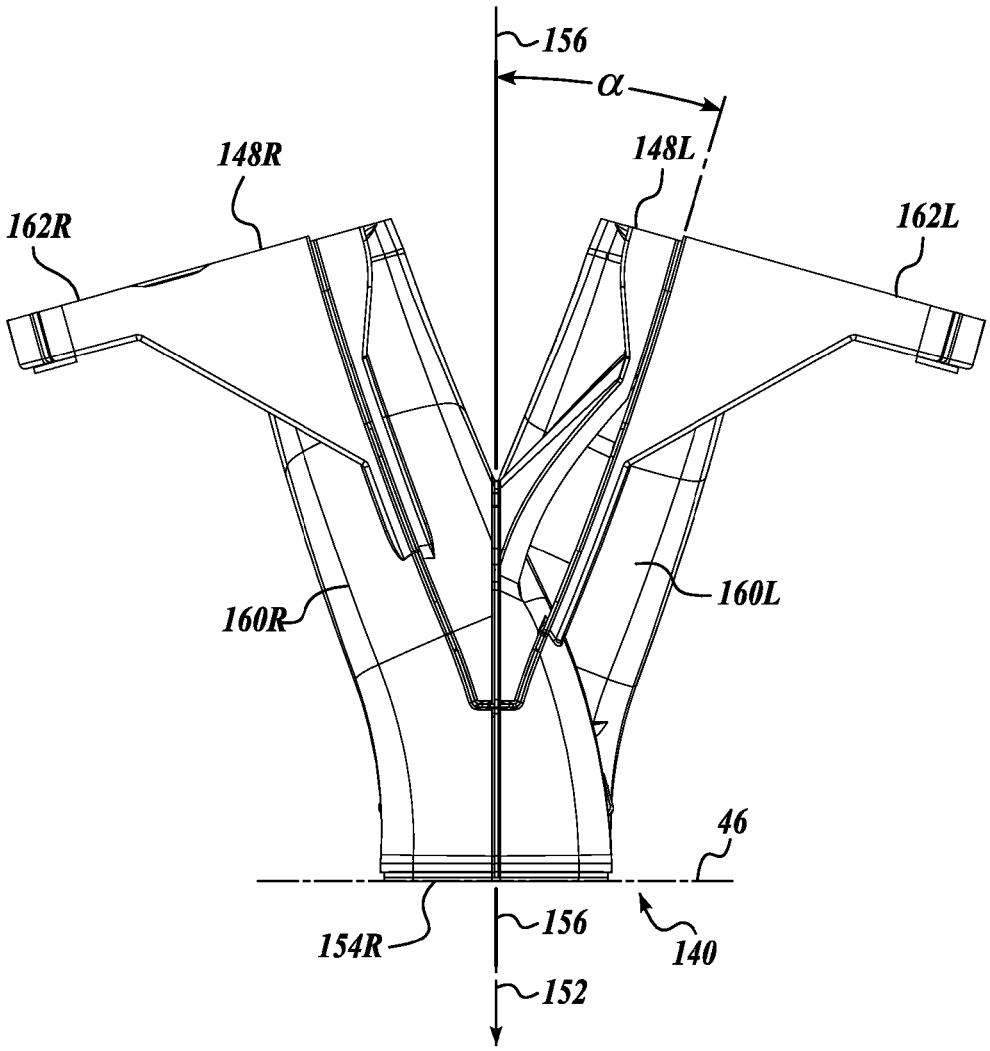

As perhaps best shown in FIGS. 24 and 25, the entrance openings or inlets 148L and 148R of the horns of each pair 144 are positioned side-by-side to each other. The entrance openings 148L and 148R are shown as being at the same elevation to each other, but they can be at different elevations to each other. Also, the inlets 148L and 148R are shown as round in shape, though the inlets do not necessarily have to be round. As perhaps best illustrated in FIG. 29, the inlets 148L and 148R are angled or canted with respect to a central axis 152 rather than being perpendicular to the axis. The angle $\alpha$ between the central axis 152 and the central axis of inlets 148L and 148R can be selected so as to provide enough separation between the drivers 142 to avoid interference therebetween. The angle $\alpha$ is shown in FIG. 29 to be of approximately 17 degrees, but the angle $\alpha$ can be in the range of 0 to 180 degrees.

The horn mouths 154L and 154R are in directional alignment with a central plane 156 which is in turn aligned with central axis 152, whereby the horn mouths are disposed in adjacent relationship to each other. In one embodiment of the present disclosure, the horn mouths 154L and 154R are stacked on top of each other, with the front of the mouths in vertical alignment. However, the front of the mouths do not have to be in the same vertical plane, but can be staggered fore and aft relative to each other. The horn mouths 154L and 154R are shown to be in the same rectilinear shape, and more specifically, rectangular in shape, having a width across the mouths that is greater in dimension than the height of the mouths. The dimensions of the width and height of the mouths are not directly related, and can be of other relative dimensions. Also, one or both of the width and height of the mouths can be selected based on a desired size of the throat "pinch" before the mouth flare 158; see FIG. 23.

Each horn 146L and 146R includes an elongate throat 160L and 160R extending between corresponding inlets 148L and 148R and mouths 154L and 154R. As shown in the figures, each of the throats 160L and 160R extends (curves) diagonally inwardly in the forward direction toward central plane 156, and also to be in alignment with the central axis 152 at mouths 154L and 154R. In addition, the throat 160R extends (rises upwardly) in a smooth, curved manner a distance equaling the elevation change from the elevation of inlet 148R to the higher elevation of outlet 154R. Correspondingly, throat 160L descends downwardly a distance corresponding to elevation change of inlet 148L to the elevation of mouth 154L. Throat 160L curves in a smooth arc to fold into a position beneath throat 160R. See FIGS. 22-29.

Drivers 142 are constructed with permanent magnets and coils in a known manner of high-frequency drivers. In the present situation, to achieve a lower vertical profile, the permanent magnets utilized in drivers 142 can be square in shape.

As shown in FIGS. 17, 18, 20, 21, 22, and 23, the horn flares 158 can be constructed as a unitary structure to project forwardly from the horn mouths 154L and 154R. Each of the horn flares 158 is substantially the same shape as the corresponding horn mouths, but flare outwardly in the horizontal direction from the horn mouths, thereby to enhance the horizontal projection of the sounds from the horn mouths. The horn flares 158 could be individually constructed rather than constructed as a unitary structure.

It will be appreciated that by the foregoing construction, the high-frequency horns are positioned within one-half of a wavelength of each other, thereby enabling control of the interaction between the sources. As a non-limiting example, the horn mouths may be 1.0 inch in height and on a 1.0 inch spacing. Moreover, the shape of the housing 120 causes the forwardly directed portion of the housing to function as a large horn for the high-frequency compression drivers and the mid-range transducers. Also the output from the high-frequency transducers 142 passes across the front of the horn wall 170 shown in FIGS. 18 and 19. In addition, as noted above, each of the high-frequency horns is independently powered by a separate transducer. Moreover, each of the high-frequency horns 144A, 144B is controlled by a separate DSP channel.

Although each of the horns 146L and 146R can be individually constructed and then assembled together, the above-described structure for the horn sets 144*a*-144*g* enables the horns to be constructed as consolidated subassemblies, for example, one subassembly at each side of the central plane 156. It is possible to produce the horn structure using permanent molds which are capable of achieving the rather complex shape of the horn structure very economically.

As shown in FIGS. 23-27, substantially planar flanges 162L and 162R extend vertically along the height of the horn structure at each of the inlets 40L and 40R of the horns 146L and 146R, respectively. The flanges 162L and 162R extend laterally outwardly from the inlets 148L and 148R, thereby to tie the inlet portions of the horns together and also to provide a mounting structure for drivers 142. Although the flanges 162L and 162R are shown as substantially planar, they can, of course, be in other shapes.

As noted above, a plurality of mid-range cone-type transducers 143 are mounted in a vertical array to each side of the horn structure 140. Although three mid-range cone transducers are illustrated in each vertical array, the number of such cone transducers can be increased or decreased from that illustrated. As shown in FIGS. 17, 18, 19, 20, and 21, the transducers 143 are protected in housings 136. Radial phase plugs 180 are used to load the transducers 143, extending the usable bandwidth thus facilitating the transition between mid-range and high-frequency transition. Moreover, the output from the transducers 143 passes through diamond-shaped openings 182 formed in the horn wall 170; see FIGS. 18 and 19, to also load the transducers. Horn flares 184 are disposed between the phase plugs 180 and the horn wall 170. The horn flares have forwardly directed openings 134, see also FIG. 5. The structure size and positioning of the mid-range cone transducers 143 enable the output therefrom to sum coherently with the high-frequency wave front generated by the high-frequency compression drivers 142 and helps maintain the desired wave front pattern control while providing horizontal symmetry. In this regard, the mid-range transducers present minimal impact on the high-frequency wave front, allowing the mid-range and high-frequency pass band origins to co-exist in nearly the same point in space without mutual interference.

Each of the mid-range transducers 143 is independently powered and controlled by a separate DSP channel. Thus, each of the mid-range transducers is independently powered and processed, as are each of the high-frequency compression drivers 143 and low-frequency cone transducers 130.

As shown in FIG. 5, a low-frequency cone transducer 130 is positioned in each of the lobe sections 122 of the housing 120. The low-frequency cone transducers occupy the entire height and width available in the lobe portion of the speaker. As shown in FIGS. 1, 2, 5, 9, 11, and 12, vertically spaced-apart slots 190 are located in the forward outward portion of the lobes 122 to provide enclosure venting for enhanced performance of the low-frequency transducers 130. In addition, vertically spaced slotted vents 192 are also provided in the forward inward portion of the lobe sections 122 to provide a degree of loading on the low-frequency cone transducers, and thereby shifting the apparent low-frequency sound source further apart and extending horizontal pattern control, thereby minimizing the build-up of low-frequency sound energy. These apertures 192, as well as apertures 190, extend outwardly beyond the transducers 130. This not only extends the uninterrupted surface of the horn, but also pushes the apparent origin of the low-frequency sound sources further apart. The net result is a configuration that provides optimal and consistent horizontal directivity for the size of the speaker housing. Also, the effective low-frequency cone transducers spacing is equal to approximately 90 percent of the mid-frequency horn size (the spacing between the inside surfaces of the lobes 122 of housing 120) with the horizontal beam width of the low-frequency transducers matched through crossover. In this regard, see U.S. Pat. No. 6,118,883, incorporated herein by reference.

With respect to additional features of the speakers 100, as shown in FIGS. 6 and 10-12, easy access manually graspable handles 196 curve around the rear corners of the housing 120 for convenient gripping, for example, when desired to lift or carry the speakers 100. Hand/finger wells 198 are recessed into the rear corner portions of the speaker housing 120. Because the rear portion of the speaker is much heavier than the forward portion of the speaker, placing the handles 196 in the rear locations, as shown, enables the speaker to be carried in a weight-balanced manner.

Referring additionally to FIG. 29, each of the speakers 100 includes four infrared proximity sensors (transmitters/receivers) 200 located at the sides of the housings 120 at the top and bottom thereof. In this regard, see FIGS. 1, 2, 6, 7, 8, 10, 11, and 12. These infrared sensors enable each of the speaker cabinets to communicate with adjacent cabinets, thereby to determine their relative positions within an array. Consequently, an array of speakers 100 can be fully modeled in software to match the array's physical configuration. Other types of proximity sensors can be used in place of infrared sensors, such as ultrasonic or radar based sensors.

Each of the loudspeakers 100 further includes a test key 201 that queries the loudspeaker for the last known status of the loudspeaker internal electronics. See FIGS. 6 and 10. The test key 201 is located on the control panel 206 at the rear 124 of the housing 120. This test key 201 is primarily intended for use during set-up of loudspeakers at the venue in question. The test key confirms the loudspeaker status based on the most recently performed self-diagnostic. When the test key is depressed, the internal systems of the speaker check the most recent test logs that are held in the speaker's memory. If the system finds no faults (acoustical or electronic), an indicator light 202 adjacent the test key will glow for a fixed time period. However, if the test function finds a fault within the speaker, the light will glow in a different color, indicating that a fault exists. The test key function is powered by a battery internal to the loudspeaker, and thus this particular test can be performed at any time, whether or not the speaker is externally powered or networked with other speakers and connected to the speaker control system 260, described below.

Figure 9:
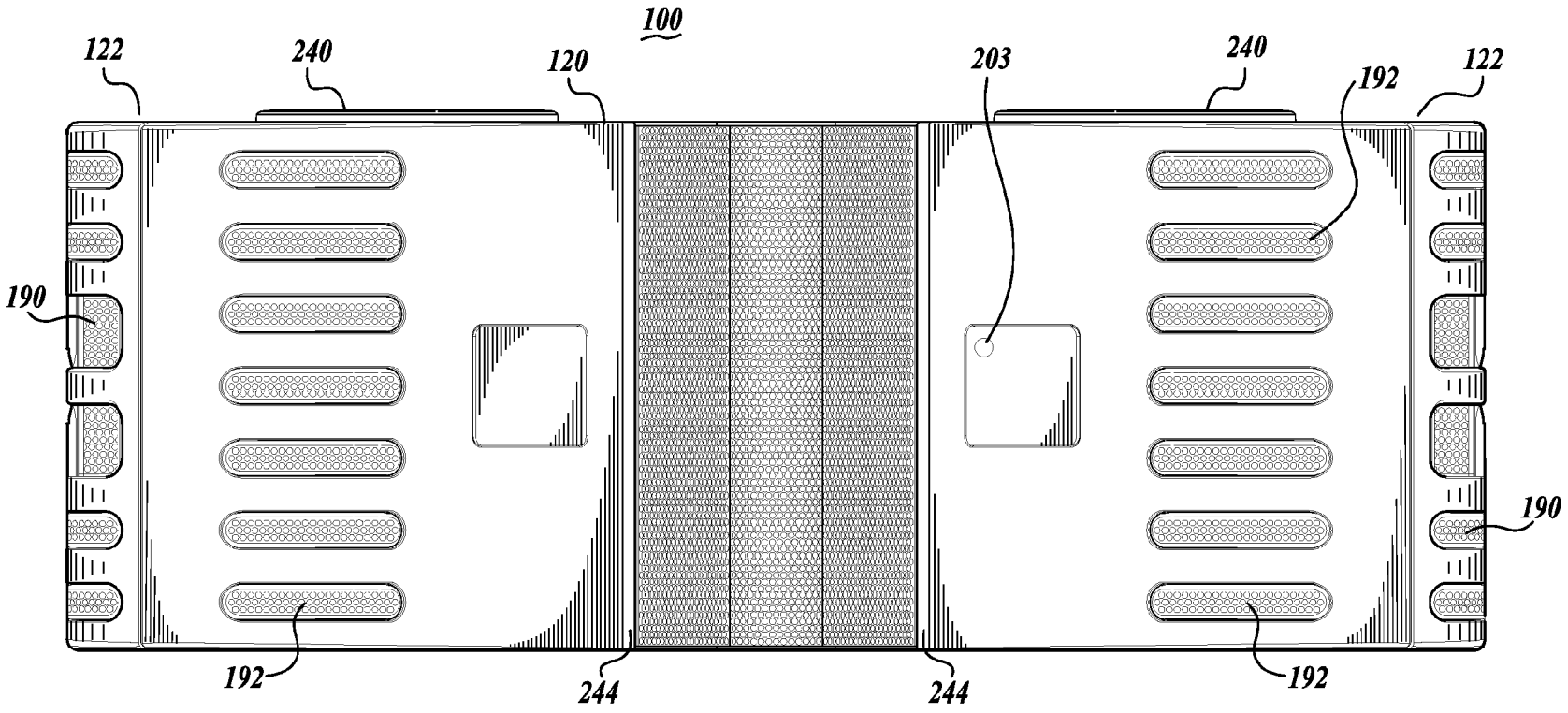
Figure 10:
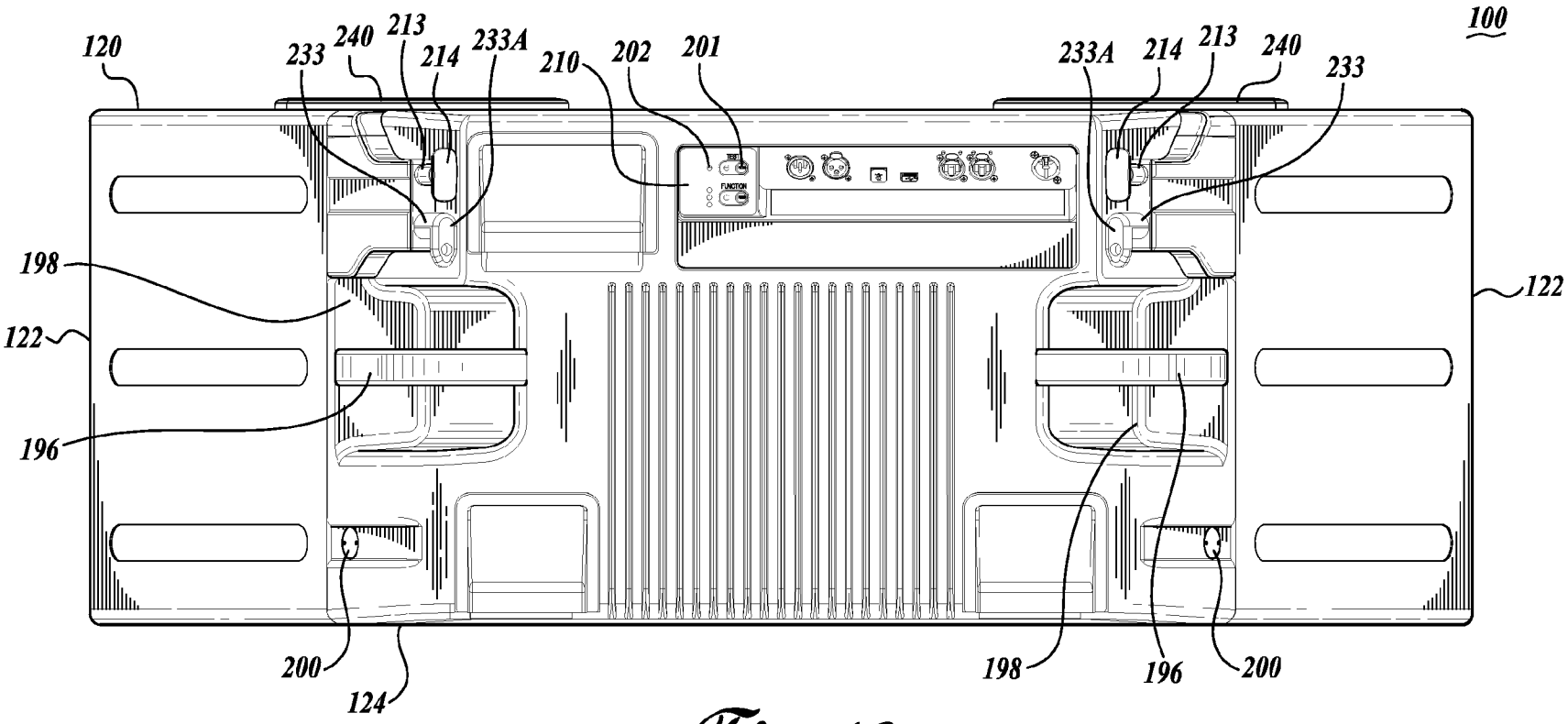
Figure 11:
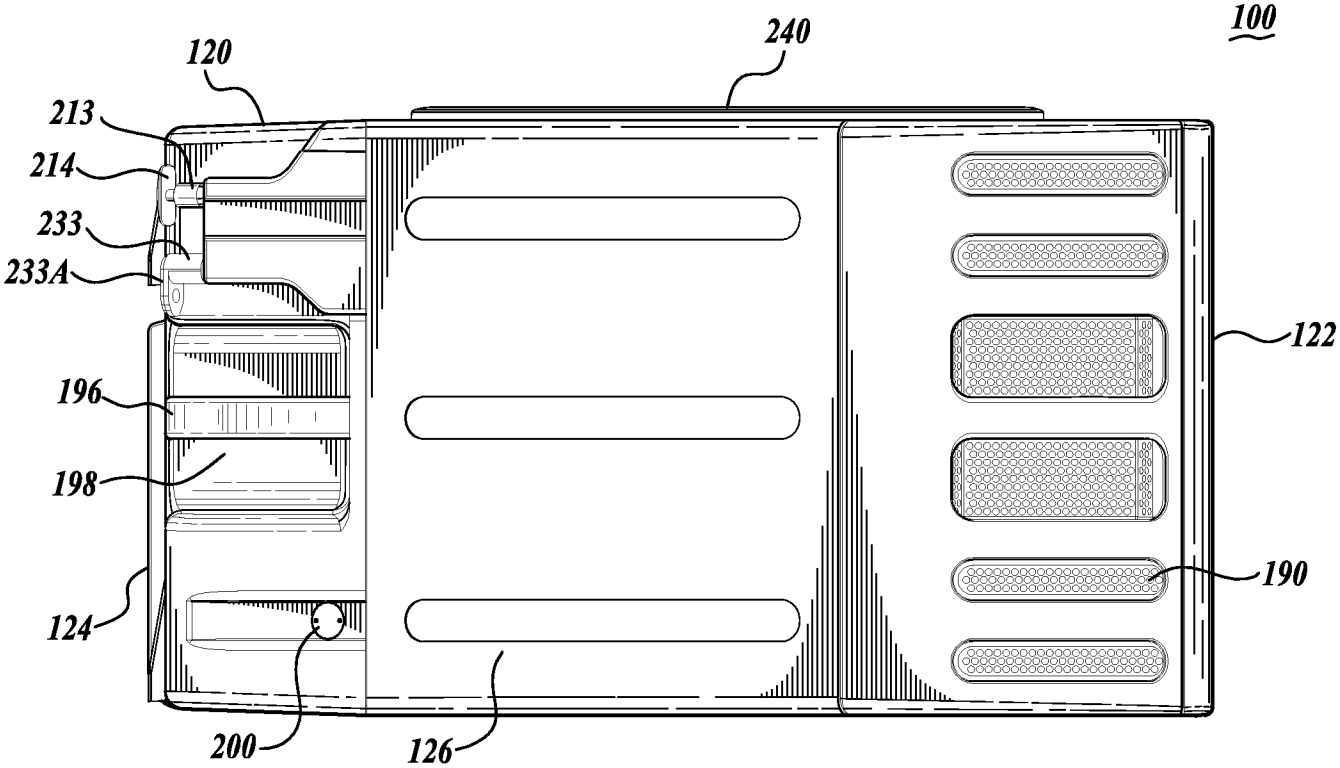
Figure 12:
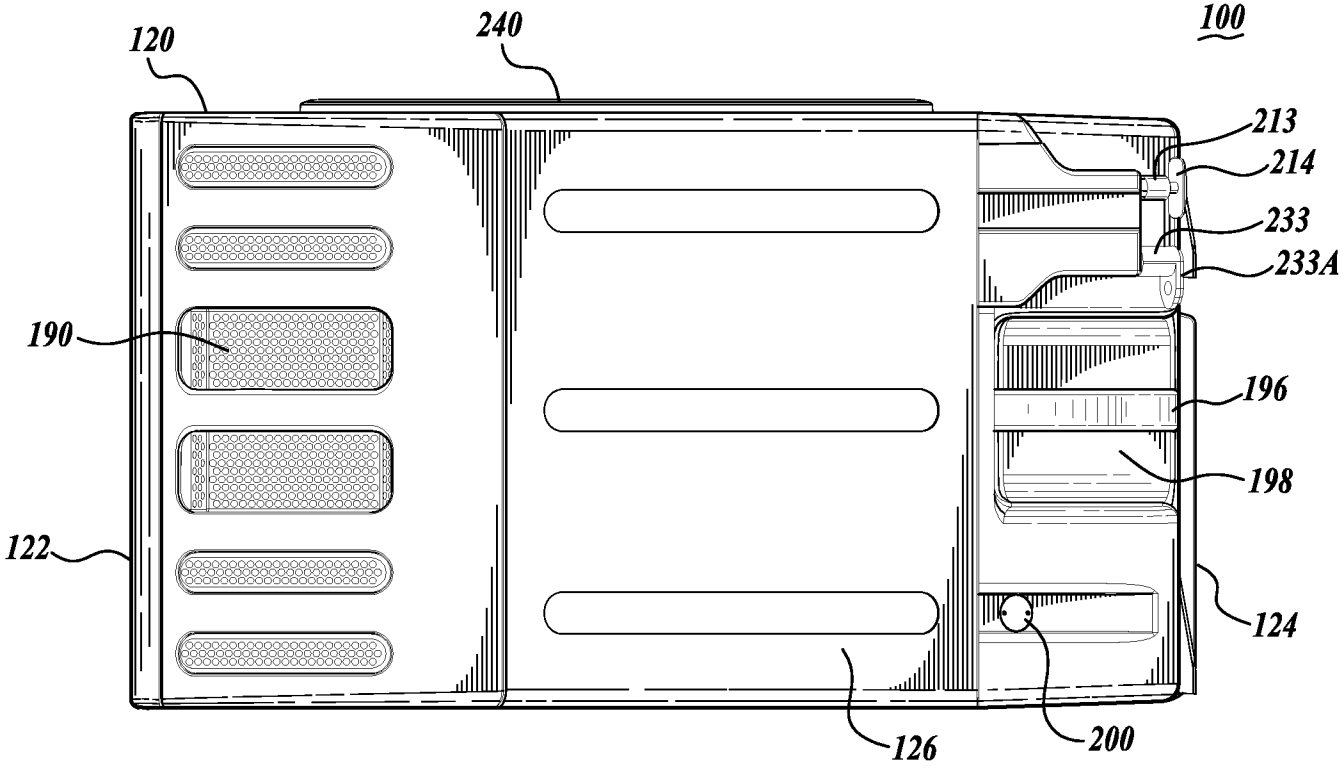

Also, each speaker 100 includes a built-in microphone 203 to perform in-situ diagnostics of the speaker, see FIG. 9. Such diagnostics utilize stored reference curves for the speaker to verify the status of the speaker drivers and transducers. This is intended primarily as a shop function to identify or assist in troubleshooting faults. The acoustic measurement function is activated by a software, and is not intended to be used during events.

To describe the foregoing more specifically, the front right panel of each housing 120 houses a calibrated microphone 203 that is used to confirm the operation of each driver and transducer within a loudspeaker 100, see FIG. 9. At the time of manufacture, the frequency response of each transducer is measured by the front panel microphone and then stored in the speakers' non-volatile memory. When physical diagnostics is performed (for example, in the shop after a performance), the frequency response for each driver/transducer is measured and compared to the factory-stored response. If the two measurements vary significantly, the control system 260 provides an alert and recommends a corrective action, for example, driver repair or replacement. If it is necessary to replace the driver or transducers, the measured response for the new component is compared to that of the original component at the time of manufacture. If the new component is within the specifications of the original component, the new response is stored in the non-volatile memory of the speaker in place of the factory-measured response, and on a going-forward basis is used for comparison in future diagnostics. In this manner, it is possible to objectively verify the performance of each driver/transducer in loudspeaker 100.

As a further feature, each of the speakers 100 includes a built-in tilt sensor located within the interior of the speaker.

This sensor can help establish the hang angle of the speaker array, which should be substantially vertical. The tile sensors provide active feedback to the control system 260 of the speaker, described below.

The speakers 100 can be vertically flown (hung) as shown in FIGS. 3, 4, and 13-15 through the use of flybar latches 210 that fit vertically through slots or rigging channels 212 formed in pairs along each outer side of housing 120. The flybar latches extend through the rigging channels 212 of the top speakers 100. Locking pin actuators 213 are provided interior to and along the sides 126 and 128 of the speaker to engage the flybar latches 210. These locking pin actuators 213 are activated by exterior rigging pin grips 214 that project rearwardly from each side of the speaker housing 120. The locking pins engage through latch-holes 215 formed in the lower end of the flybar latches.

The upper ends of the flybar latches are attachable to a flybar structure 216 composed of a pair of parallel transverse rearward and forward crossbars 220 and 222 having their corresponding ends connected by side bars 224 and 226 that extend along the outer face of the sides 126 and 128 of the speaker housing. It will be appreciated that the crossbars 220 and 222 can be connected to the side bars 224 and 226 by using brackets 227 or other means. Alternatively, the entire flybar can be constructed from a singularly welded, cast, or molded unit.

The construction of the flybar assembly 216 enables vertical speaker arrays to be conveniently jointed together in side-by-side relationship together by placing the corresponding side bars 224 and 226 of adjacent vertical arrays in face-to-face relationship to each other and then securing the corresponding side bars together. In this regard, two adjacent arrays may be initially positioned together through the use of a pin 228 extending outwardly from the forward and rearward portion of side bar 226. The pin 228 has an enlarged and pointed head 229, to initially engage through a rearward enlarged portion of a slot 230 formed in the side bar 224. Once the head 229 of pin 228 has extended through the enlarged width portion of the slot 230, the pin can be slid forwardly in the slot 230 to engage a narrower portion 231 of the slot that corresponds substantially to the width or diameter of the pin 228. When the pin 228 is in such position, the side bars 224 and 226 are in substantially a face-to-face position with each other.

Speakers 100 are conveniently attachable one on top of the other. In this regard, each of the speakers 100 includes rigging latches 232 slidably engageable within slots or rigging channels 212 at the sides of the speaker housings, see FIG. 2. Speakers 100 are attached in stacked relationship by releasing the rigging latches 232 of an upper speaker to engage within the channels 212 of a lower speaker, and then the rigging latches 232 are locked in place within the channels 212 of the lower speaker. When one speaker is positioned above the other, the vertically slidable rigging latches 232 are released by retracting lower latching pins 233 by pulling a pin grip 233A outwardly, thereby to disengage the latching pin from through holes formed in the upper end portions of the rigging latch 232. At the time that the rigging latches 232 are released from the upper speaker 100, the upper latching pins 213 of the lower speaker are disposed in retracted or outward position by manipulating the rigging pin grip 214 thereof. Once the rigging latches 232 have slid downwardly into the channels 212 of the lower speaker, then the upper latching pins 213 are engaged through the engagement rigging latch holes 234 extending through the lower ends of the rigging latches 232, thereby to lock the rigging latches 232 with the lower speaker 100. The rigging latches 232 are only allowed to extend downwardly below the lower surface of the upper speaker a distance sufficient for the latching pins 213 to engage through the rigging latch holes 234. In this manner, the speakers 100 can be quickly and conveniently coupled together in a secure manner without requiring any tools. It will be appreciated that by the foregoing construction, the speakers 100 can be arranged in vertical arrays of any desired height. Also, the components for coupling speakers 100 are "built-in" within the envelope of the speaker housing, which facilitates attaching two or more vertical speaker arrays side-by-side to each other.

Moreover, since the speakers 100 are flown in vertical relationship to each other, there is no need to position adjacent speakers at an angle relative to the horizontal or relative to each other or to adjust any angularity between speakers. This greatly simplifies the flying of speaker arrays in terms of required rigging as well as rigging time. As such, the foregoing system for attaching vertically adjacent speakers may be utilized.

Referring to FIGS. 1, 2, and 5-7, arcuate-shaped stacking pads 240 are positioned on the top of each lobe section 122. The size and shape of the stacking pads 240 matches grooves 242 formed in the underside of the housing lobe sections 122; see FIG. 8. In this manner, the pads 240 locate vertically adjacent speakers one to another and assist in maintaining the speakers stationary relative to each other in the horizontal directions.

A vertical alignment line 244 extends vertically along the inside surfaces of each lobe section 122 adjacent grille 246, which covers the central portion of the front of the speaker. The alignment line 244 can serve as a visual indication of whether or not the speakers 100 of a vertical array are all in alignment with each other. As shown in FIGS. 3 and 4, when the speakers are in alignment, the alignment line 244 of the speakers form a continuous uniform, vertical line along the height of the array. The alignment line 244 can be of a color distinctive from the adjacent portion of the speaker housing so as to improve the visibility of the alignment line.

Figure 30:
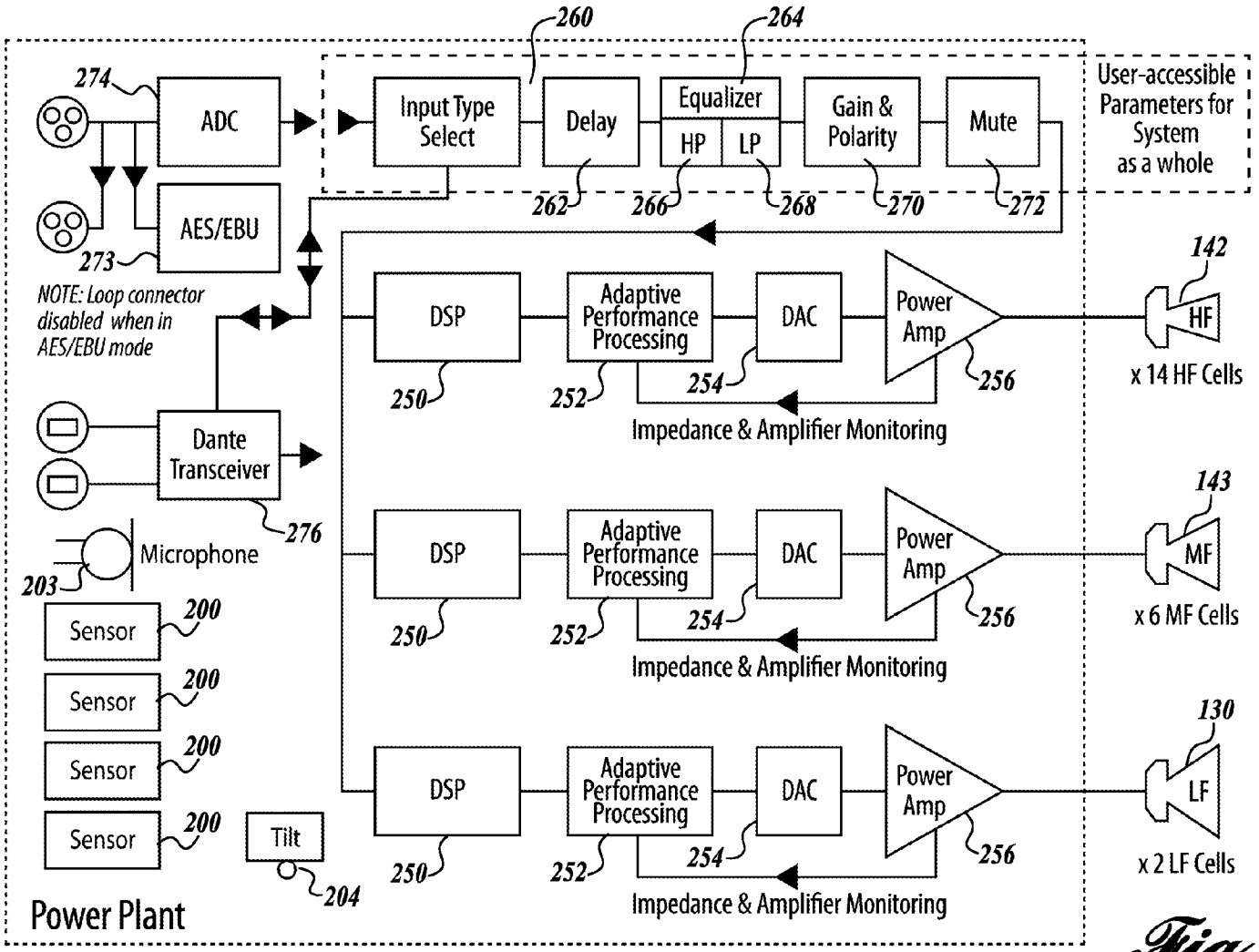

As noted above, each of the high-frequency compression drivers 142 as well as each of the mid-range cone transducers 143 and each of the low-frequency cone transducers 130 is individually powered as well as individually controlled. This is schematically illustrated in FIG. 30. As shown in FIG. 30, associated with each high-frequency compression driver 142 and each mid and low-frequency cone transducer 143, 130 is a DSP channel 250 that operates in conjunction with adaptive performance software 252. This software assists in generating optimal DSP control parameters for the compression drivers 142 and cone transducers 143 and 130 by generating particular acoustic lobe configurations. The control signal from the DSP 250 is routed through a digital-to-analog converter 254 and then through a power amplifier 256, and then to the high-frequency, mid-range, and low-frequency compression drivers/cone transducers.

The adaptive performance software, by generating desired or optimal DSP control parameters for the compression drivers and cone transducers, is able to steer or direct the output from the compression drivers and cone transducers in the vertical and horizontal directions. Typically, the signal from the high-frequency compression drivers and mid and low-frequency cone transducers can be directed between any angle or angle range in the vertical direction from essentially straight down to straight up and anywhere therebetween. Moreover, the angular output in the horizontal direction of the compression drivers and cone transducers can be directed in about a 60° range.

Further, as shown in FIG. 30, a control system 260 is provided that is capable of controlling the gain, delay, and response of speaker systems. The control system 260 has a delay subsystem 262 for controlling the delay of the system. The control system 260 also has a parametric equalizer 264 as well as a high pass filter 266 and a low pass filter 268 to control the output produced by the system. The control system 260 further includes a subsystem 270 to alter the gain and polarity of the output from the system. In addition, the control system 260 has the ability to mute the output from the system via subsection 272.

Input of digital audio signals to the control system 260 can be via AES/EBU (AES3) port 273 routed through an analog-to-digital converter 274. The input to the controller 260, as well as output therefrom, also may be routed through Dante enabled ports 276. The Dante ports also function as the network interface to the control system 260.

Figure 31:
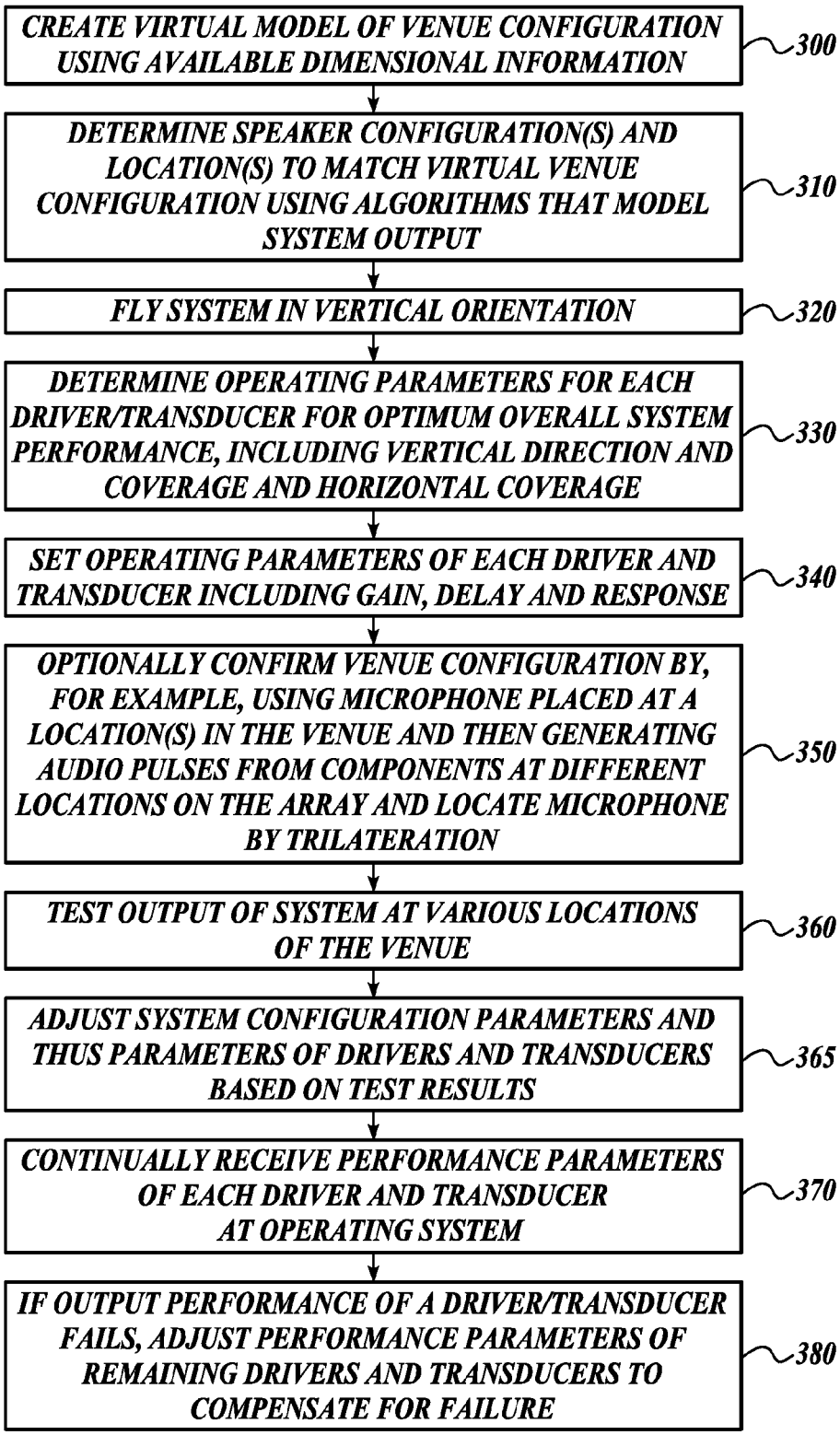

One example of a methodology of installing arrays composed of speakers 100, such as speaker arrays 102, 104, 106, 108, or 110 is illustrated in FIG. 31. The exemplary methodology at step 300 includes first creating a definition of the venue, then, at step 310, determining the array or arrays of speakers 100 to match the venue. In this regard, the array coverage pattern is optimized to the venue based in part on the calculated ideal wave front. The arrays are flown at step 320, and then at steps 330 and 340 each of the drivers/transducers of each speaker is electronically adjusted and tuned to the venue. In this regard, the operational parameters of the speakers are determined and then set. The output of the system can be tested at various locations of the venue at step 360 and if needed, the output of the speaker and its components can be adjusted at step 365. Also during the use of the speakers, the output of each driver/transducer in each speaker is continuously monitored, and, if need be, adjustments made thereto, see steps 370 and 380.

The definition of the performance venue is "drawn" in software using dimensional information available pertaining to the venue, including its length, width, seating areas, stage elevation and position and size, balcony locations and positions, etc. Once the loudspeaker arrays have been flown in the venue, the venue configuration can be confirmed by using one or more microphones positioned at one or more points in the venue, see step 350. The audio system of the present disclosure generates several impulses from the high-frequency compression drivers and/or mid/low-frequency cone transducers at different plural locations. The system of the present disclosure trilaterates the location of the microphone. This information assists in modifying a preference or making corrections to the venue model. It will be appreciated that by using this trilateration function, it is no longer necessary to make manual measurements of the venue and carry out the associated numeric data entry of such measurements.

In step 310, noted above, one or more loudspeaker arrays are configured to match the venue in question, including matching the size and the shape of the venue, as well as the locations of the audience members and based on the ideal wave front for the venue. In this regard, algorithms have been developed to model the output of the loudspeakers 100 and each compression driver/cone transducer thereof not only to provide sound to all desired areas of a venue, but also to achieve pleasing results. In one approach the venue is divided into a grid of spots and the loudspeakers are "aimed" to direct sound to each such spot. The loudspeaker arrays are constructed from identical speakers 100 and the rigging system, described above, is used to quickly and conveniently construct and position the arrays at the venue.

At steps 320 and 330, the operating parameters for each of the high-frequency compression drivers as well as the mid- and low-frequency cone transducers of each loudspeaker are determined to optimize the speakers to the venue. In this regard, as discussed above, each such compression driver and cone transducer is independently powered and processed. In part of the present process, the control system of the present disclosure is aware of the location of each of the speakers 100. As discussed above, four infrared or other type of proximity transceivers 200 are mounted on each speaker housing 120. The transceivers are located two at the top and two at the bottom of the speaker housing on opposite sides of the speaker housing, which enables the speakers to be modeled as two-dimensional arrays. With this information, the physical layout of the loudspeakers is determined. The data transmission that occurs between each loudspeaker identifies each adjacent loudspeaker. In this manner, the position of each loudspeaker is determined. Also, as noted above, each loudspeaker includes a tilt sensor 204 to confirm that the loudspeaker in question is vertical positioned, or whether the loudspeaker is at an angle off vertical. This information is also useful in adjusting or targeting the output from each speaker.

Using the control system 260, described above, the vertical directional output of each high-frequency compression driver and each mid-range and low-frequency cone transducer can be steered in the vertical direction to achieve the best audience coverage. In this regard, as noted above, the vertical angle directional output with the drivers and transducers is adaptive throughout the entire 180° range of from vertically down to vertically up. It will be appreciated that the spacing between each of the high-frequency compression drivers, as well as each of the speakers, is minimized so as to maximize the vertical lobe alteration within the speakers' operational bandwidth, and thereby minimize vertical artifacts.

Also, as noted above, the output of the transducers and drivers is controlled to provide the device horizontal coverage. The spacing between each horizontally adjacent transducer is also minimal, to maximize horizontal lobe alteration within that transducer's operational bandwidth, and to minimize horizontal artifacts. The nominal horizontal beam width of speakers 100 is approximately 70 degrees. This beam width can be increased up to 360 degrees by using multiple columns of speakers 100.

It will be appreciated that each of the speakers 100 within an array is networked together, and thus the controls for each of the compression drivers and cone transducers of each speaker, via a computer processor which operates a DSP as well as applicable algorithms to control the output and directionality of each of the transducers in each of the speakers. Such computer processor calculates all of the lobe formation parameters for the speakers and communicates them to the loudspeakers.

The networked control system also monitors the operation and performance of all of the loudspeaker compression drivers and cone transducers in the arrays on an ongoing basis, see step 370. Since the performance parameters for the loudspeaker components are sent electronically to the loudspeaker components from the control system, such parameters can be modified very quickly at any time. Some of the monitored parameters include transducer impedance, amplifier temperature, voltage, and currents of each driver/transducer, and this information is recorded on a "live" status log that can be downloaded. In this regard, not only is the functionality of each compression driver and cone transducer confirmed, but also the control system assesses the complete performance of each compression driver/cone transducer by comparing such performance with reference parameters stored in memory. Also, follow up or supplementary venue measurements can be conducted at any time, as discussed above, thereby to more accurately define the venue. For example, if additional seats in the venue are sold, or the performers are not satisfied with the sound quality, the coverage from the speakers can be easily modified.

The above methodology can be used to design the speaker configurations for the venues shown in FIGS. 13, 14, and 15. The nature of the "coverage" achieved at the venue is shown in FIGS. 13-15, wherein the various cross-batching corresponds to the sound level achieved at the various locations of the depicted venue.

FIG. 13 is a large indoor arena having multiple levels. Two substantial columns of speakers are used to cover the disparate requirements of the venue. Each of the arrays covers 120 horizontal degrees, but with varying the vertical directivity from column-to-column. Nonetheless, the arrays deliver the audio at the venue as a single integrated entity.

In FIG. 14, two speaker arrays are utilized to cover a very large, steeply raked outdoor amphitheater. The speakers are capable of delivering audio over the entire amphitheater within +/−2 decibels. The vertical directivity of the speakers is directed upwardly sufficiently to reach the back of the amphitheater while spilling off the lower forward section of the amphitheater.

FIG. 15 depicts a large tent utilizing two arrays composed of a six-module main column which covers most of the area and is pointed to the unit's far corner on two-module outer column that fills the immediate near-field and house-left.

If a failure of one or more transducers, or even an entire speaker, occurs after the speaker arrays are flown, or even during a performance, the failure is recognized by the networked control system and corrective action can be taken, step 380. Even before the overall system monitoring occurs, each loudspeaker can be tested, since each loudspeaker contains a self-test function built into the circuitry of the loudspeaker system to enable verification that all the components of the loudspeaker are operating correctly. The results of this test can be queried by simply pressing a self-test button on the loudspeaker.

If a portion of the system is damaged, the control system will determine a solution and adjust the system coverage in response. Essentially, the control system is able to rebuild the acoustical model of the loudspeaker components without the "failed" sources. In this regard, compression drivers and cone transducers parameters can be adjusted to affect the vertical direction between adjacent speakers and direct sound at every "spot" in the venue. Therefore, "spots" to be hit are redefined to adjust to the non-functioning drivers/transducers. If a particular loudspeaker or component thereof cannot "hit" every desired spot in the venue, then adjacent loudspeakers, drivers, and/or transducers are used to "fill in" the sound to achieve the desired coverage. Due to the reduction in sound level over distance, typically, more loudspeaker components are focused at further areas, and fewer loudspeaker components are directed at closer areas. It is not necessary to physically alter speaker-to-speaker angles, but instead digital signal processing is used to alter the component-to-component angles in accordance with the new virtual acoustical model created with the failed source (s) removed. The same process is used to achieve the desired horizontal coverage in the instance that a failure occurs in one or more of the drivers/transducers, or even in an entire speaker.

The speaker 100 and the arrays constructed therewith as well as the control system for the arrays described above provide significant advantages over preexisting loudspeaker arrays. For example, in the arrays of the present disclosure, the position of each loudspeaker itself is self-recognizing, and all of the drivers/transducers in each loudspeaker are networked together and individually powered and controlled for output level as well as for horizontal and vertical directionality. Further, the present loudspeaker system is "self-healing" and adapts if one or more component failures occur, even during use. Further, the rigging of the loudspeaker arrays is simplified and thus the arrays can be flown quickly and easily and also disassembled quickly and easily.

Figure 32:
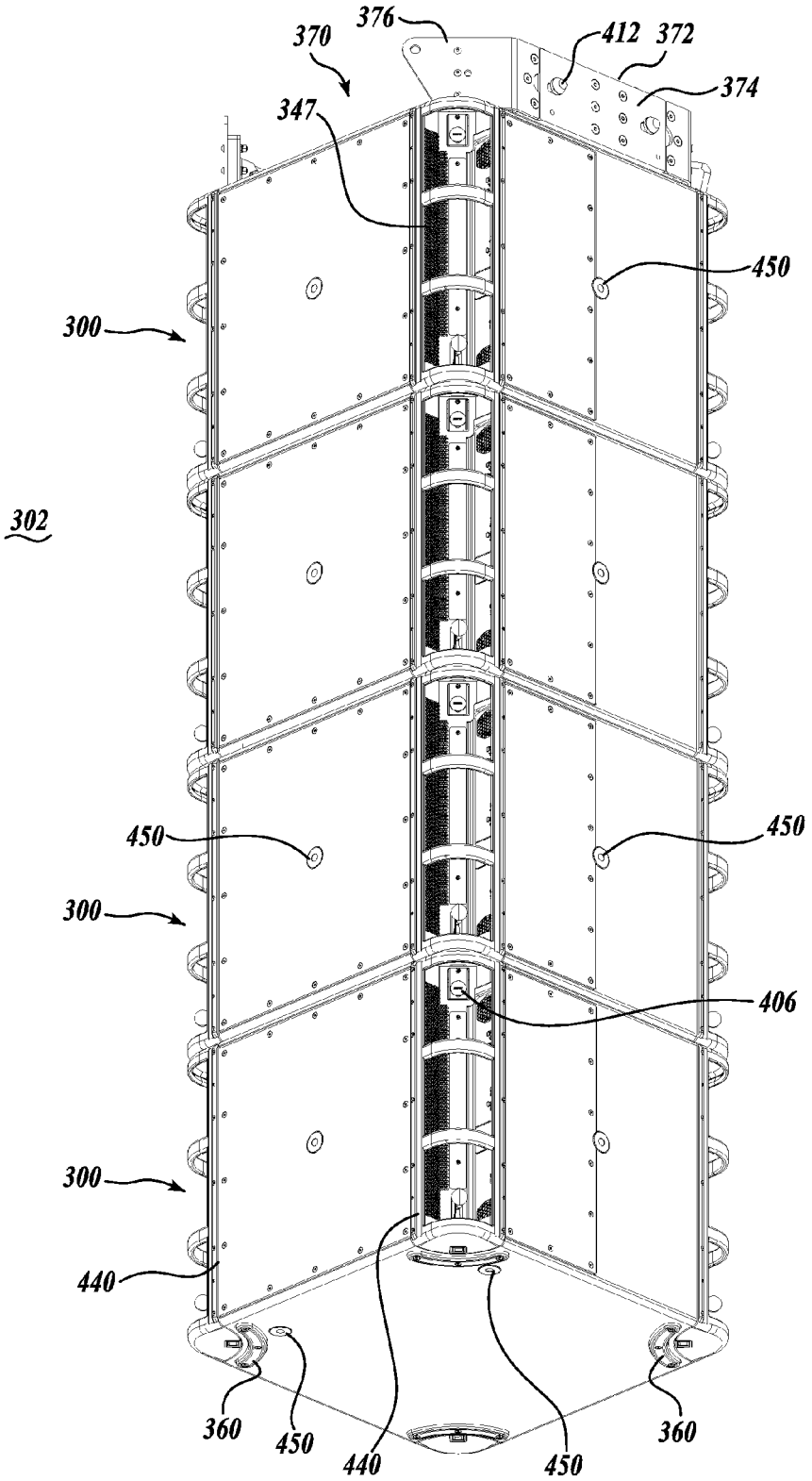
Figure 33:
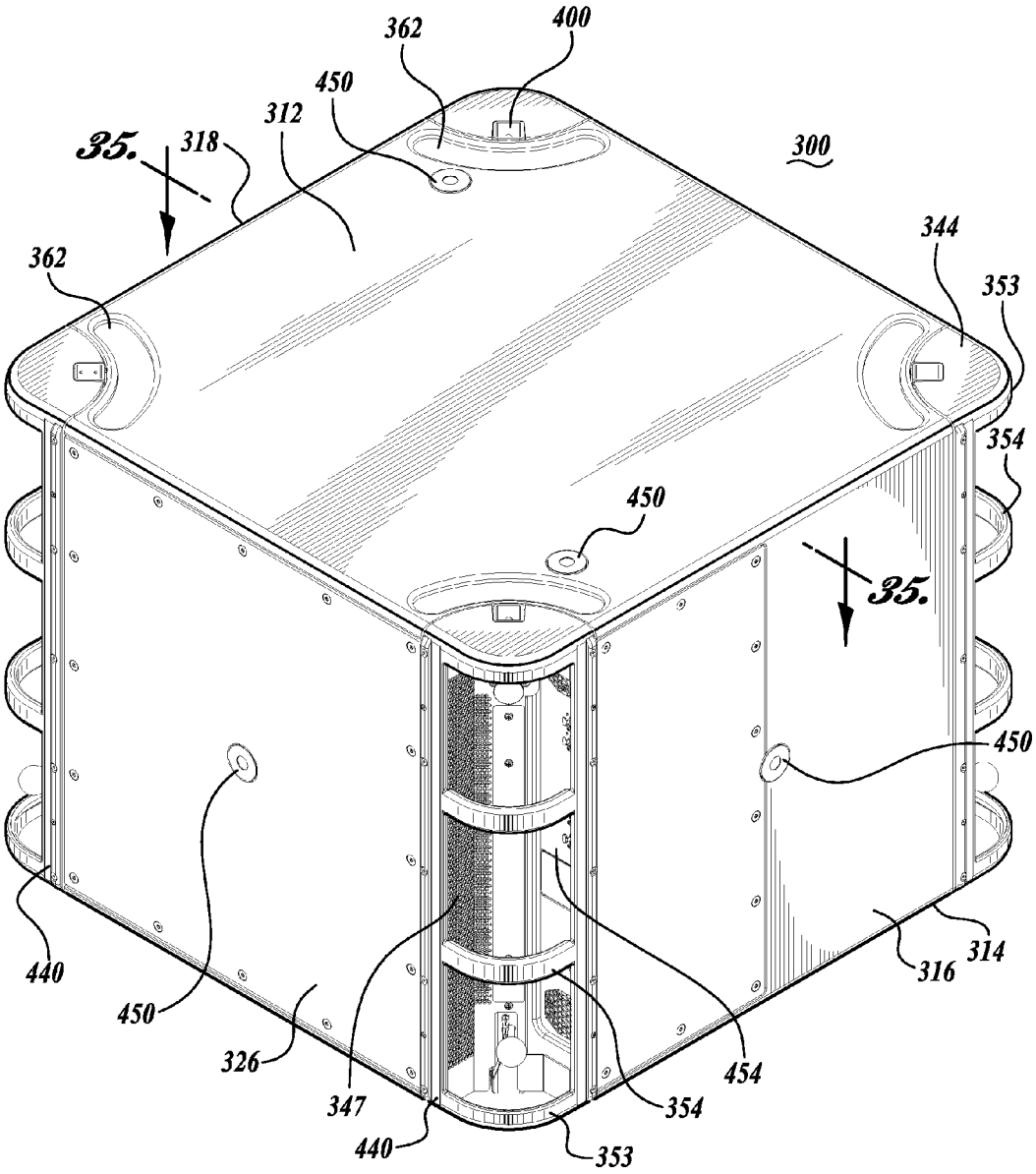
Figure 34:
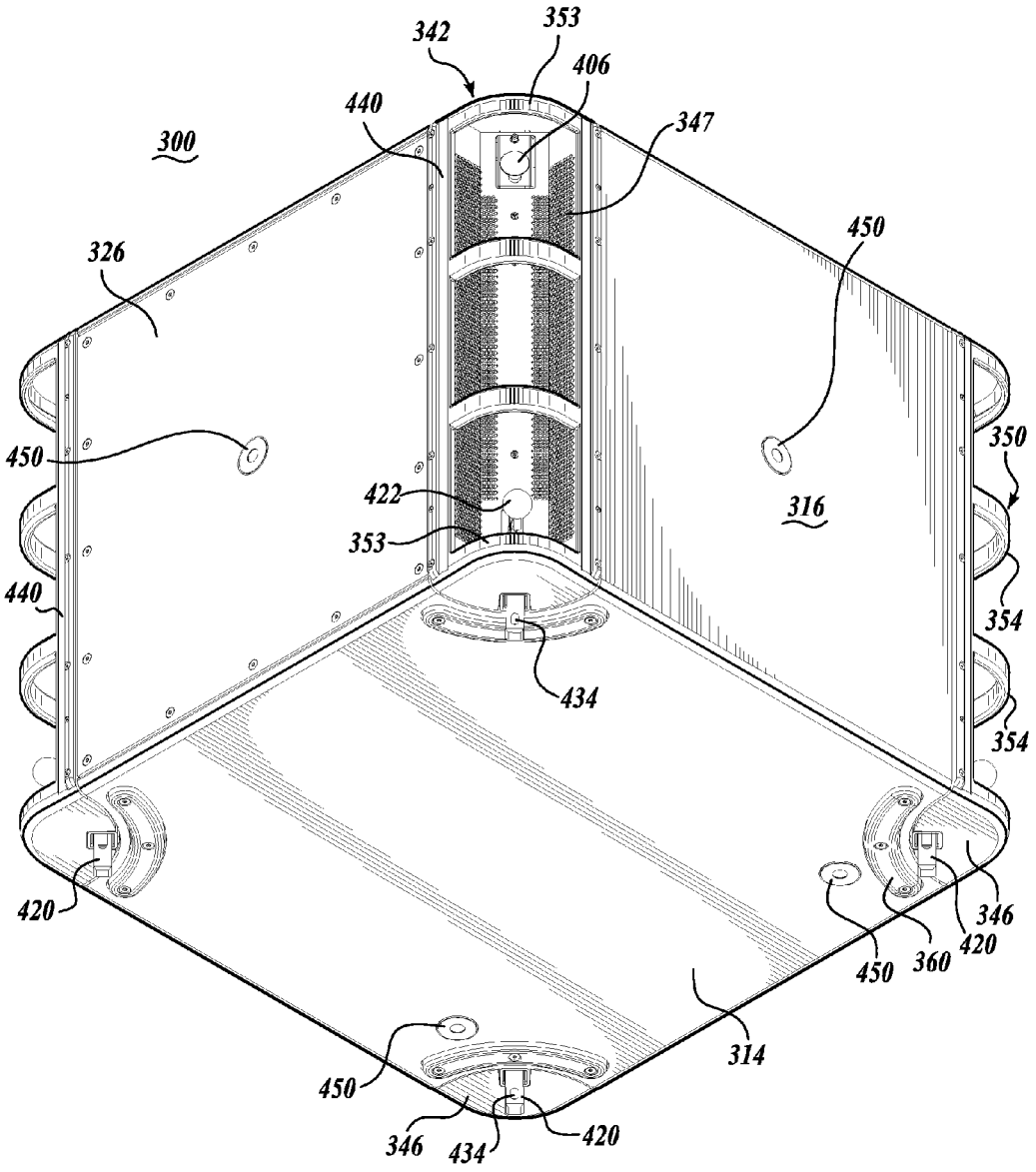

An ultra-low frequency or subwoofer loudspeaker 300 (also "speaker") of the present disclosure is shown in FIG. 32 as a vertically stacked array 302 and in FIGS. 33 and 34 as a singular unit. It will be appreciated that while the array 302 is illustrated as a single stack of loudspeakers 300 positioned one on top of another in vertical arrangement, other speaker arrays can be utilized. For example, the speakers 300 can be arranged in two side-by-side stacks. Further, the number of speakers in the side-by-side stacks arrays do not have to be identical.

Figure 35:
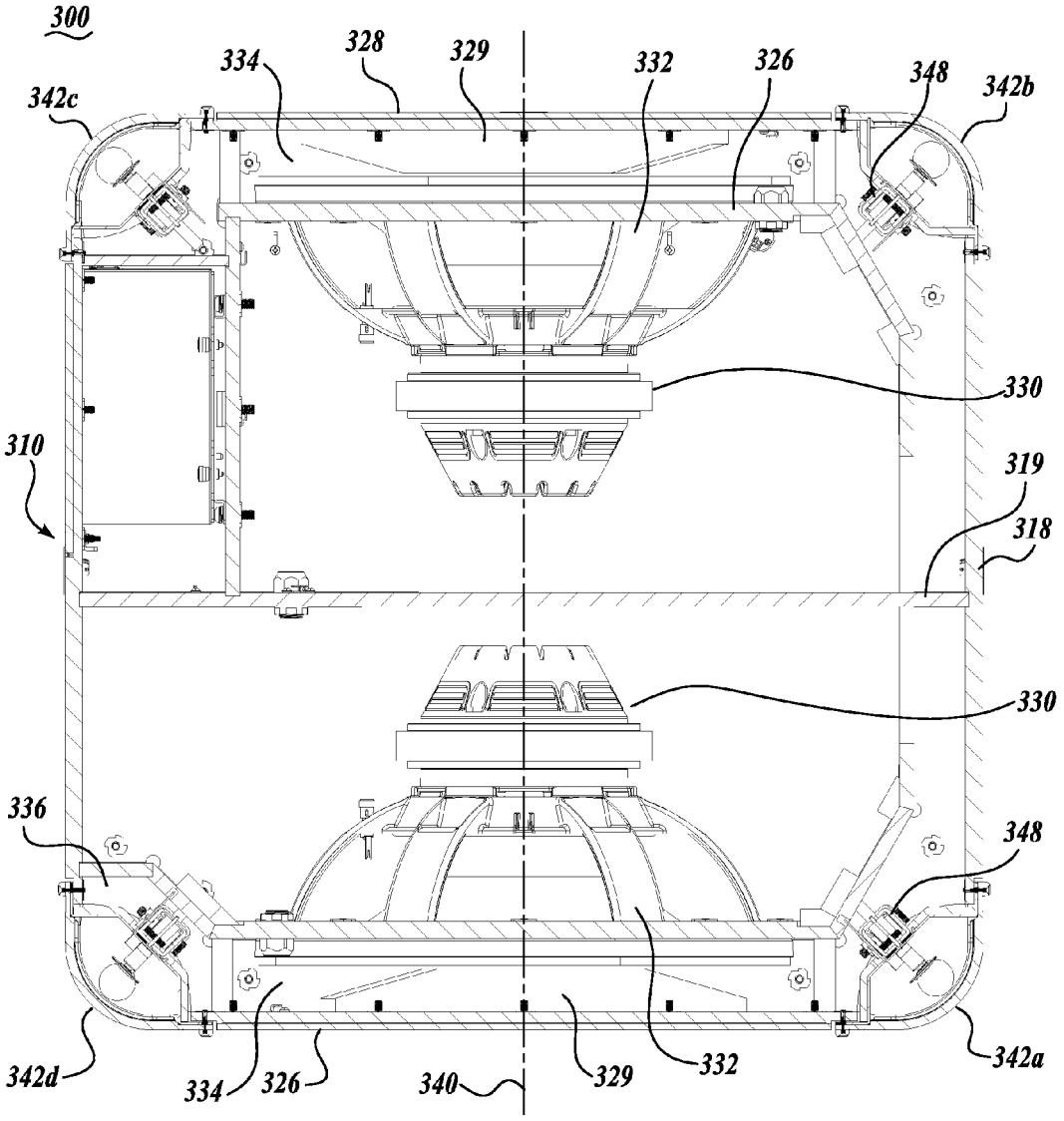
Figure 36:
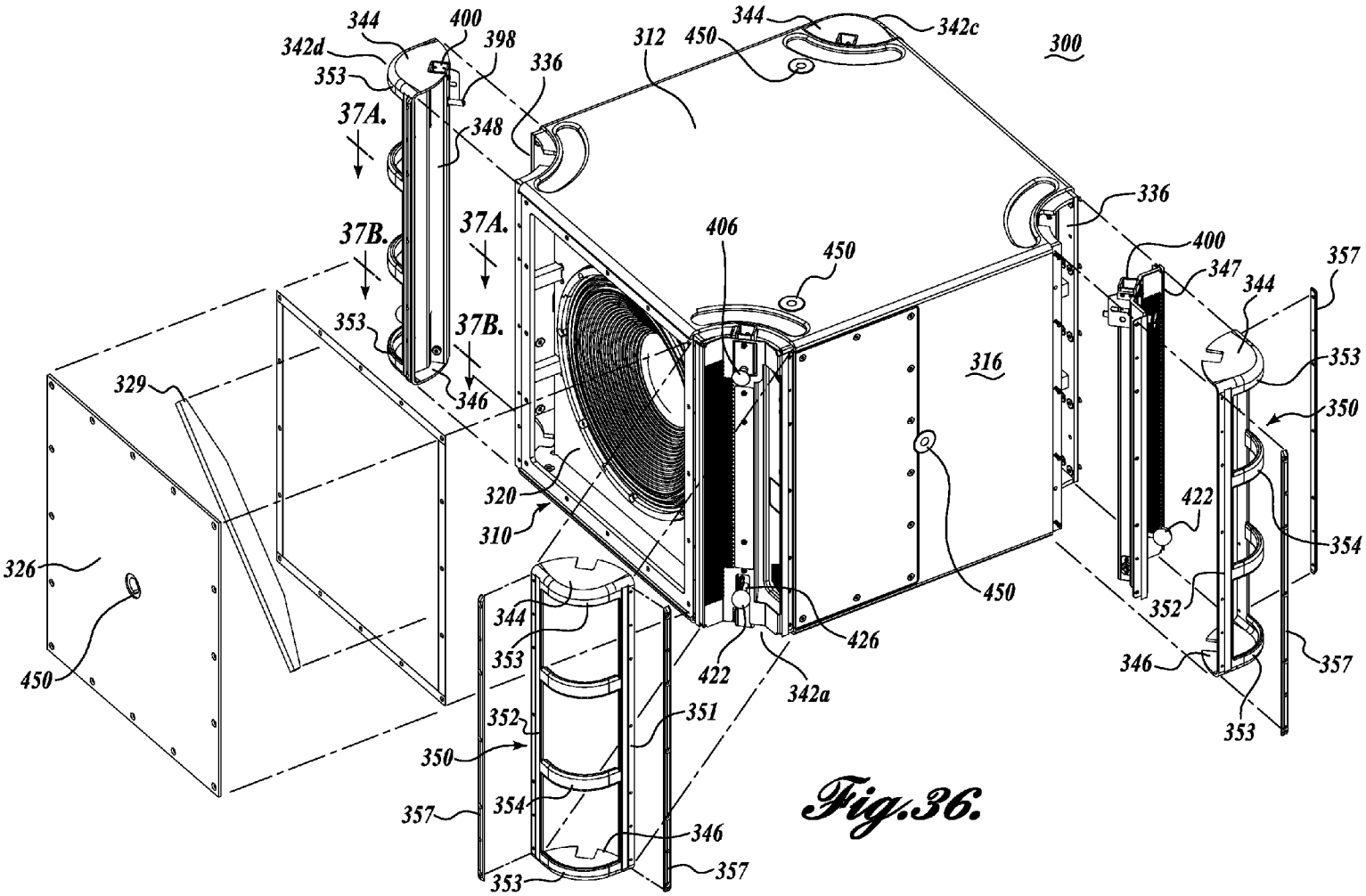

Describing the individual speakers 302, as shown in FIGS. 33-39, each speaker 300 is generally in the form of a square when viewed from the top or bottom. Moreover, an overall general shape of the speaker 300 is generally in the form of a rectangular cuboid, but does not have to be so. The speaker 300 includes a housing 310 composed of a top panel 312, a bottom panel 314, and side panels 316 and 318 spanning between the top and bottom panels. An intermediate transducer or chamber separator panel 319 divides the housing into two sections, one for each ULF transducer 330. Transducer baffle panels 320 are spaced inwardly a distance from removable front and rear panels 326 and 328. As shown in FIGS. 35 and 36, ULF transducers 330 are mounted on the mounting panels 320 within a circular hole formed therein for receiving the transducer. In a standard manner, the frame 332 surrounding the diaphragm or cone of the transducer can be attached to the mounting panel 320 by hardware members extending through holes formed in the panel outwardly of the circular central opening for the transducer.

As shown in FIG. 35, when the front and rear panels 326 and 328 are mounted in place on housing 310, a gap or front chamber 334 exists between the inside surface of the panels and the transducer mounting panels 320. Moreover, this gap 334 is open to the vertical corners 336 of the housing 310. As shown in FIG. 35, the transducers 330 are mounted in back-to-back alignment with each other along an axis 340. Stiffener bars 329 are mounted diagonally to the inside surfaces of the panels 326 and 328 to stiffen the panels and prevent them from vibrating during operation of the transducers 330; see FIGS. 35 and 36.

Figure 37A:
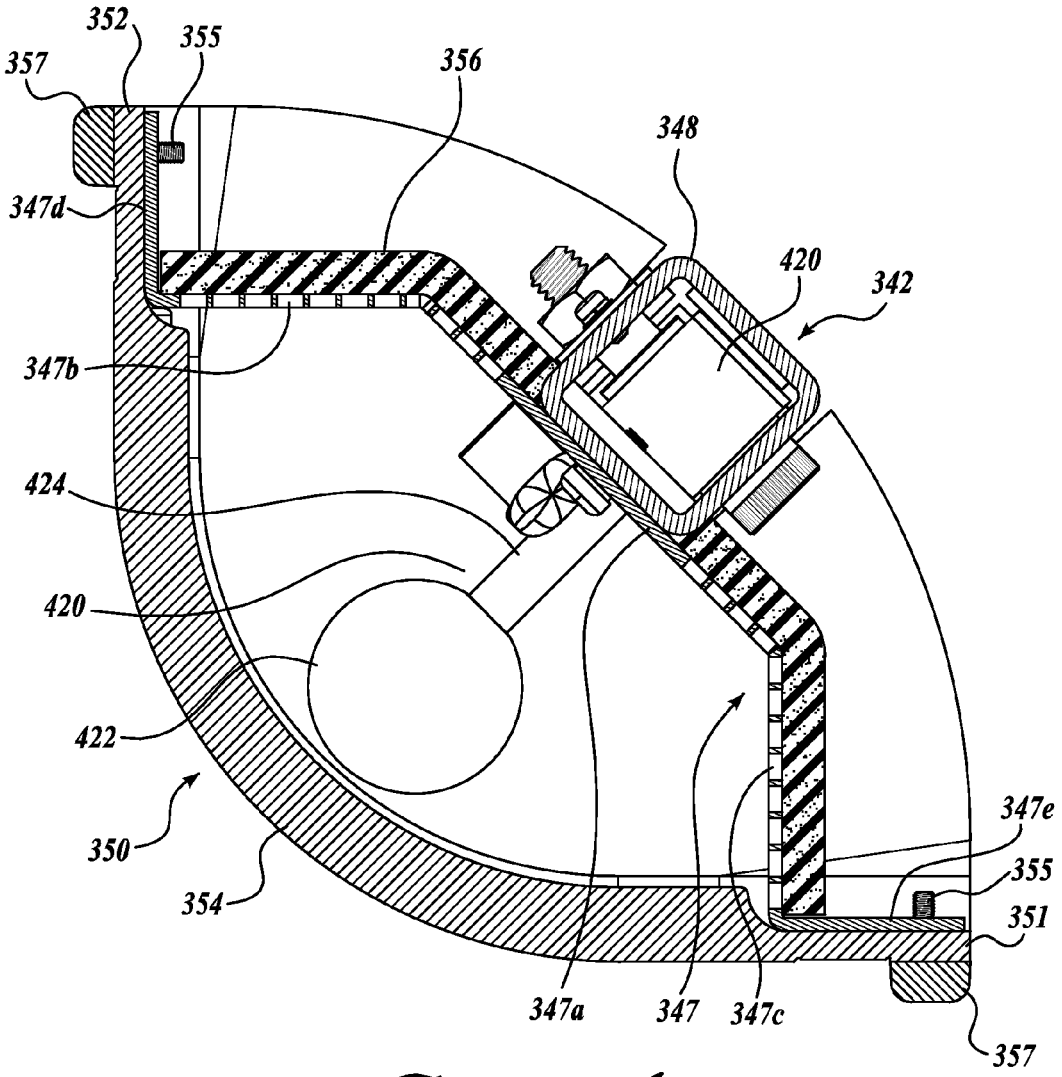
FIG. 37A is a cross-sectional view of a corner structure taken along lines 37A-37A in FIG. 36.
Figure 37B:
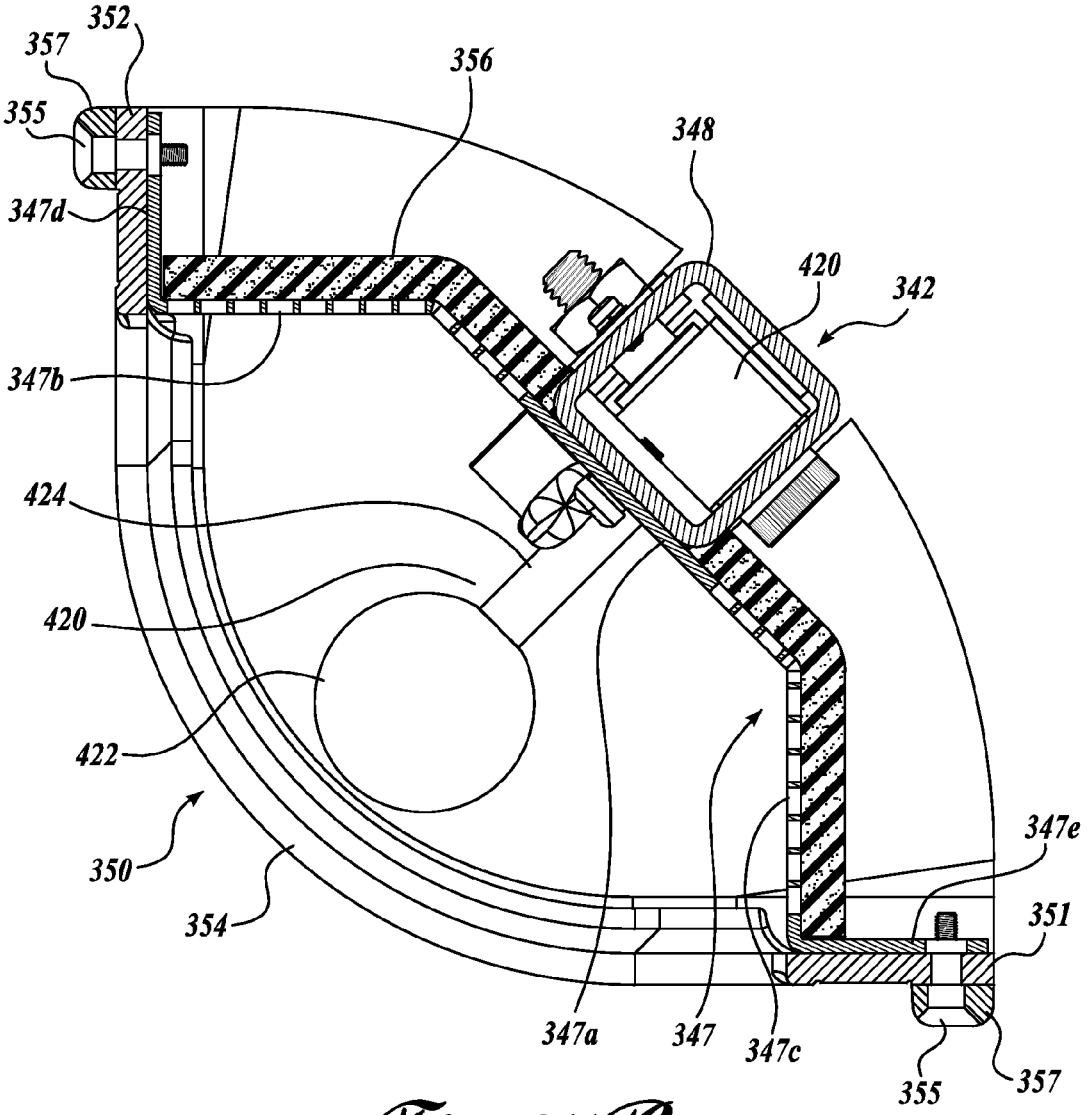
FIG. 37B is a cross-sectional view of a corner structure taken along lines 37B-37B of FIG. 36.

As illustrated in FIG. 36, the corners 336 of the housing are nominally open, and when viewed from the top or bottom of the speaker, the corners 336 define a generally concave shape. Such corners are shaped and sized to receive corner assemblies 342*a*, 342*b*, 342*c*, and 342*d* (generically referred to as "342"). As shown in FIGS. 36, 37A and 37B, each of the corner assemblies 342 is of generally acoustically "open" construction having a formed, vertically elongated grille structure 347 in the form of a central panel 347*a*, diagonal side panels 347*b* and 347*c* extending laterally from the central panel and distal end flanges 347*d* and 347*e* extending generally transversely from the diagonal side panels, see FIGS. 37A and 37B. The end flange 347*d* and

347*e* overlap the corresponding portion of the speaker housing. The side panels 347*b* and 347*c* are perforated as is a portion of the central panel 347*a*, thereby to allow sound generated by the transducers 330 to project from the speaker 300.

A rear central column structure 348 spans between the top and bottom panels 344 and 346 centrally along the back surface of the grille central panel 347*a*. The center column structure 348 houses latch mechanisms for flying and stacking speakers 300 as described below.

The corner structures also include a cover structure 350 composed of an arcuate top plate 344 and an arcuate bottom plate 346 that are spanned by side columns 351 and 352. Top and bottom forwardly projecting arcs 353 extend around the outer perimeters of the plates 344 and 346 to define the curved out perimeter at the top and bottom of the corner assemblies 342. Arcuate tie bars 354 span between side columns 351 and 352 and correspond to the curved shape of the outer perimeter of the top and bottom panels 344 and 346. The tie bars provide grasping locations or handles for the speakers 300. Hardware members 355 extend through protective vertical runners 357 extending along the height of the columns 351/352 and the grille flanges 347*d* and 347*e* to engage the speaker housing 310. It will be appreciated that all or some of these components of the cover structure can be cast or otherwise manufactured as a singular unit.

An open cell foamed rubber panel 356 overlaps the inward surface of grille structure 347. The purpose of the panel 356 is to prevent moisture, dust, etc., from entering the speaker housing while allowing the sound from the transducers 330 to project from the speaker 300.

Referring specifically to FIGS. 33, 34, 36, 37, and 40, arcuate-shaped stacking pads 360 project downwardly at each corner of the bottom panel 314 of the speaker just inwardly of the corner structures 342. The size and shape of the stacking pads 360 match arcuate grooves 362 formed in the top panels 312 of the speakers. In this manner, the pads 360 and grooves 362 locate vertically adjacent speakers one to another and assist in maintaining the speakers stationary relative to each other in horizontal directions.

Figure 40:
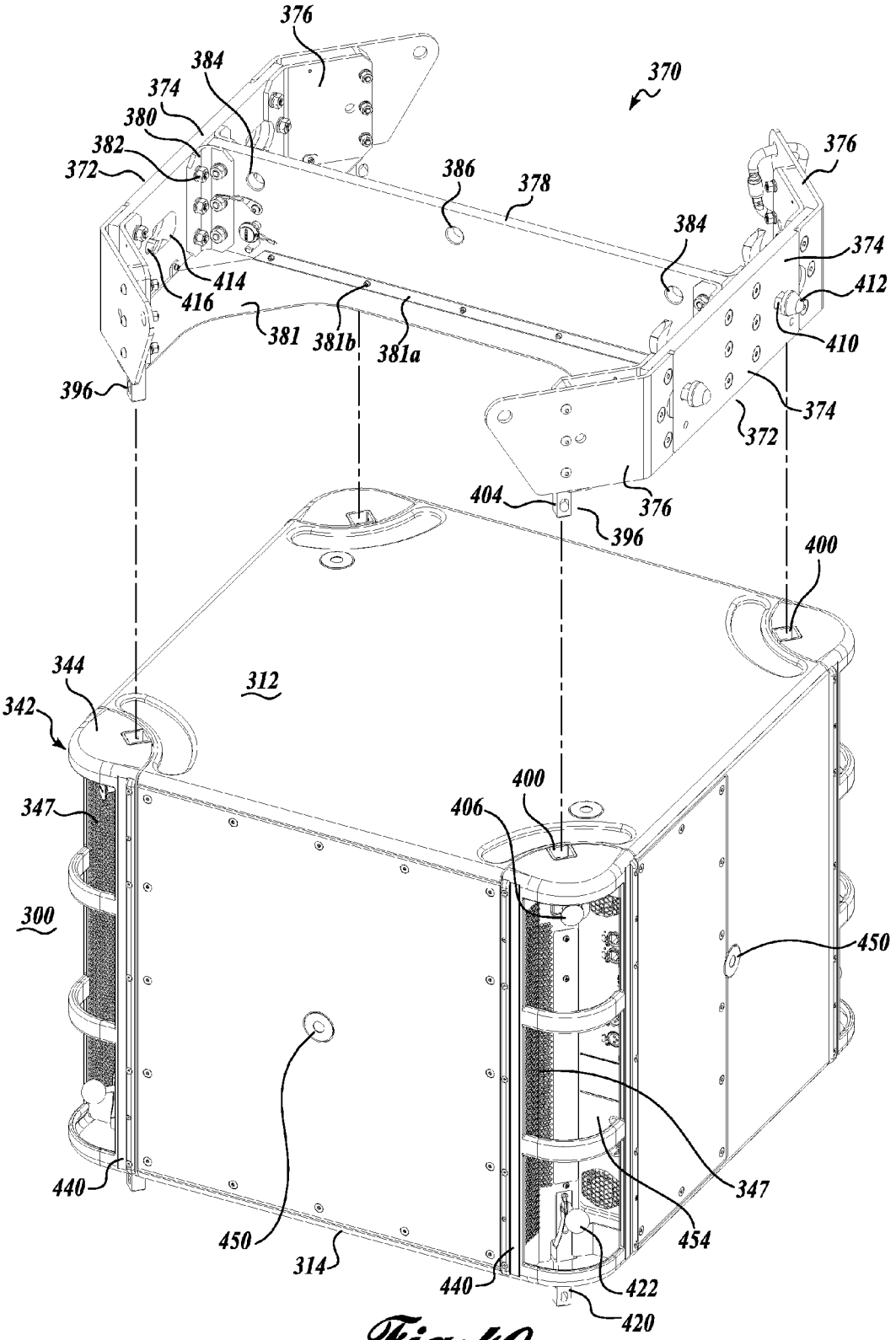

The speakers 300 can be vertically flown (hung) as shown in FIGS. 32 and 40 by the use of a flybar structure 370. The flybar structure 370 includes side bars 372 composed of straight side sections 374 that terminate at inwardly canted ends 376. A transverse cross bar 378 interconnects the side sections 374. In this regard, angle brackets 380 are attached to each side surface at the ends of the cross bar and also are connected to the adjacent inside face surfaces of the side bar side sections 374 by appropriate hardware members 382.

A reinforcing bracket 381 extends between the lower edge portion of the crossbar 378 and the lower edge portion of the canted end sections 376 of side bar 372 to enhance the structural integrity of the flybar structure 370. The bracket 381 includes a turned up edge portion 381*a* to overlap the lower edge portion of the crossbar 378, and is attached to the crossbar by appropriate hardware members 381*b*. Bracket 381 may include a similar turned up edge portion to overlap canted side section ends 376 and can be fastened thereto by hardware members similar to hardware members 381*b*.

Cross holes 384 are formed in the end portions of the crossbar 378 to enable the speaker columns 302 to be hung from two attachment points, one located on each side of the center of the speaker column. Alternatively, a speaker column can be hung from a single center opening or attachment point 386 located at the center of the crossbar 378.

Referring specifically to FIG. 40, flybar structure 370 includes flybar latches 396 that extend downwardly from the canted ends 376 to extend into the rigging channels 400 formed in the center column structures 348 of the corner assemblies 342 of the speakers. Transverse locking pins 398, shown in FIG. 36, are mounted in the center column structures 348 to engage transverse through holes 404 formed in the lower portion of the flybar latches 396. The locking pins 398 may be retracted by pulling on circular pin grips 406 to retract the locking pins 398 to permit the latches 396 to slide downwardly into the channels 400. Once the latches are in place, the pin grips can be pushed inwardly so that the locking pins 398 engage through the through holes 404, thereby to secure the flybar structure 370 in place.

The construction of the flybar structure 370 enables the vertical speaker arrays 302 to be conveniently joined together in side-by-side relationship to each other by placing corresponding side bar structures 370 of the adjacent vertical arrays in face-to-face relationship to each other and then securing the corresponding flybar structures together. In this regard, flybar structure 370 includes pins 410 projecting outwardly from one side bar 372. Each of the pins has an enlarged and pointed head portion 412 to initially engage through an enlarged portion 414 of a horizontal slot 416 formed in the side bar section 374 of an adjacent flybar structure 370. Once the head 412 of the pin 414 has extended through the enlarged portion 414 of the slot 416, the pin 410 can be slid forwardly in the slot 416 to engage a narrower portion of the slot 416 that corresponds substantially to the width or diameter of the pin 410. When the pin 410 is in such position, the side bars 372 of the flybar structures 370 are in substantially a face-to-face position with each other and can be locked together in such position by any number of locking mechanisms.

The speakers 300 are conveniently attachable one on top of the other. In this regard, each of the speakers 300 includes rigging latches 420 slidably disposed within the lower portions of the rigging channels 400 formed in the corner structure columns 348. The vertical movement of the latches 420 are controlled by manually graspable latch grips 422 which are connected to the latches 420 by a horizontal shaft 424 that slides within a vertical slot 426 formed in the column structure 348. Speakers 300 are attached in stacked relationship with each other by releasing the rigging latches 420 of an upper speaker to engage within the channels 400 of a lower speaker by gravity. Thereafter, the rigging latches 420 are locked in place within the channels 400 of the lower speaker.

When one speaker is positioned above the other, the vertically slideable rigging latches 420 are released by operating latch grip 422 so that the horizontal shaft 424 is in alignment within slot 426, thereby allowing the shaft 424 to slide downwardly in the slot 426 and also allowing the rigging latch 420 to slide downwardly within rigging channel 400. At the time the rigging latches 420 are lowered from the upper speaker 300, the latching pins 398 of the lower speaker are disposed and retracted into outward position by manipulating the locking pin grip 406 thereof. Once the rigging latches 420 have slid downwardly into the channel 400 of the lower speaker, the upper locking pins 398 are engaged through the engagement holes 434 extending through the lower ends of the rigging latches 420, thereby to lock the rigging latches 420 with the lower speaker 300. The rigging latches 420 only extend downwardly below the lower surface of the upper speaker a distance sufficient for the latching pins 398 to engage through the rigging latch holes 434. In this manner, the speakers 300 can be quickly and conveniently coupled together in a secure manner without requiring any tools.

It will be appreciated that by the foregoing construction, the speakers 300 can be arranged in vertical arrays of any desired height. Also, the components for rigging speakers one on top of the other are "built in" within the envelope of the speaker perimeter, which facilitates attaching two or more vertical speaker arrays side-by-side to each other.

Moreover, since the speakers 300 are flown in vertical relationship to each other, there is no need to position adjacent speakers at an angle relative to the horizontal or relative to each other or to adjust any angularity between the speakers. This greatly simplifies the flying of the speaker arrays in terms of required rigging equipment or structure as well as rigging time.

As shown in FIGS. 32, 33, 34, and 40, vertical alignment lines 440 extend vertically along the edges of the corner structures 342 at the location that the corner structures mate with the speaker housing 310. The alignment lines 440 can serve as a visual indication of whether or not the speakers 300 of a vertical array are all in alignment with each other. As shown in FIG. 40, when the speakers are in alignment, the alignment lines 400 of the speakers form a continuous, uniform vertical line along the height of the array. The alignment line 440 can be of a color distinctive from the adjacent portion of the speaker housing so as to improve the visibility of the alignment line.

Referring specifically to FIGS. 32, 33, 34, 38, 39, and 40, each of the speakers 300 includes four infrared proximity sensors (transmitters/receivers) 450 located generally centrally at the front, back, and sides of the speakers 300. Also, two proximity sensors are positioned on the speaker top panel 312 and two on the speaker bottom panel 314. These infrared sensors 450 enable each of the speaker cabinets to communicate with adjacent cabinets, thereby to determine their relative positions within an array, such as array 302. Consequently, an array of speakers 300 can be fully modeled in software to match the array's physical configuration. Other types of proximity sensors can be used in place of the infrared sensors 450, such as ultrasonic or radar-based sensors.

Each of the loudspeakers 300 also includes a test key 452 that queries the loudspeaker for the last known status of the loudspeaker's internal electronics. See FIG. 38. The test key 452 is located on the control panel 454 as shown in the front elevational view of the speaker 300, FIG. 38. The test key 452 is primarily intended for use during set-up of the loudspeakers at the venue in question. The test key confirms the loudspeaker status based on the most recently performed self-diagnostic. When the test key is depressed, the internal systems of the speaker check the most recent test logs that are held in the speaker's memory. If the system finds no faults (acoustic or electronic), an indicator light 456, located adjacent the test key, will glow for a fixed time period. However, if the test function finds fault within the speaker, the light 456 will glow in a different color, indicating that a fault exists. The test key function is powered by a battery internal to the loudspeaker, and thus this particular test can be performed at any time, whether or not the speaker is externally powered or networked with other speakers and connected to the speaker control system 510, described below.

Figure 38:
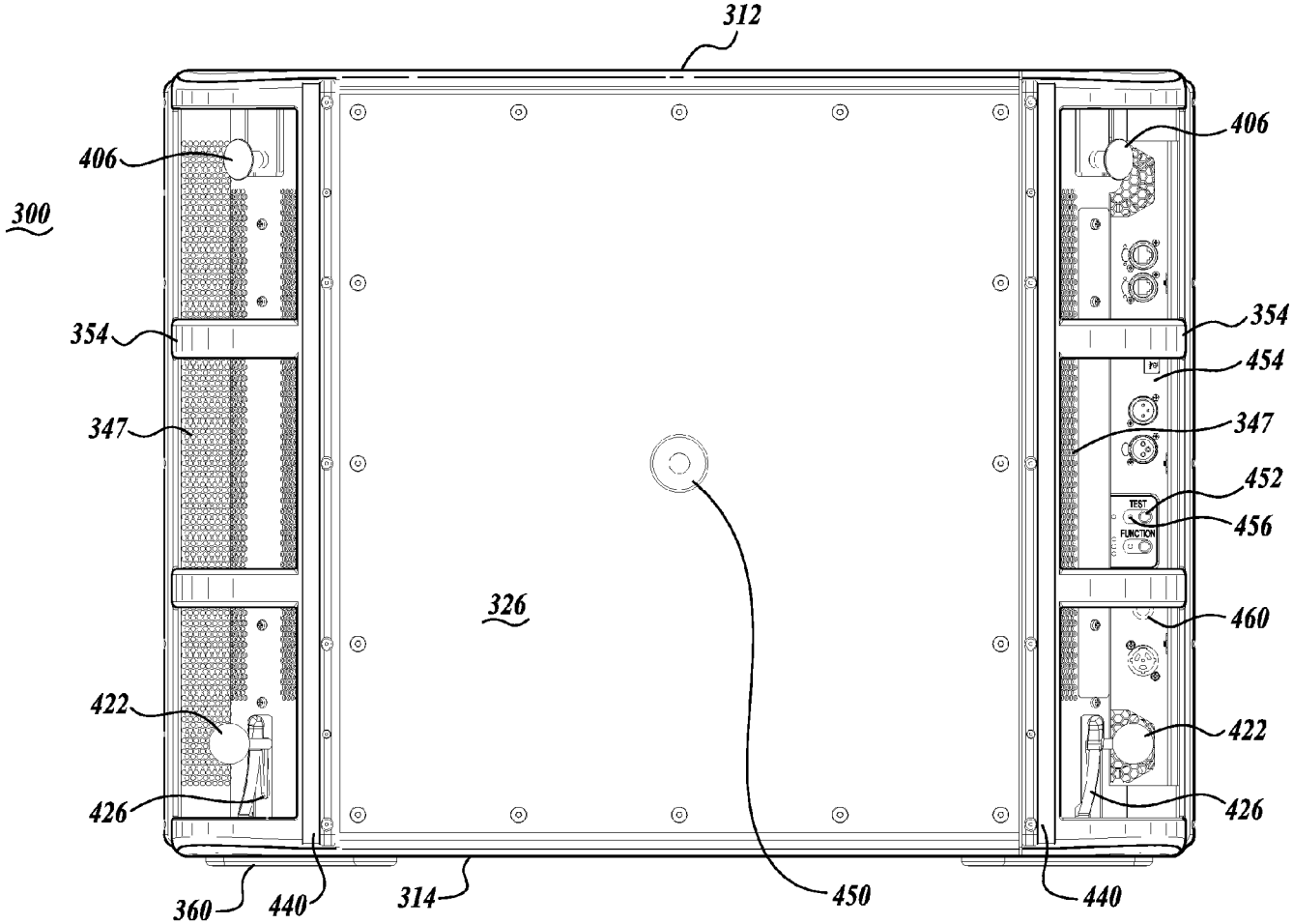
Figure 39:
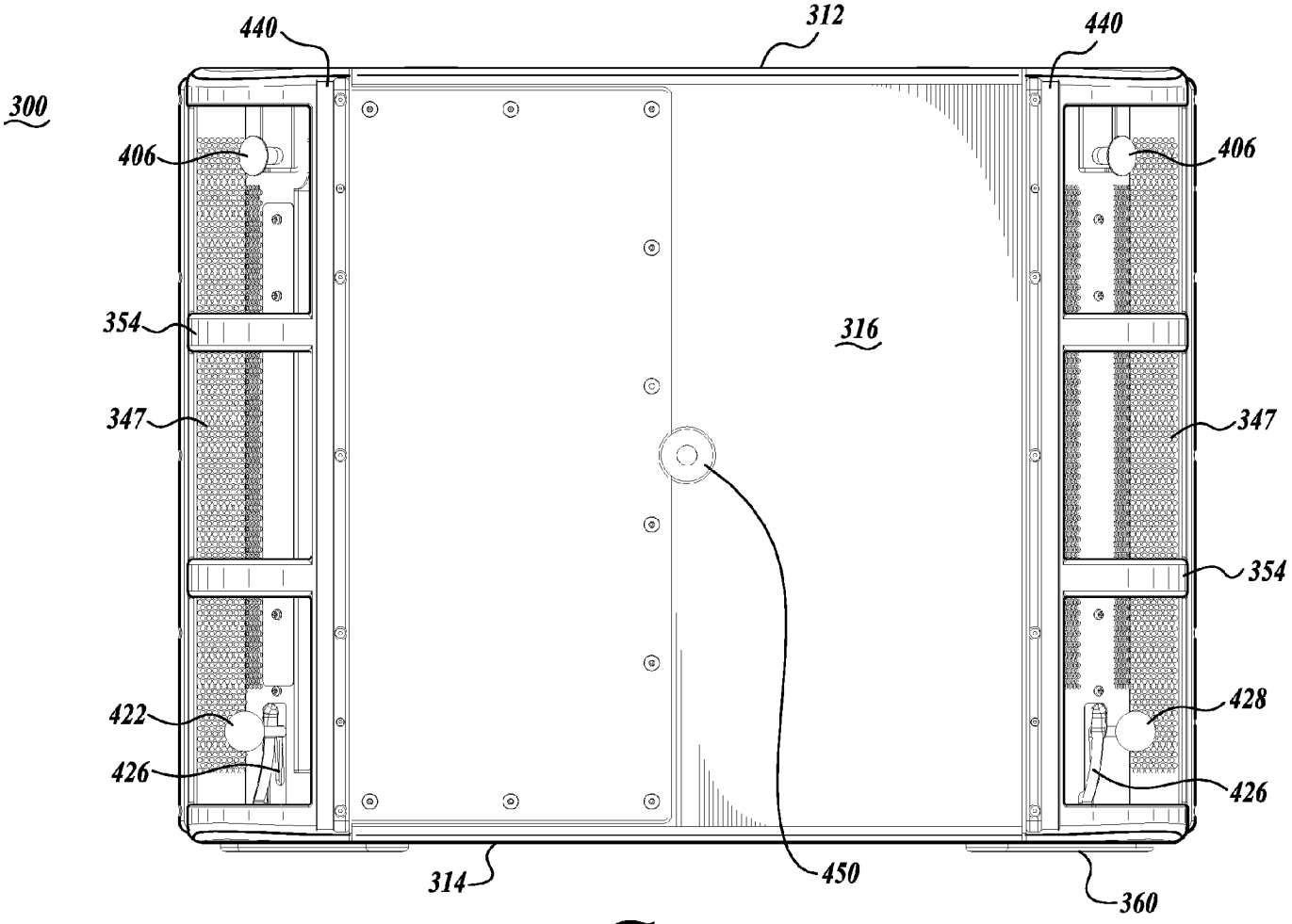

Also, each speaker 300 includes a built-in microphone 460 to perform in-situ diagnostics of the speaker; see FIG. 38. Such diagnostics utilize stored reference curves for the speaker to verify the status of the speaker transducers. This is intended primarily as a shop function to identify or assist in troubleshooting faults. The acoustic measurement function is activated by software, and is not intended to be used during events.

To describe the foregoing more specifically, the control panel 454 of each speaker houses a calibrated microphone 460 that is used to confirm the operation of the transducers within the loudspeaker. At the time of manufacture, the frequency response of each transducer 330 is measured by the front panel microphone and then stored in the speaker's non-volatile memory. When physical diagnostics are performed (for example, in the shop after a performance), the frequency response of each transducer is measured and compared to the factory-stored response. If the two measurements vary significantly, the control system 510 provides an alert and recommends a corrective action, for example, transducer repair or replacement. If it is necessary to replace a transducer, the measured response for the new component is compared to that of the original component at the time of manufacture. If the new component is within the specifications of the original component, the new responses are stored in the non-volatile memory of a speaker in place of the factory-measured response, and on a going-forward basis is used for comparison in future diagnostics. In this manner, it is possible to objectively verify the performance of each transducer 330 of the speaker.

As a further feature, each of the speakers 300 may include a built-in tilt sensor located within the interior of the speaker. This sensor can help establish the hang angle of the speaker array, which should be substantially vertical. The tilt sensors provide active feedback to the control system 510 of the speaker, described below.

Figure 41:
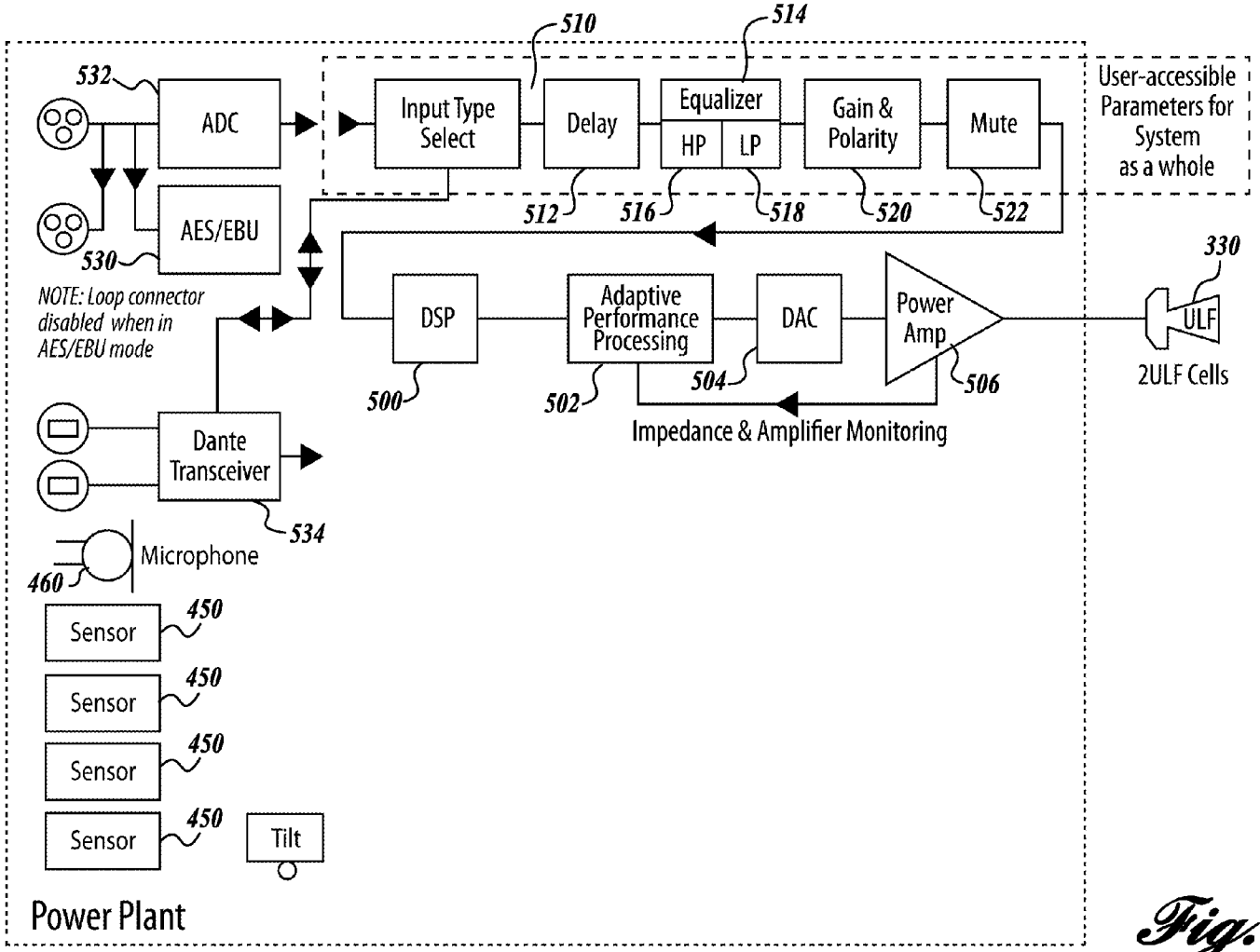

As noted above, each ultra-low frequency transducer 330 of a speaker 300 is individually powered, as well as individually controlled. This is schematically illustrated in FIG. 41. As shown in FIG. 41, associated with each ultra-low frequency transducer 330 is a digital signal processor (DSP) channel 500 that operates in conjunction with adaptive performance software 502. The software assists in generating optimal DSP control parameters for the transducer 330 by generating particular acoustic lobe configurations, discussed below. The adaptive performance software, by generating desired or optimal DSP control parameters for the transducer 330, is able to steer or direct the output from the transducer in the vertical and horizontal directions. The control signal from the DSP channel 500 is routed through a digital-to-analog converter 504 and then through a power amplifier 506 and then to the ultra-low frequency transducer 330.

Further, as shown in FIG. 41, the control system 510 is capable of controlling the gain, delay, and response of the speaker. In this regard, the control system 510 includes a delay subsystem 512 for controlling the delay of the system. The control system 510 also includes a parametric equalizer 514 as well as a high-pass filter 516 and a low-pass filter 518 to control the output produced by the system. The control system 510 further includes a subsystem 520 to alter the gain and polarity of the output from the system. In addition, the control system 510 includes the ability to mute the output from the system via muting subsection 522.

Input of digital/audio signals to the control system 510 can be via AES/EBU (AES3) port 530 routed through an analog-to-digital converter 532. The input to the controller 510, as well as the output therefrom, also may be routed through Dante-enabled ports 534. The Dante ports also function as a network interface to the control system 510.

Figure 44:
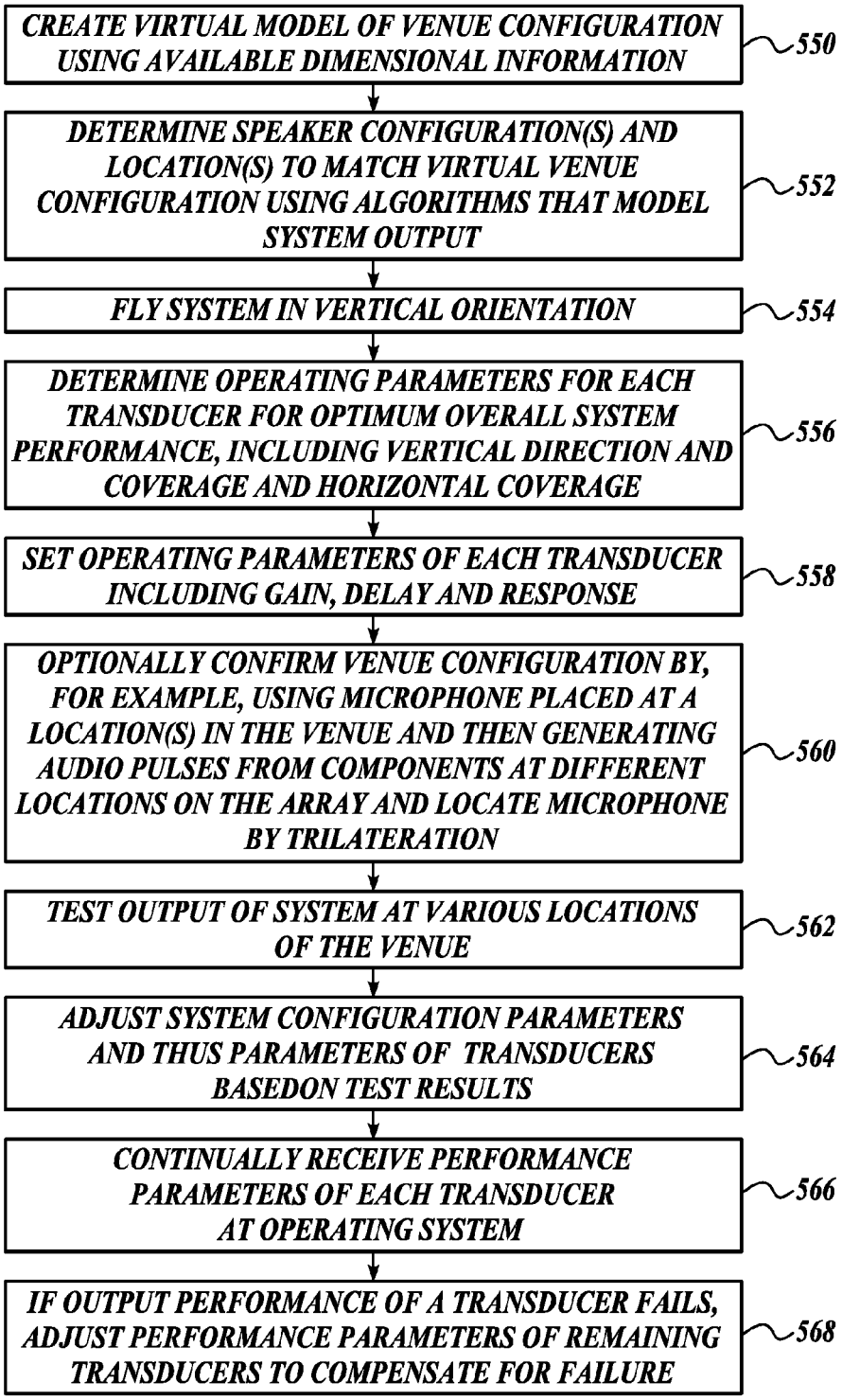

FIG. 44 schematically illustrates one example of a methodology of installing arrays composed of speakers 300, such as array 302 illustrated in FIG. 32. The exemplary methodology at step 550 includes first creating a definition of the venue, then, at step 552, determining the array or arrays of speakers 300 to match the venue. In this regard, the array coverage pattern is optimized to the venue based in part on the calculated ideal wave front. The arrays are flown at step 554, and then at steps 556 and 558, each of the transducers of each speaker is electronically adjusted and tuned at the venue. In this regard, the operational parameters of the speakers are determined and then set. The output of the system can be tested at various locations of a venue at step 562 and if needed, the output of the speaker can be adjusted at step 564. Also, during the use of the speakers, the output of each transducer in each speaker is continuously monitored, and, if need be, adjustments made thereto; see steps 566 and 568.

The definition of the performance venue is "drawn" in software using dimensional information available pertaining to the venue, including its length, width, seating areas, stage elevation and position and size, balcony locations and position, etc. Once the loudspeaker arrays have been flown in a venue, the venue configuration can be confirmed by using one or more microphones positioned at one or more points in the venue; see step 560. In this regard, the audio system of the present disclosure generates several impulses at different locations. The system of the present disclosure can trilaterate the location of the microphone. This information assists in modifying a preference or making corrections to the venue model. It will be appreciated that by using this trilateration function, it is not necessary to make manual measurements of the venue and carry out the associated numeric data entry of such measurements.

In step 552, noted above, one or more loudspeaker arrays are configured to match the venue in question, including matching the size and shape of the venue as well as the location of the audience members and based on the ideal wave front for the venue. In this regard, algorithms have been developed to model the output of the loudspeakers 300 and each of the transducers 330, not only to provide sound to all desired areas of a venue, but also to achieve pleasing results. In one approach, the venue can be divided into a grid of spots, and the loudspeakers are aimed to direct sound to each spot. The loudspeaker arrays are constructed from identical speakers 330 and a rating system, as described above, is used to quickly and conveniently construct and position the arrays at the venue.

At steps 354 and 356, the operating parameters of each of the ultra-low frequency transducers of each loudspeaker are determined to optimize the speakers to the venue. As discussed above, each such transducer is independently powered and processed. In this regard, the control system 510 of the present disclosure is aware of the location of each of the speakers 300. As discussed above, four infrared or other type of proximity transceivers 450 are mounted on each loudspeaker housing. The transceivers are located one on each side of the speaker housing, which enables the speakers to be modeled as two-dimensional arrays. With this information, the physical layout of the loudspeakers is determined. The data transmission that occurs between each loudspeaker identifies each adjacent loudspeaker. In this manner, the position of each loudspeaker 300 is determined.

Also as noted above, each loudspeaker can include a tilt sensor to confirm that the loudspeaker in question is in vertical position, or whether the loudspeaker is at an angle off vertical. This information is helpful in adjusting or targeting the output from each speaker.

Figure 42A:
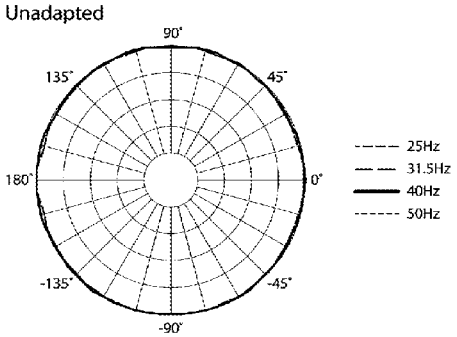
FIGS. 42A through 42F illustrate the horizontal acoustic lobe output of the ULF speaker of FIGS. 33 and 34, in this regard.
Figure 42D:
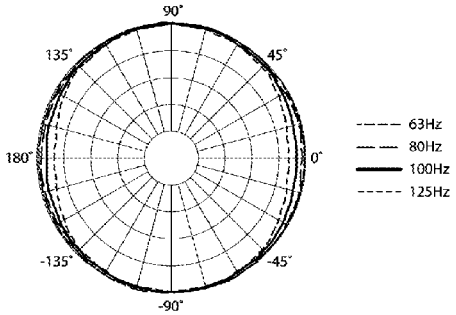
Figure 42B:
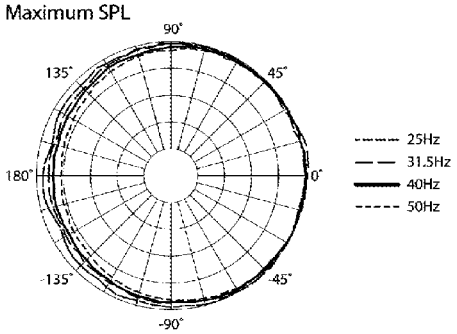
Figure 42E:
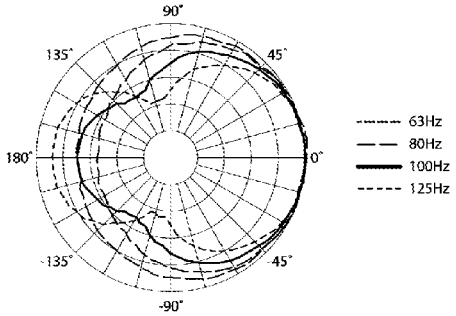
Figure 42C:
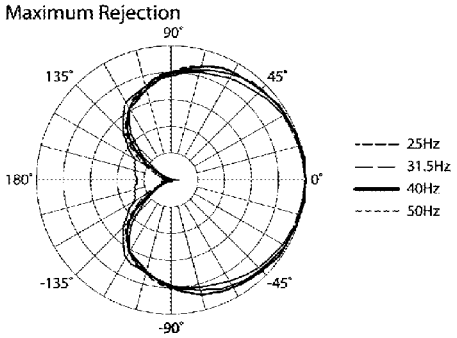
Figure 42F:
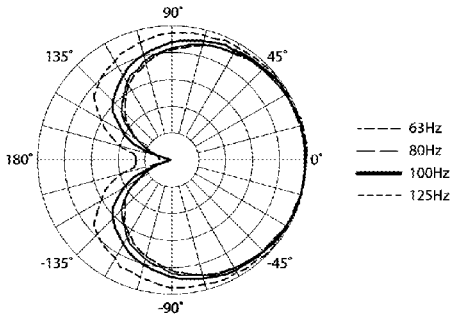
Figure 43A:
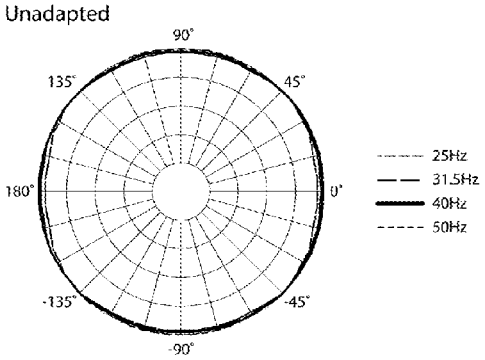
FIGS. 43A through 43F illustrate the vertical acoustic lobe output of the ULF speaker of FIGS. 33 and 34, in this regard.
Figure 43D:
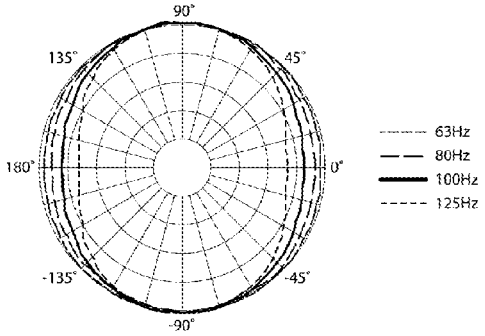
Figure 43B:
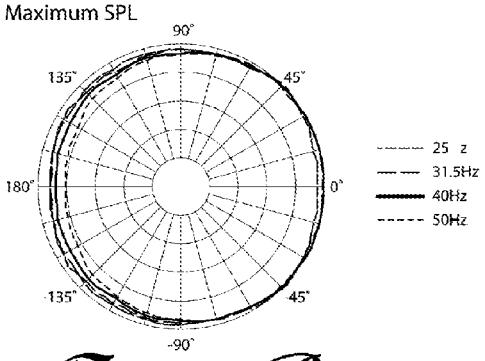
Figure 43E:
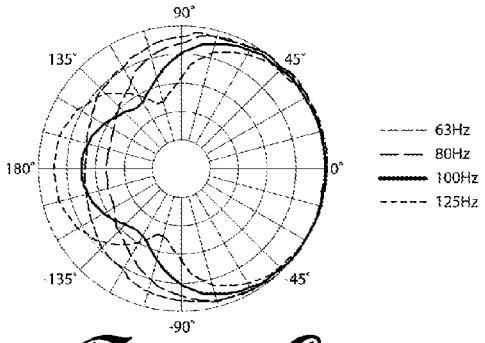
Figure 43C:
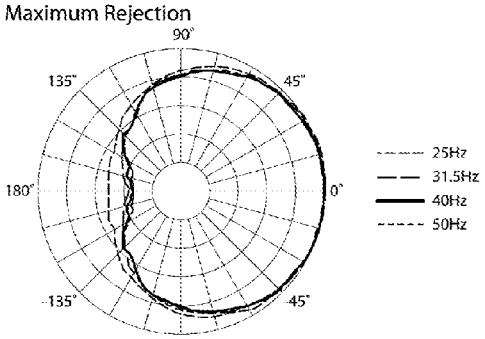
Figure 43F:
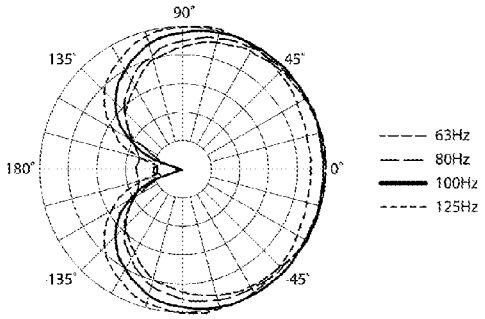

Using the control system 510, described above, the horizontal output of each transducer can be controlled. FIGS. 42A-42F depict the horizontal output acoustic lobe formations for the speakers 300 at various frequencies of 25, 31.5, 40, 50, 63, 80, 100, and 125 Hz. FIGS. 42A and 42D depict the omnidirectional output from the speaker. FIGS. 42B and 42E disclose hypercardioid output patterns achieved at maximum output from the speakers. FIGS. 42C and 42F depict cardioid output patterns with the characteristic decrease in output in the rearward or 180 degree direction.

The control system 510 also can be used to control the vertical directional output from the speakers 300. The vertical output polar plots for the frequencies 25 Hz, 31.5 Hz, 40 Hz, 50 Hz, 63 Hz, 80 Hz, 100 Hz, and 125 Hz are shown in FIGS. 43A-43F. These figures correspond to the corresponding FIGS. 42A-42F discussed above. The FIGS. 42A-42F and 43A-43F when considered together can provide an indication of the output from speakers 300 on a three-dimensional basis.

It will be appreciated that all of the speakers 300 within an array 302 are networked together, and thus enable integrated control of the transducers via a computer processor which operates a DSP as well as applicable algorithms to control the output and directionality of each of the transducers in each of the speakers. Such computer processor calculates all of the lobe formation parameters for the speakers and communicates them to the loudspeakers.

The network control system also monitors the operation and performance of all the loudspeaker transducers in the array on an ongoing basis; see step 566. Since the performance parameters for the loudspeaker components are sent electronically to the loudspeaker components from the control system, such parameters can be modified very quickly at any time. Some of the monitor parameters include transducer impedance, amplifier temperature, voltage and current level of each transducer. This information is recorded on a "live" status log that can be downloaded. In this regard, not only is the functionality of each transducer confirmed, but also the control system accesses the complete performance of each transducer by comparing such performance with reference parameters stored in memory. Also, follow-up or supplemental venue measurements can be conducted at any time, as discussed above, thereby to more fully and accurately define the venue. For example, if additional seats in the venue are sold, or the performers are not satisfied with the sound quality, the coverage of the speakers can be easily modified.

Moreover, if failure of one or more transducers 330, or an entire speaker 300, occurs after the speaker arrays are flown, or even during a performance, the failure is recognized by the network control system and corrective action can be taken at step 568. Even before the overall system monitoring occurs, each loudspeaker can be tested, since each loudspeaker contains a self-test function built in to the circuitry of the loudspeaker system to enable verification that all the components of the loudspeaker are operating correctly. The results of this test can be queried by simply pressing the self-test button 452 on the loudspeaker.

If a portion of the system is damaged, the control system will determine a solution and adjust the system coverage in response. Essentially, the control system is able to rebuild the acoustical model of the loudspeaker components without the "failed" source(s). In this regard, the transducer parameters can be adjusted to affect the vertical direction between adjacent speakers and direct sound to every "spot" in the venue. Therefore, "spots" to be hit are redefined to adjust the non-functioning transducer. If a particular loudspeaker, or the transducers thereof, cannot "hit" a desired spot in a venue, then adjacent loudspeakers and/or transducers are used to "fill in" the sound to achieve the desired coverage. Due to the reduction in sound level over distance, typically, more loudspeaker components are focused at farther areas, and fewer loudspeaker components are directed at closer areas. It is not necessary to physically alter speaker-to-speaker angles, but instead digital signal processing is used to alter the component-to-component angles in accordance with the new virtual acoustical model created with the failed source(s) removed. The same process is used to achieve the desired horizontal coverage in the instance that a failure occurs in one or more of the transducers, or even in the entire speaker.

As with speaker 100 discussed above, speaker 300 and the arrays constructed therefrom, provide significant advantages over preexisting loudspeaker arrays. For example, in the arrays of the present disclosure, the position of each loudspeaker is self-recognized, and all of the drivers/transducers in each loudspeaker are networked together and individually powered and controlled for output level as well as horizontal and vertical directionality. In addition, the present loudspeaker system is "self-healing" and adapts if one or more component failures occur, even during use. Further, the rigging of the loudspeaker is simplified and thus the arrays can be flown quickly and easily and also disassembled quickly and easily.

While exemplary embodiments of the present disclosure have been illustrated and described, it will be appreciated that various changes can be made therein without departing from the spirit and scope of the invention. For example, although loudspeaker 100 is illustrated and described herein as composed of 14 high-frequency transducers, six mid-range transducers and two low-frequency transducers, the number of high-frequency, mid-range and low-frequency transducers can be altered or modified. Regardless of the numbers of the various transducers used, what is of significance is the close and relative arrangement of the transducers and drivers, the manner of their loading using horns, horn walls, horn flairs, phase plugs, and other structures, and that they are each individually controlled.

With respect to loudspeaker 300, it will be appreciated that such loudspeaker is illustrated and described as composed of two back-to-back ULF transducers 330; however, a different number of transducers can be utilized. Regardless of the number of ULF transducers used, of significance, among other features, is the offset loading of such transducers, for example, with the sound outlets from the speaker 300 at its corners 336. Also of significance are the ability to rotate the transducers to change the sound coverage of the transducers, and the individual operation and control of the transducers.

It will be appreciated that loudspeakers 100/300 and the various arrays that may be constructed therefrom provide significant advances and advantages. For example, each of the loudspeakers of the array can be of identical construction, thereby minimizing the need for spare components or parts. The loudspeakers are arrayed in a vertical arrangement, and are "dead hung," thereby simplifying the flying of the arrays. In this regard, there are no vertical splay angles to adjust. Further, by the selection of the number of transducers and horns, their size and their spacing and relative location, the speakers 100 create a radial coverage pattern that is very narrowly focused.

Further, as described above, the tuning of the drivers and transducers of the loudspeakers is carried out electronically, and thus the parameters for the transducers and drivers can be conveniently and rapidly specified, as well as adjusted. This also enables the drivers and transducers in speakers 100/300 to adjust if any of the drivers and transducers fail during use. Further, the speakers 100/300 enable the arrays to be precisely configured to a particular venue and also enable the system to be scaleable to a particular venue.

Moreover, by the construction and control of loudspeakers 100/300, loudspeakers 100/300 and the arrays composed thereof enable the loudspeaker and arrays to produce a continuous and consistent beam width versus frequency characteristic over the entire working frequency range of a loudspeaker. Further, the loudspeakers 100/300, and the arrays composed thereof, exhibit continuous and consistent directional pattern characteristics versus frequency output from the loudspeaker, while occupying a relatively small amount of physical space, especially for the level of output generated by the loudspeaker.

The invention claimed is:

1. An adaptive low frequency loudspeaker system adaptive to the physical configuration of a venue at which the loudspeaker system is in use, comprising:

(a) a plurality of adaptive loudspeakers, each loudspeaker comprising:
  (i) a housing;
  (ii) a plurality of low frequency transducers within the housing, said transducers being powered and controlled independently of each other; and
  (iii) a digital signal processor channel for each low frequency transducer to control the at least one of the vertical and horizontal directionality of the loudspeaker system output;

(b) an electronic network interconnecting the digital signal processor channels with each other; and (c) a control system monitoring and controlling the operation and performance of the low frequency transducers individually, said control system comprising a computer processor connected to said electronic network and functioning to calculate the optimal loudspeaker output acoustic lobe formation parameters based on the physical configuration of the venue, said control system controlling the operation of the low frequency transducers based in part on the calculated loudspeaker output acoustic output lobe formation parameters.

2. The adaptive low frequency loudspeaker system according to claim 1, wherein:

each low frequency transducer powers an acoustic diaphragm having a center; and the housing comprises openings for sound transmission from the loudspeaker at locations offset from the center of the acoustic diaphragm.

3. The adaptive low frequency loudspeaker system according to claim 2, wherein:

the acoustic diaphragm defines an area; and the housing comprises openings for sound transmission from the loudspeaker at locations offset from the area of the acoustic diaphragm.

4. The adaptive low frequency loudspeaker system according to claim 1, wherein said control system controls said digital signal processor channel to direct the acoustical output from said loudspeakers in a desired direction selected from the group consisting of a vertical direction, a horizontal direction, and both vertical and horizontal directions.

5. The adaptive low frequency loudspeaker system according to claim 1, wherein said control system controls at least one of the gain, delay, and response of each low frequency transducer in the loudspeaker, thereby to selectively direct the acoustical output from the loudspeaker in a desired vertical direction to achieve a desired coverage of the venue in which the loudspeaker is located.

6. The adaptive low frequency loudspeaker system according to claim 1, wherein said loudspeakers are stacked in one or more vertical arrays.

7. The adaptive low frequency loudspeaker system according to claim 1, further comprising a rigging system to arrange a plurality of loudspeakers in a stacked, substantially straight vertical line.

8. An adaptive low frequency loudspeaker system according to claim 1, wherein:

(a) the loudspeaker housing comprises a plurality of sides arranged to form the housing in a rectilinear shape, with adjacent sides of the housing defining corners;

(b) openings formed in the corners of the rectilinearly shaped housing for transmission of sound from the loudspeakers.

9. The adaptive low frequency loudspeaker system according to claim 8, wherein:

each of the low frequency transducers powers an acoustic diaphragm having an area;

the corner openings of the housings are at locations offset from the area of the acoustic diaphragms.

10. An adaptive low frequency loudspeaker system adaptive to the physical configuration of a venue at which the loudspeaker system is in use, comprising:

(a) a plurality of adaptive loudspeakers, each loudspeaker comprising:

(i) a housing;

(ii) a plurality of low frequency transducers within the housing, said transducers being powered and controlled independently of each other; and (iii) a digital signal processor channel for each low frequency transducer to control the at least one of the vertical and horizontal directionality of the loudspeaker system output;

(b) an electronic network interconnecting the digital signal processor channels with each other;

(c) a control system monitoring and controlling the operation and performance of the low frequency transducers individually, said control system comprising a computer processor connected to said electronic network and functioning to calculate the optimal loudspeaker output acoustic lobe formation parameters based on the physical configuration of the venue, said control system controlling the operation of the low frequency transducers based in part on the calculated loudspeaker output acoustic output lobe formation parameters; and (d) wherein each loudspeaker comprises a self-testing program incorporated into the circuitry of the loudspeaker, said self-test program operable to verify that the low frequency transducers of the loudspeaker are operating properly.

11. An adaptive low frequency loudspeaker system, adaptive to the physical configuration of a venue at which the loudspeaker system is in use, comprising:

(a) a plurality of adaptive loudspeakers, each loudspeaker comprising:

(i) a housing;

(ii) a plurality of low frequency transducers within the housing, said low frequency transducers being powered and controlled independently of each other; and (iii) a digital signal processor channel for each low frequency transducer to control the at least one of the vertical and horizontal directionality of the loudspeaker system output;

(b) an electronic network interconnecting the digital signal processor channels with each other;

(c) a control system monitoring and controlling the operation and performance of the low frequency transducers individually, said control system comprising a computer processor connected to said electronic network and functioning to calculate the optimal loudspeaker output acoustic lobe formation parameters based on the physical configuration of the venue, said control system controlling the operation of the low frequency transducers based in part on the calculated loudspeaker output acoustic output lobe formation parameters; and (d) wherein said control system functions to verify a specific location in the venue relative to each loudspeaker, said specific location corresponding to the location of a test microphone, said control system generating acoustical impulses from low frequency transducers positioned at different locations to trilaterally locate the microphone and thereby determine the distance and direction of the microphone relative to the low frequency transducers which generate the acoustical impulses.

12. An adaptive low frequency loudspeaker system adaptive to the physical configuration of a venue at which the loudspeaker system is in use, comprising:

(a) a plurality of adaptive loudspeakers, each loudspeaker comprising:

(i) a housing;

(ii) a plurality of low frequency transducers within the housing, said transducers being powered and controlled independently of each other; and (iii) a digital signal processor channel for each low frequency transducer to control the at least one of the vertical and horizontal directionality of the loudspeaker system output;

(b) an electronic network interconnecting the digital signal processor channels with each other;

(c) a control system monitoring and controlling the operation and performance of the low frequency transducers individually, said control system comprising a computer processor connected to said electronic network and functioning to calculate the optimal loudspeaker output acoustic lobe formation parameters based on the physical configuration of the venue, said control system controlling the operation of the low frequency transducers based in part on the calculated loudspeaker output acoustic output lobe formation parameters; and (d) sensors selected from the group consisting of (i) at least one proximity sensor disposed on the loudspeaker housing, said control system capable of determining the position of each housing based on the output signal from said at least one proximity sensor; and (ii) a tilt sensor associated with each loudspeaker, said control system capable of determining the tilt of each loudspeaker based on the output from each tilt sensor.

13. A method of providing low frequency sound to a venue, comprising:

(a) creating a model of the configuration of the venue;

(b) assembling a plurality of loudspeakers in stacked relationship, and positioning the stacked loudspeakers so that the loudspeakers are disposed in a substantially vertical array, wherein each of said loudspeakers comprises low frequency transducers, wherein each of the low frequency transducers is operated via digital signal processor channels;

(c) based on the modeled venue configuration, positioning the stacked vertical array of loudspeakers at one or more locations relative to the venue;

(d) operating each of the low frequency transducers of the loudspeaker individually from each other via a control system that networks the digital signal processor channels together and also networks the speakers together;

(e) testing the output of each low frequency transducer; and (f) setting at least one of the gain, delay, and response of each low frequency transducer individually to direct the sound emanating from the speaker array in selected vertical and horizontal directions.

14. The method of providing low frequency sound to a venue according to claim 13, wherein the loudspeakers utilized to assemble the vertical array of loudspeakers are each substantially identical in construction and operation to each other.

15. A method of providing low frequency sound to a venue according to claim 13, comprising:

(a) creating a model of the configuration of the venue;

(b) assembling a plurality of loudspeakers in stacked relationship, and positioning the stacked loudspeakers so that the loudspeakers are disposed in a substantially vertical array, wherein each of said loudspeakers comprises low frequency transducers, wherein each of the low frequency transducers is operated via digital signal processor channels;

(c) based on the modeled venue configuration, positioning the stacked vertical array of loudspeakers at one or more locations relative to the venue;

(d) operating each of the low frequency transducers of the loudspeaker individually from each other via a control system that networks the digital signal processor channels together and also networks the speakers together;

(e) testing the output of each low frequency transducer;

(f) setting at least one of the gain, delay, and response of each low frequency transducer individually to direct the sound emanating from the speaker array in selected vertical and horizontal directions; and (g) wherein the control system recognizing if a particular low frequency transducer is not operational, and adjusting the output of other operational low frequency transducers to compensate for the non-operational low frequency transducer.

16. The method of providing low frequency sound to a venue according to claim 13, further comprising providing the sound to an adjusted configuration of the venue by setting at least one of the gain, delay, and response of each low frequency transducer individually to direct the sound in the vertical and horizontal directions to the adjusted venue configuration.

17. The method of providing low frequency sound to a venue according to claim 13, further comprising:

powering acoustic diaphragms with the low frequency transducers, the acoustic diaphragms having a center; and transmitting the sound generated by the loudspeakers through openings in the loudspeaker housings, said openings located offset from the center of the acoustic diaphragms of the loudspeakers.

18. The method of providing low frequency sound to a venue according to claim 17:

wherein the acoustic diaphragms defines an area; and further comprising transmitting the sound generated by the loudspeakers through openings in the loudspeaker housing, said openings located offset from the area of the acoustic diaphragms of the loudspeakers.

19. A method of providing low frequency sound to a venue, comprising:

(a) creating a model of the configuration of the venue;

(b) assembling a plurality of loudspeakers in stacked relationship, and positioning the stacked loudspeakers so that the loudspeakers are disposed in a substantially vertical array, wherein each of said loudspeakers comprises low frequency transducers, wherein each of the low frequency transducers is operated via digital signal processor channels;

(c) based on the modeled venue configuration, positioning the stacked vertical array of loudspeakers at one or more locations relative to the venue;

(d) operating each of the low frequency transducers of the loudspeaker individually from each other via a control system that networks the digital signal processor channels together and also networks the speakers together;

(e) testing the output of each low frequency transducer;

(f) setting at least one of the gain, delay, and response of each low frequency transducer individually to direct the sound emanating from the speaker array in selected vertical and horizontal directions;

(g) determining or confirming the configuration of the venue using trilateration techniques; and (h) using the determined/confirmed venue configuration to position the stacked vertical array of loudspeakers at one or more locations relative to the venue.

20. A low frequency loudspeaker, comprising:

(a) a housing;

(b) a plurality of low frequency transducers within the housing;

(c) electronic circuitry operably connected to the low frequency transducers;

(d) a control system monitoring and controlling the operation and performance of the low frequency transducers, said control system comprising a computer processor capable of calculating the loudspeaker output acoustic lobe formation parameters, said control system controlling the operation of the low frequency transducers based in part on the calculated loudspeaker output acoustic lobe formation parameters; and (e) a self-testing program incorporated into the circuitry of the loudspeaker, said self-test program operable to verify that the low frequency transducers of the loudspeaker are operating properly.

21. A low frequency loudspeaker, comprising:

(a) a housing;

(b) a plurality of low frequency transducers within the housing, (c) a control system monitoring and controlling the operation and performance of the low frequency transducers, said control system comprising a computer processor capable of calculating the loudspeaker output acoustic lobe formation parameters, said control system controlling the operation of the low frequency transducers based in part on the calculated loudspeaker output acoustic lobe formation parameters; and (d) wherein said control system functions to verify a specific location relative to each loudspeaker corresponding to the location of a test microphone, said control system generating acoustical impulses from low frequency transducers positioned at different locations to trilaterally locate the microphone and thereby determine the distance and direction of the microphone relative to said low frequency transducers which generate the acoustical impulses.

22. A low frequency loudspeaker, comprising:

(a) a housing;

(b) a plurality of low frequency transducers within the housing;

(c) a control system monitoring and controlling the operation and performance of the low frequency transducers, said control system comprising a computer processor capable of calculating the loudspeaker output acoustic lobe formation parameters, said control system controlling the operation of the low frequency transducers based in part on the calculated loudspeaker output acoustic lobe formation parameters; and (d) at least one proximity sensor disposed on or in the loudspeaker housing, said control system capable of determining the position of the housing based on the output signal from said at least one proximity sensor.

23. A method of providing low frequency sound to a venue, comprising:

(a) creating a model of the configuration of the venue;

(b) assembling a plurality of loudspeakers in stacked relationship, and positioning the stacked loudspeakers so that the loudspeakers are disposed in a substantially vertical array, wherein each of said loudspeakers comprises low frequency transducers, wherein the low frequency transducers are operated via digital signal processor channels;

(c) based on the venue configuration, positioning the stacked vertical array of loudspeakers at one or more locations relative to the venue;

(d) determining the location of each loudspeaker from signals generated by proximity sensors disposed on or in the housings of the loudspeakers; and (e) using the determined locations of the loudspeakers to adjust the operating parameters of the loudspeaker to direct the sound from the loudspeaker in the vertical and horizontal directions.

24. The method of providing low frequency sound to a venue according to claim 23, further comprising operating each of the low frequency transducers of the loudspeaker individually from each other via a control system that networks all the digital signal processor channels together and also networks all of the speakers together.

25. A method of providing low frequency sound to a venue, comprising:

(a) creating a model of the configuration of the venue;

(b) assembling a plurality of loudspeakers in stacked relationship, and positioning the stacked loudspeakers so that the loudspeakers are disposed in a substantially vertical array, wherein each of said loudspeakers comprises low frequency transducers, wherein each of the low frequency transducers is operated via a control system utilizing digital signal processor channels;

(c) based on the venue configuration, positioning the stacked vertical array of loudspeakers at one or more locations relative to the venue; and (d) verifying at least one specific location in the venue relative to each loudspeaker, said at least one specific location corresponding to the location of a test microphone, said control system generating acoustical impulses from the low frequency transducers positioned at different locations to trilaterally locate the microphone and thereby determine the distance and direction of the microphone relative to the low frequency transducers which generate the acoustical impulses.

* * * * *